US005737814A

United States Patent [19]

Kuroyanagi et al.

[11] Patent Number: 5,737,814

[45] Date of Patent: Apr. 14, 1998

[54] JUNCTION TYPE WARP PASSING AND DRAWING-IN METHOD AND APPARATUS

[75] Inventors: Kazunori Kuroyanagi, Inaga-gun; Toyoshi Ito, Hamamatsu, both of Japan

[73] Assignee: Hamamatsu Photonics K.K., Hamamatsu, Japan

[21] Appl. No.: 757,249

[22] Filed: Nov. 27, 1996

[30] Foreign Application Priority Data

Dec. 1, 1995 [JP] Japan ..... 7-314187

[51] Int. Cl.[6] ..... D03J 1/14

[52] U.S. Cl. ..... 28/203.1; 28/204

[58] Field of Search ..... 28/203.1, 204

[56] References Cited

U.S. PATENT DOCUMENTS

| | | | |
|---|---|---|---|
| 4,916,784 | 4/1990 | Tachibana et al. | 28/203.1 |
| 4,989,301 | 2/1991 | Ishii et al. | 28/204 |
| 5,079,811 | 1/1992 | Tachibana et al. | 28/204 |

FOREIGN PATENT DOCUMENTS

| | | |
|---|---|---|
| 63-315646 | 12/1988 | Japan . |
| 2-300356 | 12/1990 | Japan . |
| 3-167349 | 7/1991 | Japan . |
| 5-5253 | 1/1993 | Japan . |
| 5-117943 | 5/1993 | Japan . |

*Primary Examiner*—Andy Falik
*Attorney, Agent, or Firm*—Cushman Darby & Cushman IP Group of Pillsbury Madison & Sutro LLP

[57] ABSTRACT

A method and an apparatus for passing a warp wound around a warp beam through a warp-passing hole of a dropper, a mail of a heald, and a reed eye includes the steps of disposing the warp-passing hole and the mail in a warp conveying passage provided between a warp beam and the reed. A tip portion of the warp is subjected to a vacuum suction and drawn through the warp conveying passage toward the reed. As the warp is drawn through the warp conveying passage, the warp passes through the mail and the warp-passing hole.

14 Claims, 48 Drawing Sheets

JUNCTION TYPE WARP PASSING AND DRAWING-IN METHOD AND APPARATUS

BACKGROUND OF THE INVENTION

1. Field of the Invention

The present invention relates to a warp passing method and warp passing apparatus, and more particularly, to a warp passing method and warp passing apparatus for drawing warps into droppers, healds, and a reed in a preparation stage for use of the warps in a weaving machine.

2. Related Background Art

An example of the conventionally existing warp passing apparatus is the one as described in the bulletin of Japanese Laid-open Patent Application No. 2-300356. The apparatus disclosed in this bulletin is an apparatus that can pass the warp through the dropper, heald, and reed singly. Namely, this apparatus comprises a warp guide passage for having the dropper and heald juxtaposed on the front end side and the reed located on the rear end side, and a jet nozzle for supplying compressed air into the warp guide passage. After a warp-passing hole of a dropper, a mail of a heald, and an arbitrary reed eye of the reed are juxtaposed in the warp guide passage, a nozzle aperture of the jet nozzle is then aligned with the warp-passing hole of the dropper and the mail of the heald in front of the warp guide passage. After that, by supplying a tip portion of the warp toward the warp guide passage as sending the compressed air through the nozzle aperture, the jet force of this compressed air causes the warp to pass through the warp-passing hole of the dropper and the mail of the heald and thereafter pass through the warp guide passage so as to be set through the reed eye of the reed. Then the compressed air for sweeping away the warp is finally supplied to the warp guide passage, so as to sweep the warp away from the warp guide passage, thereby completing a series of operations for passing the warp through the dropper, heald, and reed.

The bulletin of Japanese Laid-open Patent Application No. 5-117943 and the bulletin of Japanese Laid-open Patent Application No. 63-315646 also disclose the warp passing methods utilizing the compressed air. The technology disclosed herein is such that warp passages are funnel-shaped, a compressed air blowing port is formed to face each warp passage, and this compressed air blowing port ejects the compressed air toward the exit of the warp passage.

The conventional warp passing apparatus, however, was complex in structure and it was difficult to surely perform the warp passing in such apparatus because such conventional apparatus had the above-stated structures.

SUMMARY OF THE INVENTION

A specific object of the present invention is to provide a warp passing method and warp passing apparatus for performing the warp passing through the dropper, heald, and reed with certainty.

The warp passing method according to the present invention is a warp passing method for passing a predetermined warp wound around a warp beam through a warp-passing hole of a dropper, a mail of a heald, and a reed eye between reed wires of a reed, comprising: juxtaposing the warp-passing hole of the dropper and the mail of the heald midway in a warp conveying passage provided between the warp beam and the reed, passing a tip portion of the warp, subjected to vacuum suction toward the reed over the entire length of the warp conveying passage, through the warp-passing hole and the mail, and thereafter passing the tip portion of the warp through the reed eye between the reed wires.

In the warp passing method according to the present invention, after the warp-passing hole of the dropper and the mail of the heald are juxtaposed midway in the warp conveying passage, the tip portion of the warp drawn out from the warp beam is made to enter the entrance side of the warp conveying passage under the vacuum suction toward the reed. After that, the tip portion of the warp passes through the warp-passing hole of the dropper and the mail of the heald as traveling in the warp conveying passage because of the vacuum suction. Then the tip portion of the warp passes through the reed eye of the reed on the exit side of the warp conveying passage, thereby completing the drawing-in work of the warp into the dropper, the heald, and the reed.

Moreover, the method may be preferably arranged in such a way that for subjecting the tip portion of the warp to vacuum suction by a plurality of suction portions, the tip portion of the warp is successively fed out to near the suction portions as regulating feed lengths of the warp, so that the warp is conveyed in a staged manner so as to correspond to installation positions of the suction portions in the warp conveying passage, and that during this conveyance the warp is further fed out after a suction portion located near the tip portion of the warp is closed, whereby the tip portion of the warp is conveyed up to a next suction portion.

Further, the method may be preferably arranged in such a way that after the warp has been passed through the dropper, the heald, and the reed, the warp conveying passage is separated into two so as to form a warp sweep aperture, and the warp is swept away to the outside through the warp sweep aperture as moving the dropper and the heald after passing of warp in a sweeping direction.

Moreover, the method may be preferably arranged in such a way that the warp is swept away to the outside through the warp sweep aperture by catching the warp by drawing pieces located before and after the warp conveying passage and moving the warp in the sweeping direction.

When the warp is picked out after the completion of the warp passing, the method may be preferably arranged in such a way that the warp is forced to be discharged through the warp sweep aperture by supplying compressed air into the warp conveying passage.

The warp passing apparatus of the present invention is a warp passing apparatus for passing a predetermined warp wound around a warp beam through a warp-passing hole of a dropper, a mail of a heald, and a reed eye between reed wires of a reed, comprising: a warp guide member extending between the warp beam and the reed, and permitting the dropper and the heald to be juxtaposed in front and rear relation midway and to stand by; a warp conveying passage provided inside of the warp guide member and linearly extending as being open at an upstream end on a side of the warp beam and at a downstream end on a side of the reed; and a suction portion for subjecting the warp to vacuum suction toward the reed over the entire length of the warp conveying passage.

In the warp passing apparatus according to the present invention, after the warp-passing hole of the dropper and the mail of the heald are juxtaposed midway in the warp conveying passage provided in the warp guide member, the tip portion of the warp drawn out from the warp beam is made to enter the entrance side of the warp conveying passage under the vacuum suction toward the reed by the suction portion. After that, the tip portion of the warp passes through the warp-passing hole of the dropper and the mail of the heald as traveling in the warp conveying passage by the vacuum suction of the suction portion. Then the tip portion of the warp passes through the reed eye of the reed on the exit side of the warp conveying passage, thereby completing the drawing-in work of the warp into the dropper, the heald, and the reed.

Moreover, the apparatus may be preferably arranged in such a way that the suction portion has a plurality of suction ports provided in the warp guide member, the suction ports communicating with the warp conveying passage and being closed upon arrival of a tip portion of the warp thereat.

Further, the apparatus may be preferably arranged in such a way that the warp guide member is comprised of a first passage member and a second passage member divided by a plane passing the warp conveying passage, and the warp is swept away to the outside through a warp sweep aperture formed by moving the first passage member relative to the second passage member in a departing direction.

Further, the apparatus may preferably comprise a first drawing piece, disposed between a front end of the warp guide member and the warp beam, for catching the warp in front of the warp guide member to move the warp toward the warp sweep aperture, and a second drawing piece, disposed between a rear end of the warp guide member and the reed, for catching the warp behind the warp guide member to move the warp toward the warp sweep aperture.

Further, when the warp is picked out after the completion of the warp passing the apparatus may be preferably arranged in such a way that the warp guide member further has a sweeping air supply portion communicating with the warp conveying passage to supply compressed air to the warp conveying passage, and that the warp is swept away to the outside through the warp sweep aperture by the compressed air ejected from the sweeping air supply portion.

The present invention will become more fully understood from the detailed description given hereinbelow and the accompanying drawings which are given by way of illustration only, and thus are not to be considered as limiting the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

DESCRIPTION OF THE PREFERRED EMBODIMENTS

The preferred embodiments of the warp passing apparatus and warp passing method according to the present invention will be described in detail with reference to the drawings.

Figure 1:
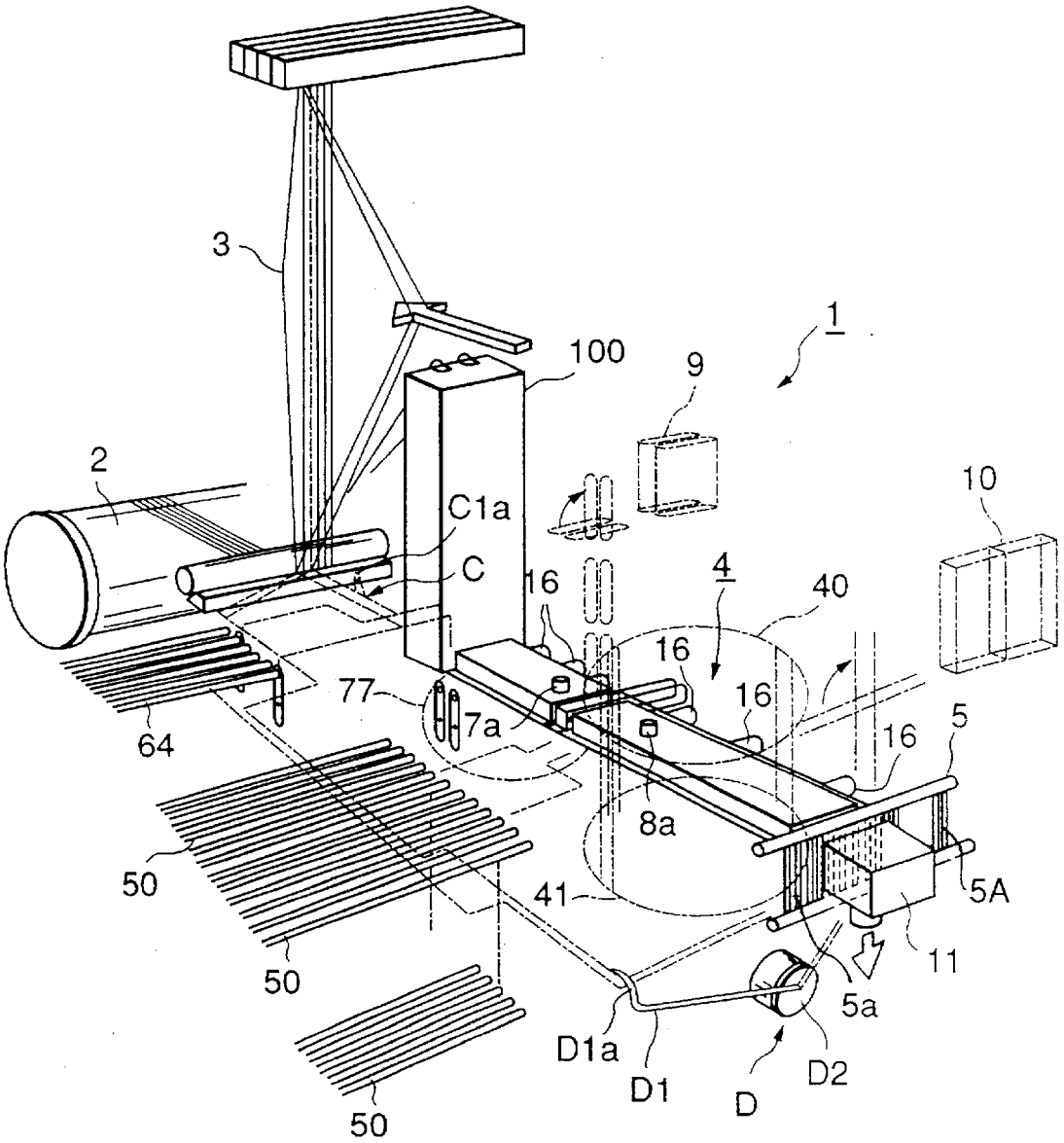
FIG. 1 is a perspective view to show the first embodiment of the warp passing apparatus according to the present invention.
Figure 2:
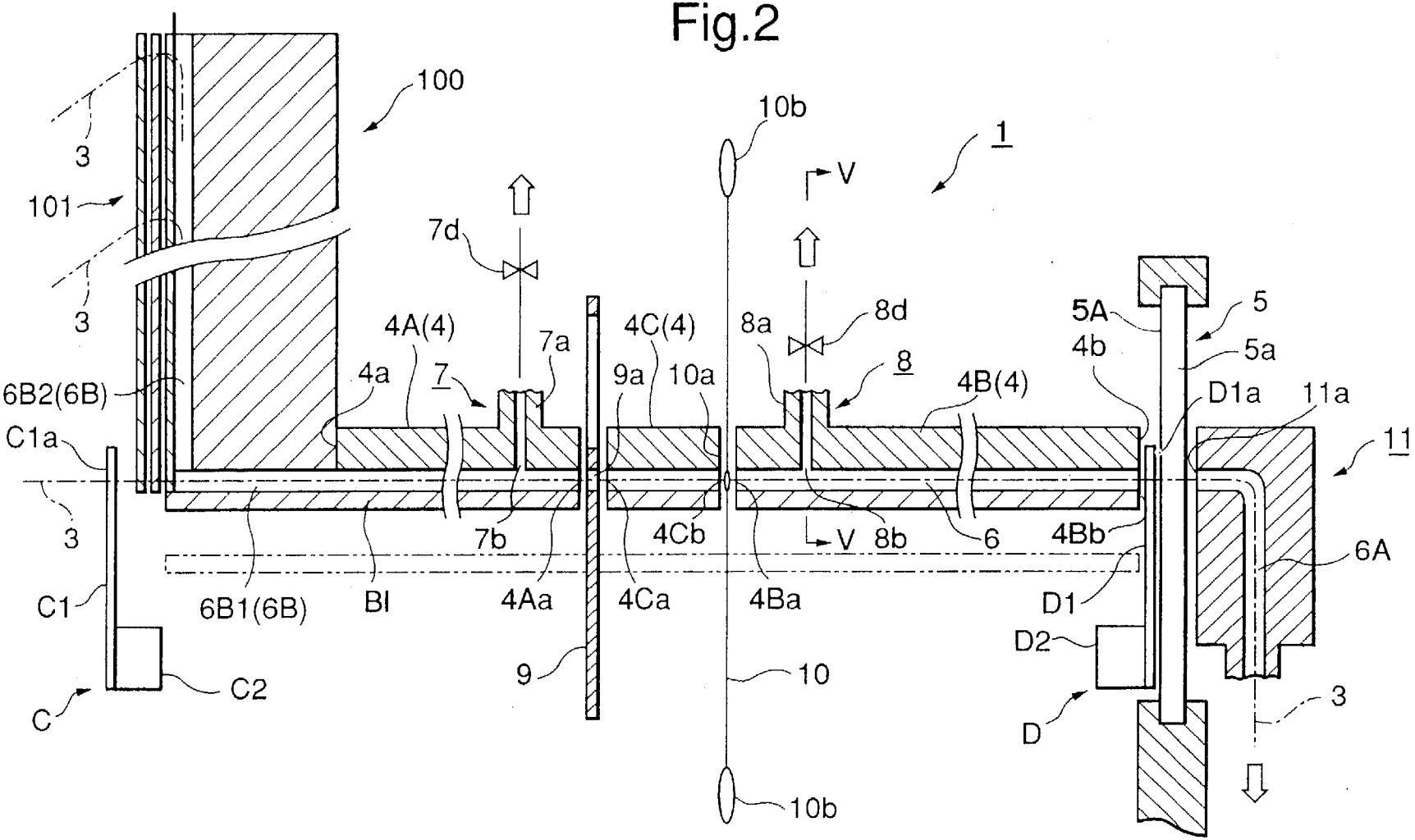
FIG. 2 is a sectional view to show the first embodiment of the warp guide member forming a major part of the present invention.

FIG. 1 is a perspective view to show the warp passing apparatus according to the present embodiment and FIG. 2 is a longitudinal, cross-sectional view of the warp passing apparatus. The warp passing apparatus 1 shown in these drawings comprises a warp guide member 4 for conveying warps 3 wound around a warp beam 2 in a horizontal direction. This warp guide member 4 extends between the warp beam 2 and the reed 5 and is provided with linear warp conveying passages 6 inside thereof. This warp conveying passage 6 is open at the upstream end on the warp beam 2 side and at the downstream end on the reed 5 side, and is divided into upper and lower parts in order to sweep away the warp 3 from the warp conveying passage 6 to the outside. The warp conveying passage 6 may be formed in a linear shape or in a shape bent at a desired position.

Figure 3:
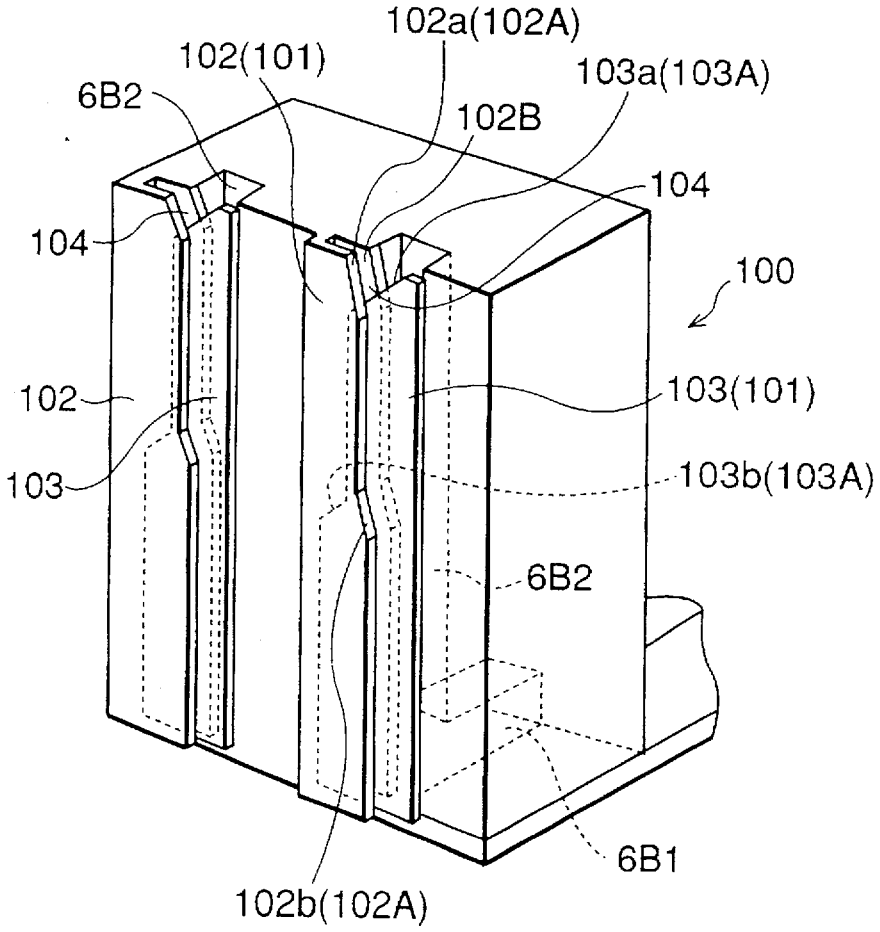
FIG. 3 is a perspective view to show the feed regulating member.

As shown in FIG. 2 and FIG. 3, in the upper part of the warp guide member 4 there are a plurality of (two in the present embodiment) suction portions 7, 8 provided in order to create flow of air in a warp conveying passage 6 as drawing the air out of the warp conveying passage 6. Each suction portion 7, 8 has a suction port 7*b*, 8*b* communicating with the warp conveying passage 6, and each suction port 7*b*, 8*b* is connected to a vacuum pump (not shown) through a suction pipe 7*a*, 8*a*. Moreover, the suction pipe 7*a*, 8*a* is provided with a switch valve 7*d*, 8*d* comprised of an electromagnetic valve or the like. When the switch valve 7*d*, 8*d* is properly opened or closed by a switch valve control signal, vacuum suction through the suction port 7*b*, 8*b* can thus be turned on or off at necessity.

Further, as shown in FIG. 2, the warp guide member 4 is comprised of a first warp guide member 4A located on the warp beam 2 side, a second warp guide member 4B located on the reed 5 side, and a third warp guide member 4C located between the first warp guide member 4A and the second warp guide member 4B, and droppers 9 are positioned in an upright state between the first warp guide member 4A and the third warp guide member 4C, and wire healds 10 are positioned in a vertically stretched condition between the second warp guide member 4B and the third warp guide member 4C.

For passing a warp 3 through the dropper 9 and wire heald 10 using the warp guide member 4, a warp-passing hole 9*a* provided nearly at the center of a dropper 9, a warp discharge port 4Aa of the first warp guide member 4A, and a warp sucking port 4Ca of the third warp guide member 4C are arranged in a line, while a mail 10*a* provided nearly at the center of a wire heald 10, a warp discharge port 4Cb of the third warp guide member 4C, and a warp sucking port 4Ba of the second warp guide member 4B are arranged in a line. As a result, the warp-passing hole 9*a* of the dropper 9 and the mail 10*a* of the wire heald 10 can be arranged in a line on the warp conveying passage 6.

Further, a final suction portion 11 having warp conveying passages 6A inside is located behind the rear end 4*b* of the warp guide member 4, and the reed 5 is located between this final suction portion 11 and the warp guide member 4. By locating a warp discharge port 4Bb of the second warp guide member 4B so as to face a warp sucking port 11*a* of the final suction portion 11, a warp 3 can be sent with certainty from the warp guide member 4 into the final suction portion 11 and the warp 3 can be threaded into a reed eye 5*a* formed between reed wires 5A of the reed 5. This suction of the warp 3 by the final suction portion 11 is continued until the dropper 9 and wire heald 10 after passage of warp are located at respective predetermined places (i.e., at positions of dropper holding rod 64 and heald holding rods 50 as detailed hereinafter) so as to complete all of one warp-passing work.

Here, provided at the front end 4*a* of the warp guide member 4 is a feed regulating member 100 for regulating the feed lengths of warp 3 drawn out from the warp beam 2.

Further, the suction portion 7 described above is provided at the rear end of the first warp guide member 4A (namely, immediately before the dropper 9 , and the suction portion 8 is provided at the front end of the second warp guide member 4B (namely, immediately after the wire heald 10). Then the feed regulating member 100 is mounted in a standing state at the front end of the warp guide member 4 and is provided with warp conveying passages 6B formed in an L-shape inside thereof. This warp conveying passage 6B is comprised of a horizontal passage extending in a horizontal direction and a vertical passage 6B2 extending in a vertical direction, the horizontal passage 6B1 communicates with the warp conveying passage 6 extending in parallel, and the vertical passage 6B2 is open at the top of the feed regulating member 100.

As shown in FIG. 3, on the front surface of the feed regulating member 100 there are shutter portions 101 each provided in order to open the vertical passage 6B2 over the entire length in the warp conveying passage 6B. This shutter portion 101 has a first shutter plate 102 projecting so as to close approximately the half of the opening portion of this vertical passage 6B2 throughout the entire length of the vertical passage 6B2, and a second shutter plate 103 arranged to slide to the side by a desired actuator (not shown) and overlap with the first shutter plate 102, thereby opening and closing the vertical passage 6B2.

A first step portion 102A is formed in a step shape at the inner end of the first shutter plate 102, and this first step portion 102A has an upper step **102*a* projecting to the side, and a lower step 102*b* projecting more than the upper step 102*a*. A second step portion 103A is also formed in a step shape at the inner end of the second shutter plate 103, and this second step portion 103A has an upper step 103*a* projecting to the side, and a lower step 103*b* projecting more than this upper step 103*a*. Further, the first shutter plate 102 is provided with a shutter plate inserting recess 102B formed in a U-shaped cross section in order to accommodate the inner end of the second shutter plate 103, that is, the second step portion 103A. The first step portion 102A of the first shutter plate 102 is formed in symmetry with the second step portion 103A of the second shutter plate 103, whereby cooperative action of the first shutter plate 102 and the second shutter plate 103 can open the vertical passage 6B1** in a staged manner from the top.

Figure 4:
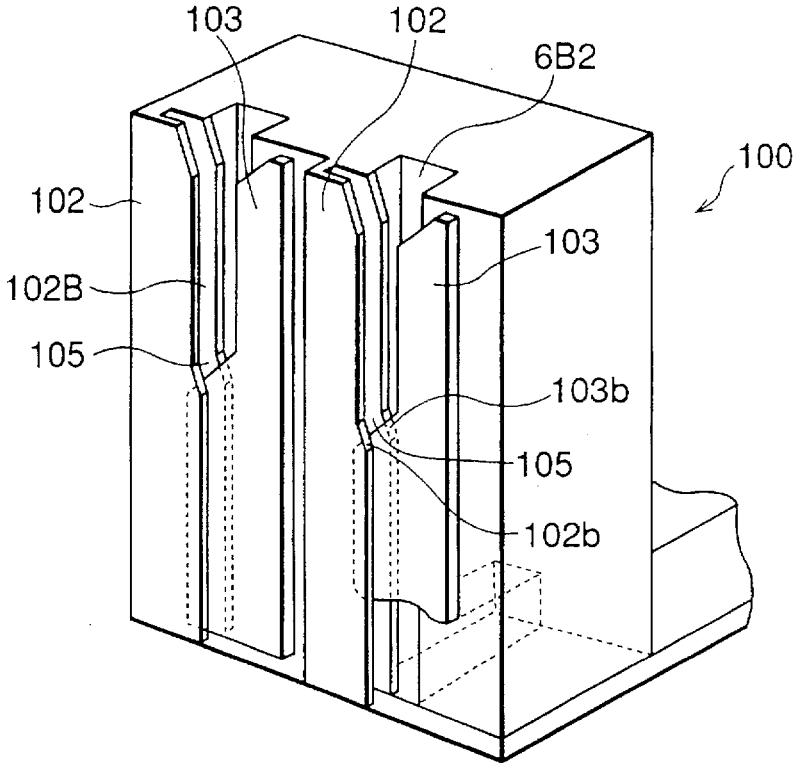
FIG. 4 is a perspective view to show a state after the shutter plate of the feed regulating member is moved.

In more detail, as shown in FIG. 3, a V-shaped first warp regulating portion 104 is formed by a combination of the upper step **102*a* and the upper step 103*a* in the shutter portion 101, and a first feed length in warp 3 is regulated by hooking the warp 3 on this first warp regulating portion 104. Further, as shown in FIG. 4, after the second shutter plate 103 is made to slide, a V-shaped second warp regulating portion 105 is formed by a combination of the lower step 102*b* and the lower step 103*b* in the shutter portion 101, and a second feed length in warp 3 is regulated by hooking the warp 3 on this second warp regulating portion 105. When the second shutter plate 103 is made further to slide so as to disengage the first shutter plate 102 from the second shutter plate 103, the vertical passage 6B2 becomes fully open. Accordingly, sliding of the second shutter plate 103 opens or closes the vertical passage 6B2 so as to change its exposure length, thereby enabling staged feed of the warp 3**.

In the first stage of feed of warp, as the feed length of warp 3 is regulated by the feed regulating member 100 (see FIG. 3), the tip portion of warp 3 is stopped immediately before the suction port **7*b* in the suction portion 7. As a result, the tip portion of warp 3 maintains a state immediately before passing through the dropper 9 and wire heald 10 as being drawn by the suction portions 7, 8, 11. Next, in the second stage of warp feed, after the electromagnetic valve 7*d* is closed to turn the vacuum suction from the suction port 7*b* off, the tip portion of warp 3 is stopped immediately before the suction port 8*b* of the suction portion 8 as the feed length of warp 3 is regulated by the feed regulating member 100 (see FIG. 4). As a result, the tip portion of warp 3 is drawn by the suction portions 8, 11 so as to maintain a state immediately after passed through the dropper 9 and wire heald 10**.

Then, in the third stage of warp feed, after the electromagnetic valve **8*d* is closed to turn the vacuum suction from the suction port 8*b* off, regulation of the feed length of warp 3 by the feed regulating member 100 is released, so that the tip portion of warp 3 is drawn by the final suction portion 11 so as to pass through the reed eye 5*a* of the reed 5, thus completing the warp-passing step of warp 3**.

Before completion of all of one warp-passing work, the final suck portion 11 continues sucking the tip portion of warp 3. By increasing or decreasing the number of suction portions described above in accordance with the length of the warp conveying passage 6 and also increasing or decreasing the number of step portions in the shutter plate corresponding to the number of suction portions, more certain conveyance of warp 3 becomes possible. Even if the tip portion of warp 3 is inserted in a bent state into the feed regulating member 100, the vacuum suction by the suction portions 7, 8, 11 can correct for the bent into a straight state during movement in the warp conveying passage 6 or during stop by the suction portion 7, 8.

Figure 5:
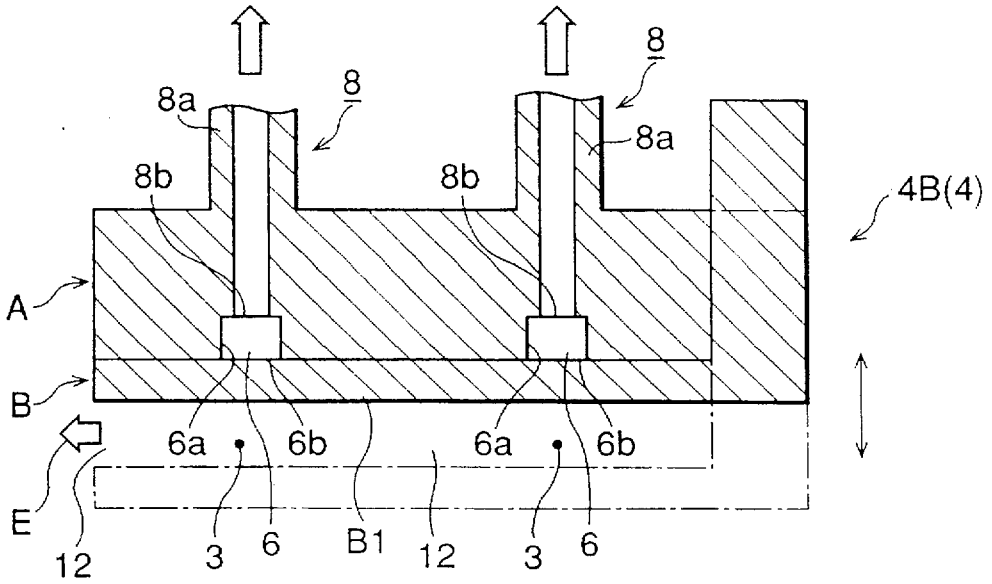
FIG. 5 is a cross-sectional view along V—V line of FIG. 2.

Here, as shown in FIG. 5, the warp guide member 4 is divided into two by a horizontal plane passing the warp conveying passage 6. Namely, the warp guide member 4 is divided into upper first passage member A and lower second passage member B so as to separate the warp conveying passage 6 into two, the first passage member A is formed in a block shape, and the second passage member B is formed in a plate shape. Warp conveyance grooves **6*a* are formed in a U-shaped cross section as extending in the conveyance direction of warp 3 in the lower surface of the first passage member A, and apertures 6*b* of the warp conveyance grooves 6*a* are closed by a cover plate B1 of the second passage member B. Further, the cover plate B1** is arranged to move up and down by a predetermined actuator (a piston cylinder device, for example).

Accordingly, when this actuator is actuated to move the cover plate B1 up and down, the apertures **6*b* of the warp conveying passages 6 can be opened and closed. Thus, when this cover plate B1 is moved down to move the second passage member B relative to the first passage member A in a departing direction, a warp sweep aperture 12 can be created between the bottom surface of the first passage member A and the top surface of the cover plate B1 of the second passage member B. As described, when the top surface of the cover plate B1 is in contact with the bottom surface of the first passage member A, the warps 3 can be conveyed in the warp conveying passages 6; when the top surface of the cover plate B1 is separated away from the bottom surface of the first passage member A, the warps 3 can be discharged to the outside through the apertures 6*b* of the warp conveying passages 6 and the warp sweep aperture 12. At this time, the droppers 9 and wire healds 10 after passing of warp are mechanically moved in the sweep direction (or in the direction of arrow E), whereby the warps 3 are carried to the outside through the warp sweep aperture 12 with movement of the droppers 9 and wire healds 10 after passing of warp and with actuation of drawing pieces C1, D1** described hereinafter.

Figure 6:
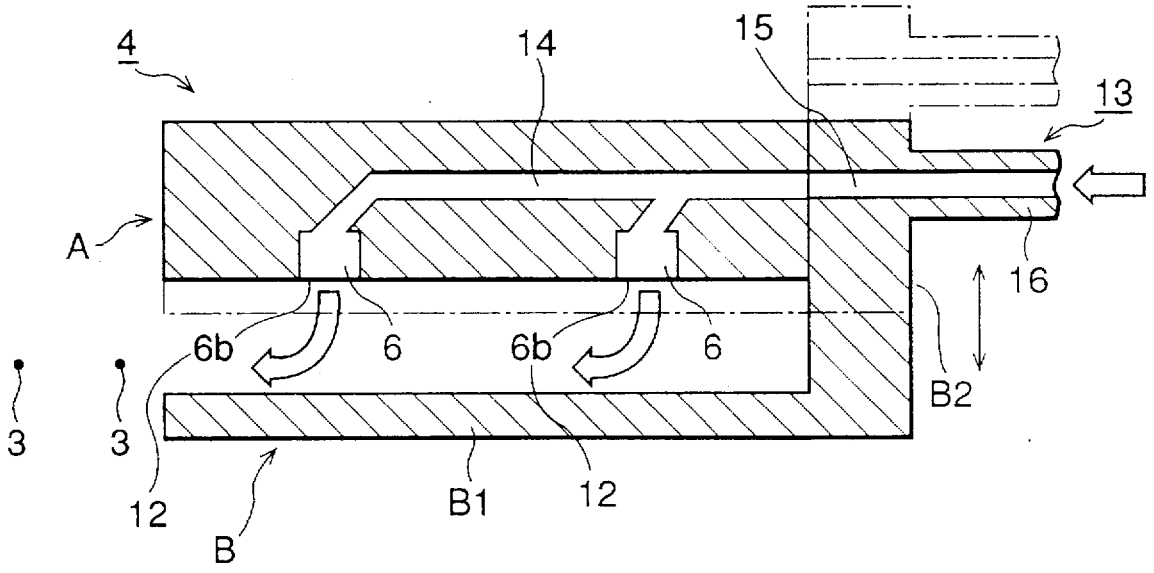
FIG. 6 is a cross-sectional view to show the sweeping air supply portion applied to the warp guide member.

In addition, as shown in FIG. 6, the warp guide member 4 is provided with a plurality of sweeping air supply portions 13 for supplying compressed air into the warp conveying passages 6, and each sweeping air supply portion 13 has a first compressed air supply passage 14 provided inside the first passage member A and communicating with the warp conveying passages 6, and a second compressed air supply passage 15 formed in a standing plate B2 of the second passage member B and communicating with the first compressed air supply passage 14 only upon supply of compressed air. Further, a plurality of jet pipes 16 for compressed air connected to the second compressed air supply passages 15 are disposed to stand on the outer wall surface of the standing plate B2, and these jet pipes 16 are connected to an air supply source not shown and are arranged at predetermined intervals along the longitudinal direction of the warp guide member 4 (see FIG. 1).

Thus, by moving the second passage member B down by the actuator (not shown), the first compressed air supply passages 14 are made to match with the second compressed air supply passages 15 so as to form compressed air flow paths and so as to form the warp sweep aperture 12 between the first passage member A and the second passage member B. Then the compressed air discharged from the air supply source not shown is supplied through the first and second compressed air supply passages 14, 15 into the warp conveying passages 6, so that the compressed air can be ejected from the apertures 6*b* toward the warp sweep aperture 12. Therefore, the stream of compressed air forces to expel the warps 3 located in the warp conveying passages 6 from the warp conveying passages 6, and thereafter the warps are driven out to the outside through the warp sweep aperture 12 as moving along the cover plate B1 of the second passage member B.

Here, the sweeping air supply portions 13 are used mainly or supplementarily when the warps 3 are driven out through the warp sweep aperture 12. Especially, it is effective to supplementarily utilize the sweeping air supply portions 13 in driving heavy warps 3 of thick yarn number out with certainty. As a matter of course, the sweeping air supply portions 13 described above are not necessary as long as the warps 3 can be discharged completely through the warp sweep aperture 12 by the operation of the drawing pieces C1, D1 described hereinafter with movement of the droppers 9 and wire healds 10 after passing of warp in the sweep direction (or in the direction of arrow E).

Further, as shown in FIG. 1 and FIG. 2, first and second warp drawing-out mechanisms C, D are provided on the warp beam 2 side and on the reed 5 side. The first warp drawing-out mechanism C comprises a first drawing piece C1 disposed between the front end 4*a* of the warp guide member 4 (preferably, the feed regulating member 100) and the warp beam 2 and arranged to rotate in a plane perpendicular to the warps 3 in front of the warp guide member 4, a first hook portion C1*a* provided at the tip of the first drawing piece C1 and arranged to catch the warps 3 with rotation of the first drawing piece C1 to move the warps toward the warp sweep aperture 12, and a first rotary solenoid C2 provided at the base end of the first drawing piece C1 arranged to rotate the first drawing piece C1. Accordingly, by driving the first rotary solenoid C2, the first hook portion C1*a* can be rotated so as to traverse the warps 3 exposed as located in front of the warp guide member 4. At this time, in front of the front end 4*a* of the warp guide member 4, the hook portion C1*a* catches the warps 3 from the back to move the warps 3 forward toward the warp sweep aperture 12, so that the warps located in front of the warp guide member 4 are finally forced to be swept away from the warp guide member 4.

The second warp drawing mechanism D comprises a second drawing piece D1 disposed between the rear end 4*b* of the warp guide member 4 and the reed 5 and arranged to rotate in a plane perpendicular to the warps 3 behind the warp guide member 4, a second hook portion D1*a* disposed at the tip of the second drawing piece D1 and arranged to catch the warps 3 with rotation of the second drawing piece D1 to move the warps 3 toward the warp sweep aperture 12, and a second rotary solenoid D2 provided at the base end of the second drawing piece D1 and arranged to rotate the second drawing piece D1. Accordingly, by driving the second rotary solenoid D2, the second hook portion D1*a* can be rotated so as to traverse the warps 3 exposed as located behind the warp guide member 4. At this time, behind the rear end 4*b* of the warp guide member 4, the hook portion D1*a* catches the warps from the back to move the warps 3 forward toward the warp sweep aperture 12, so that the warps 3 located behind the warp guide member 4 are finally forced to be swept away from the warp guide member 4.

As described, utilizing the first drawing piece C1 and second drawing piece D1, the warps 3 can be driven out of the warp conveying passages 6 throughout the entire length of the warp conveying passages 4 with certainty. There could occur an unforeseen accident that a warp 3 near the lower end of the feed regulating member 100 and near the reed 5 fails to be driven out through the warp sweep aperture 12, when the droppers 9 and wire healds 10 after passing of warp move in the sweep direction (in the direction of arrow E in FIG. 5) to expel the warps 3 through the warp sweep aperture 12, and therefore, the first and second drawing pieces C1, D1 have a significant role in order to prevent such incomplete sweep. The means for driving the drawing pieces C1, D1 is not always limited to the rotary solenoids C2, D2 as described above, but may be replaced by linear actuators (air cylinders, for example) performing translational motion, or rotary actuators (electric motors, for example).

Next explained is the structure to pass the warp 3 through the heald 10 by the warp passing apparatus 1 utilizing the aforementioned warp guide member 4.

Figure 7:
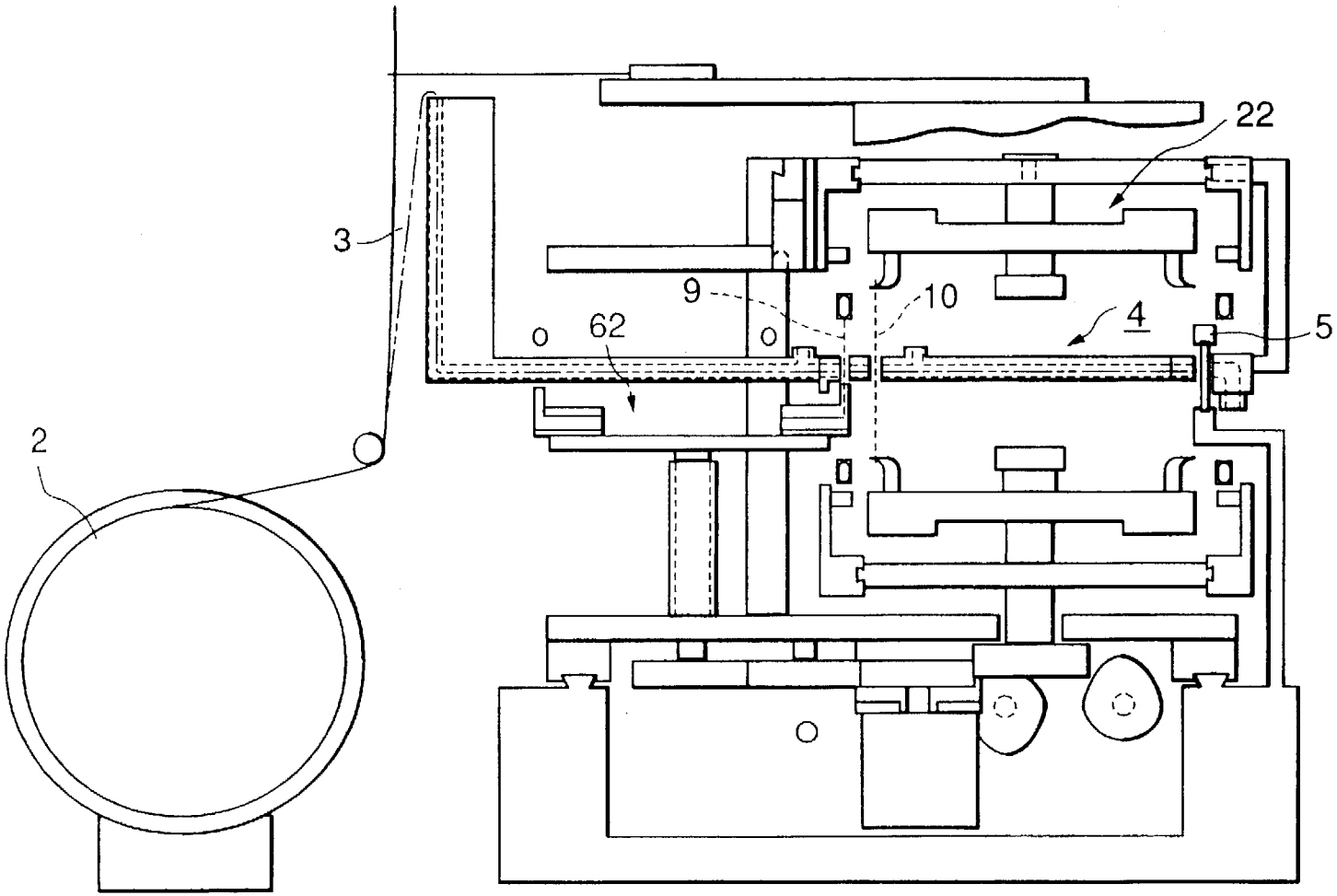
FIG. 7 is a side view of the warp passing apparatus according to the present invention.
Figure 8:
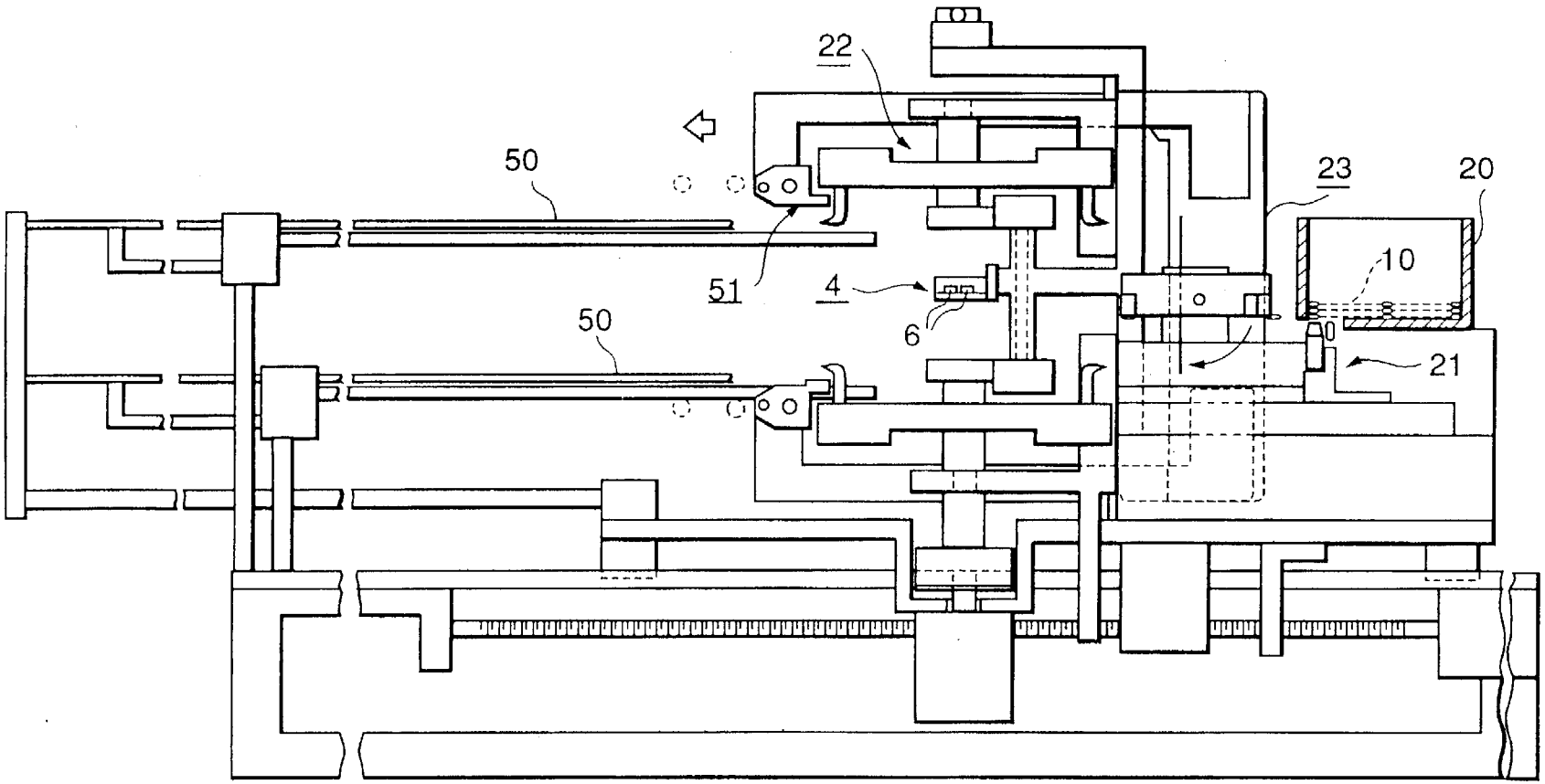
FIG. 8 is a front view of the warp passing apparatus according to the present invention.
Figure 9:
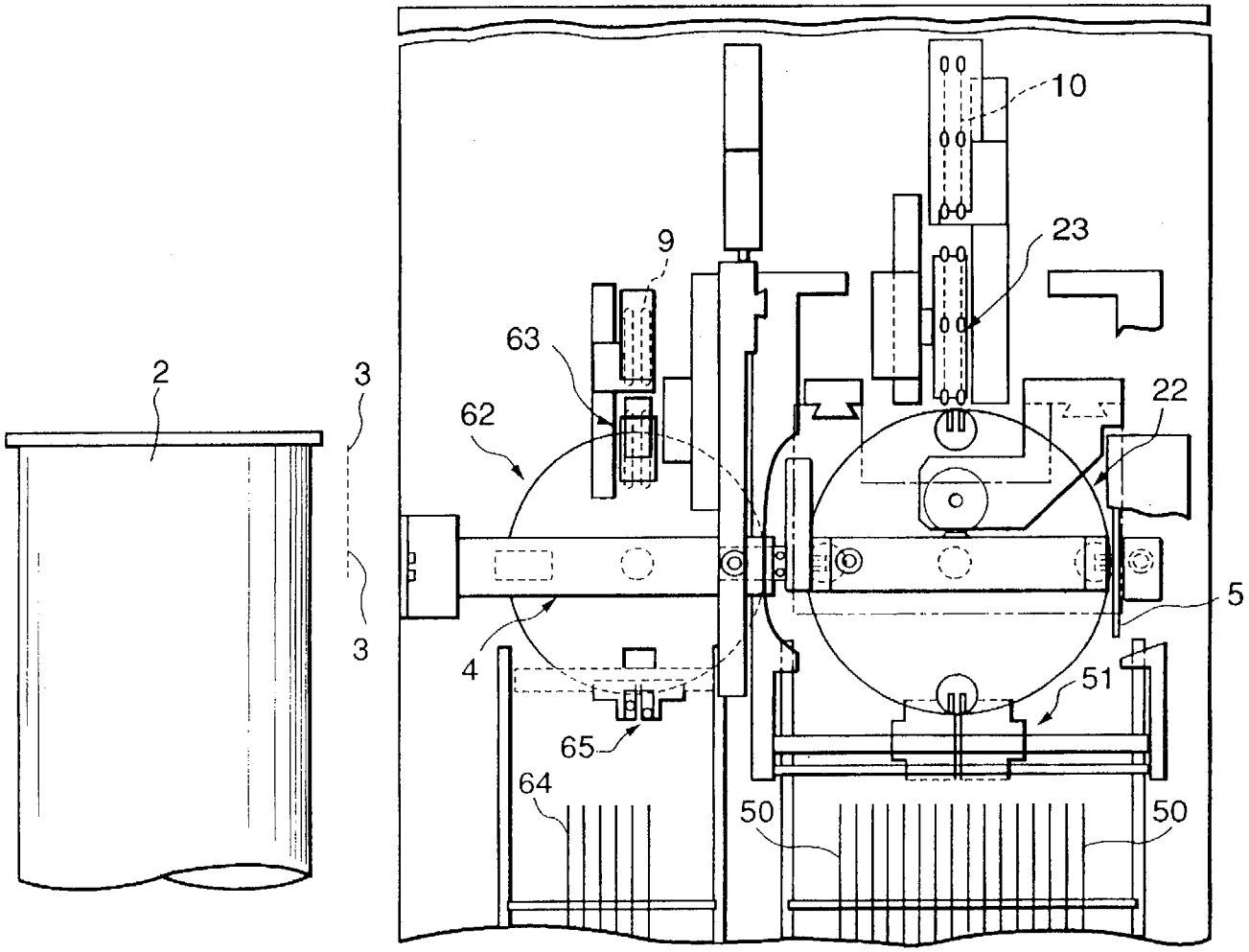
FIG. 9 is a plan view of the warp passing apparatus according to the present invention.

FIG. 7 is a front view to show the whole of the warp passing apparatus, FIG. 8 is a side view thereof, and FIG. 9 a plan view thereof. As shown in these drawings, the warp passing apparatus 1 comprises a stocker 20 for healds to stock healds 10 at a predetermined place in a stack and in a lying state (in a horizontal state), a heald drawing mechanism 21 for completely drawing a lowermost heald 10 in a horizontal direction out of plural healds 10 stacked in the stocker 20, a heald carrying mechanism 22 for carrying one heald 10 withdrawn from the stocker 20 to a position where it traverses the warp conveying passage 6 of the warp guide member 4, a heald transferring mechanism 23 for transferring the heald 10 withdrawn by the heald drawing mechanism 21 to the heald carrying mechanism 22, and a heald sending mechanism 51 for bringing guide holes 10*b* (see FIG. 14) of the heald 10 after passing of warp, mounted on the heald carrying mechanism 22, into fit with the heald holding rods 50.

Figure 10:
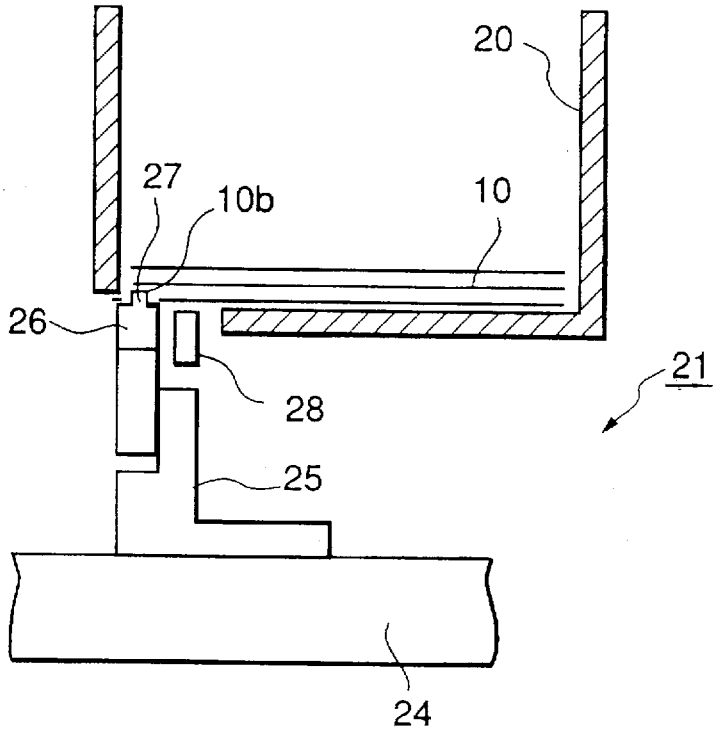
FIG. 10 is a schematic drawing to show the heald drawing mechanism located below the stocker for healds.
Figure 11:
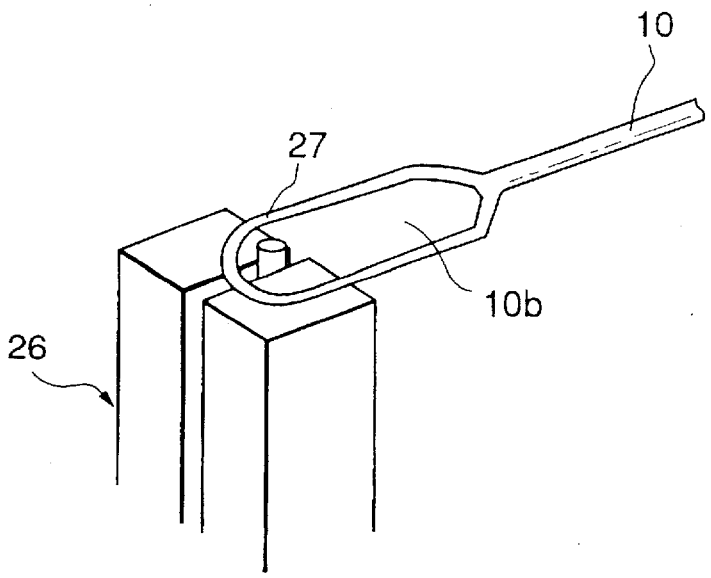
FIG. 11 is a perspective view to show a state in which the drawing pin provided in the magnetic head is put in the guide hole of heald.

Here, as shown in FIG. 10, the heald drawing mechanism 21 is disposed below the stocker 20, and this heald drawing mechanism 21 is provided with a conveyance block 25 arranged to move in horizontal directions along a translation stage 24 extending in a horizontal direction. Attached to the upper part of the conveyance block 25 is a magnetic head 26 for drawing of heald, arranged to move up and down immediately below the guide hole 10*b* provided at the end of heald 10, and this magnetic head 26 composes an electromagnet comprised of a magnetic member of soft iron or the like around which an electromagnetic coil is wound. Further, as shown in FIG. 11, a drawing pin 27 made of a non-magnetic material is fixed to the top part of the magnetic head 26. Therefore, when this drawing pin 27 is located immediately below the guide hole 10*b* of heald 10 and when the magnetic head 26 is moved up, the drawing pin 27 can be inserted into the guide hole 10*b* and the heald 10 is made to magnetically stick to the magnetic head 26, whereby the heald 10 can be drawn horizontally while preventing the heald 10 from dropping off from the drawing pin 27.

Figure 12:
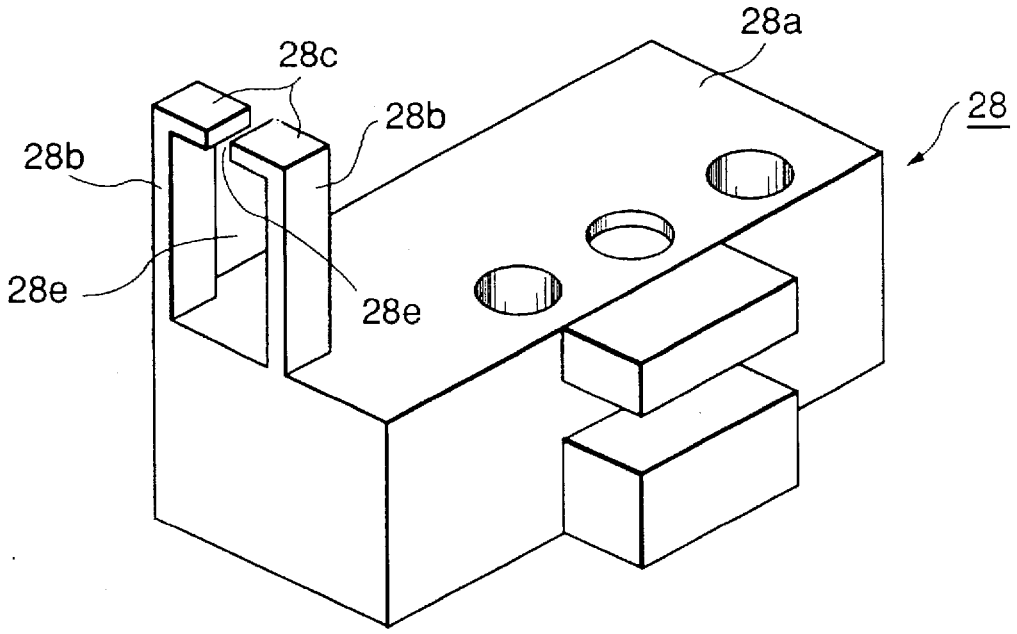
FIG. 12 is a perspective view to show the push head for pushing the healds in the stocker up.

In addition, the heald drawing mechanism 21 is provided with a push head 28 as a heald separating member disposed adjacent to the magnetic head 26. This push head 28 has a base 28*a* arranged to move up and down, as shown in FIG. 12, and a pair of push claws 28*b* stand on the top surface of the base 28*a*. Further, a claw portion 28*c* projecting inward is provided at the tip of each push claw 28*b*, and a gap 28*d* formed between the tips of the pair of claw portions 28*c* is formed in such a size that a wire portion 10*c* of the heald 10 can pass therethrough.

Figure 13:
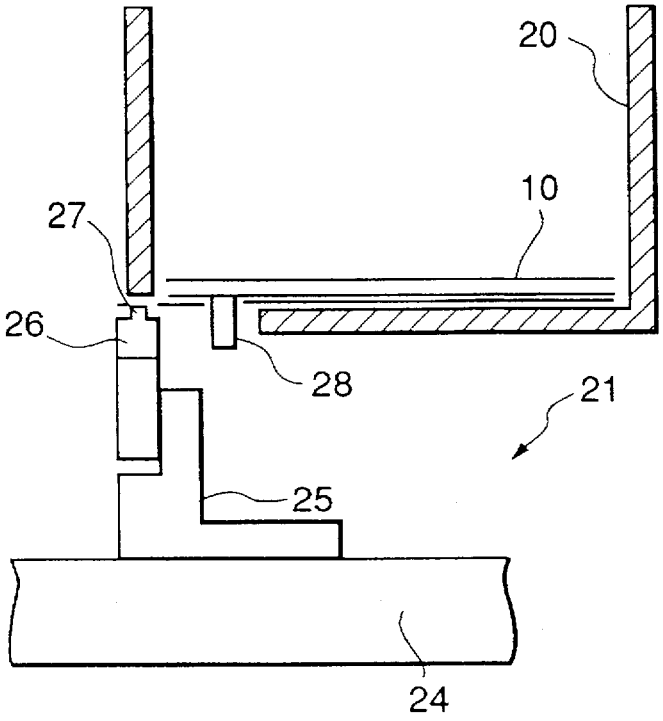
FIG. 13 is a schematic drawing to show a state in which a heald is drawn out slightly utilizing the heald drawing mechanism.
Figure 14:
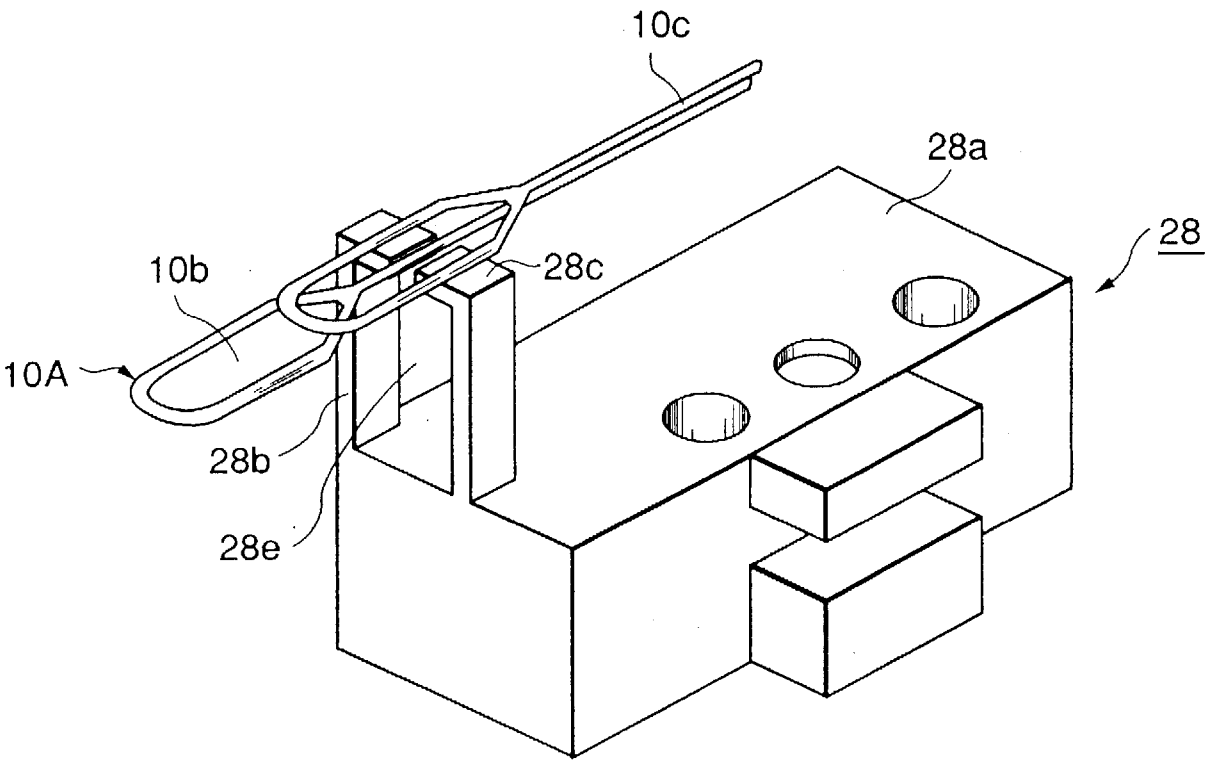
FIG. 14 is a perspective view to show a drawn state of a heald above the push head.

Then, as shown in FIG. 13 and FIG. 14, the end portion 10A of heald 10 is made to magnetically stick to the magnetic head 26, thereby inserting the drawing pin 27 into the guide hole 10*b*, and thereafter the heald 10 is drawn out slightly from the stocker 20 by the drawing pin 27. After that, the push head 28 is moved up so as to pass the wire portion 10*c* of the heald 10 located at the lowermost through the gap 28*d* between the claw portions 28*c*, and at the same time, the end portion 10A of heald 10 located in the second place from the bottom is pushed up by the top surfaces of the claw portions 28*c*, thereby separating only the lowermost heald 10 from the other healds 10. Also on the way of drawing the heald 10, the lowermost heald 10 can be kept through the gap 28*e* between the push claws 28*b*, and thus, the lowermost heald 10 can be drawn out smoothly using the drawing pin 27 while separating the lowermost heald 10 from the other healds 10.

Figure 15:
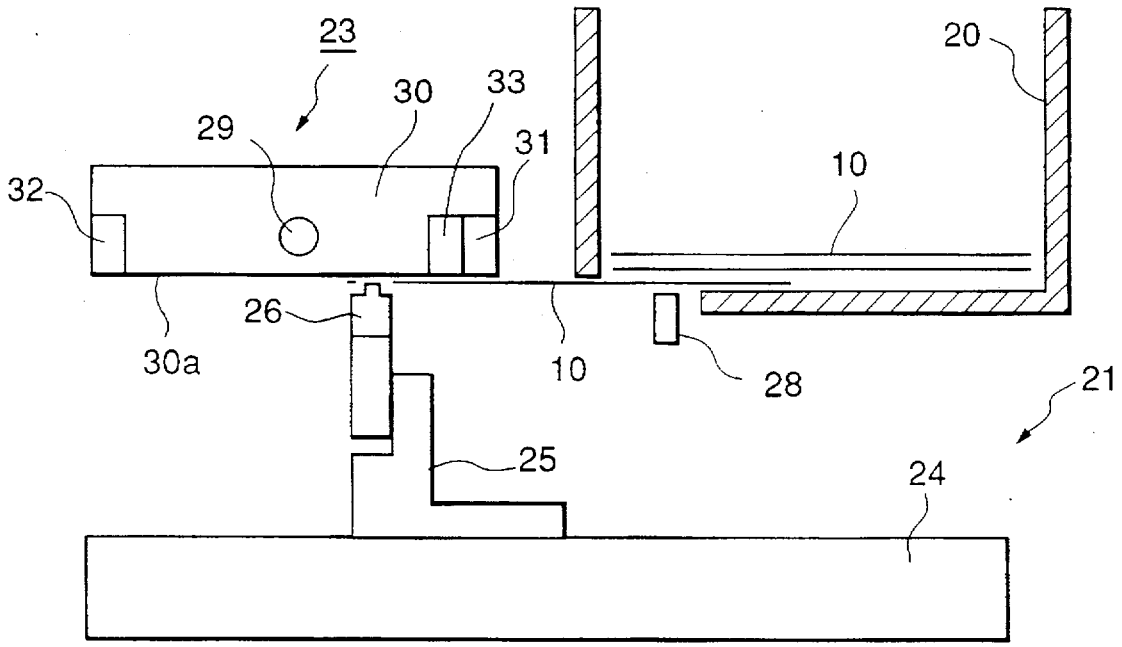
FIG. 15 is a schematic drawing to show an intermediate state on the way of drawing the heald from the stocker using the heald drawing mechanism.

As shown in FIG. 15, the heald transferring mechanism 23 is positioned in front of the stocker 20, and this heald transferring mechanism 23 has a standing block 30 arranged to rotate 90° about a support shaft 29 located nearly at the center. This standing block 30 is provided with a heald conveying surface 30*a*, and this heald conveying surface 30*a* rotates from a parallel state with the translation stage 24 to a perpendicular state thereto by rotating the standing block 30 by 90° about the support shaft 29. Further, first and second magnetic heads 31, 32 for securing the heald, which compose respective electromagnets, are provided at positions to meet the heald conveying surface 30*a* at the both ends of the standing block 30, and a distance between these first magnetic head 31 and second magnetic head 32 corresponds to the length of heald 10.

Figure 16:
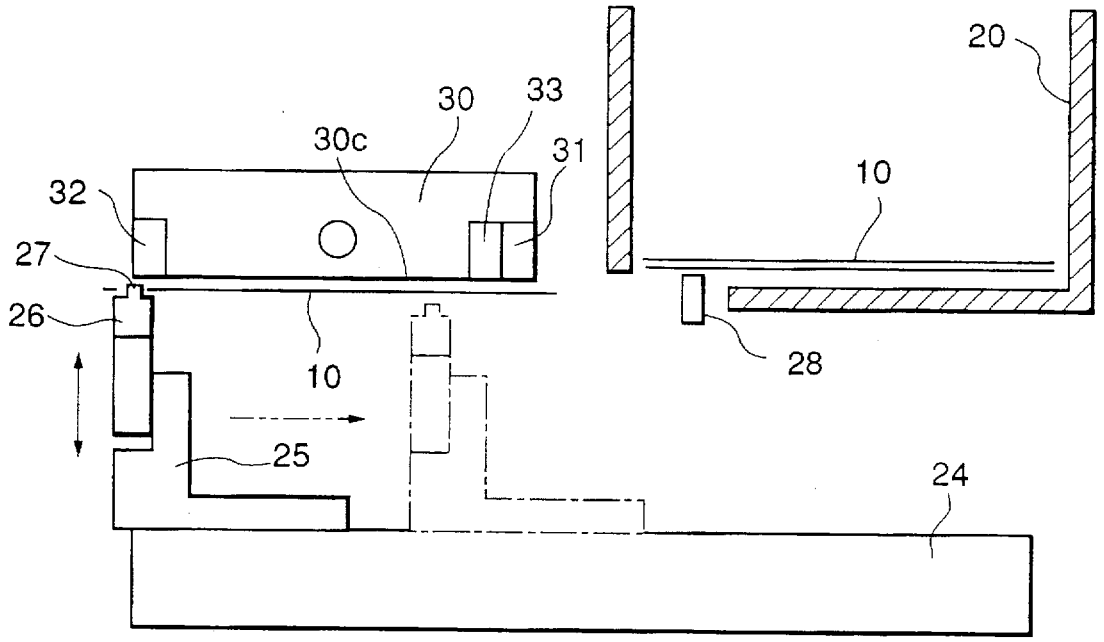
FIG. 16 is a schematic drawing to show a completely drawn state of the heald from the stocker using the heald drawing mechanism.

Thus, by keeping the both ends of the heald 10, completely withdrawn from the stocker 20 using the drawing pin 27, magnetically stuck to the first and second magnetic heads 31, 32, the heald 10 can be transferred from the heald drawing mechanism 21 to the heald transferring mechanism 23 (see FIG. 16). As shown in FIG. 15, if the coil wound around the magnetic head 31 is energized while the heald 10 is drawn out from the stocker 20 using the drawing pin 27, the heald 10 can be made to magnetically stick to the first magnetic head 31 magnetized, which enables stable drawing of heald 10.

Further, the standing block 30 is provided with a degaussing head 33 located between the first magnetic head 31 and the second magnetic head 32, and this degaussing head 33 is disposed adjacent to the first magnetic head 31 on the heald-entering side, and a steady-state alternating current for degaussing is made to flow through the coil wound around the degaussing head 33. Therefore, the degaussing head 33 can erase the remanence occurring in the heald 10 because of the magnetic action of the first magnetic head 31 when the heald 10 is drawn out of the stocker 20 as kept in contact with the degaussing head 33, thus eliminating the remanence from the heald 10.

As shown in FIG. 16, the heald 10 is moved forward up to the front end of the standing block 30 along the translation stage 24 while keeping the heald conveying surface 30*a* of the standing block 30 horizontal. As a result, the heald 10 is completely drawn out of the stocker 20 as being magnetically stuck to the first magnetic head 31, so that the both ends 10A of heald 10 come to face the first and second magnetic heads 31, 32. At this time the current to the coil wound around the magnetic head 26 for drawing of heald is switched to a damping alternating current for degaussing, whereby the remanence of the heald 10 magnetized by the magnetic head 26 upon magnetic sticking can be erased completely. After that, the second magnetic head 32 is energized to generate magnetic force in the second magnetic head 32. As a result, one end 10A of heald 10 is transferred from the magnetic head 26 to the second magnetic head 32, thereby completing the operation to transfer the heald 10 from the heald drawing mechanism 21 to the heald transferring mechanism 23.

After that, the magnetic head 26 is moved down relative to the conveying block 25 to fully pull the drawing pin 27 out of the guide hole 10*b* of the heald 10, and the conveying block 25 is moved backward along the translation stage 24 to take the drawing pin 27 back to the predetermined position of the stocker 20. As a result, the magnetic head 26 and drawing pin 27 go into a drawing standby state of heald 10 as located below the stocker 20. Then, without interference of the conveying block 25, the standing block 30 can be rotated 90° about the support shaft 29.

Figure 17:
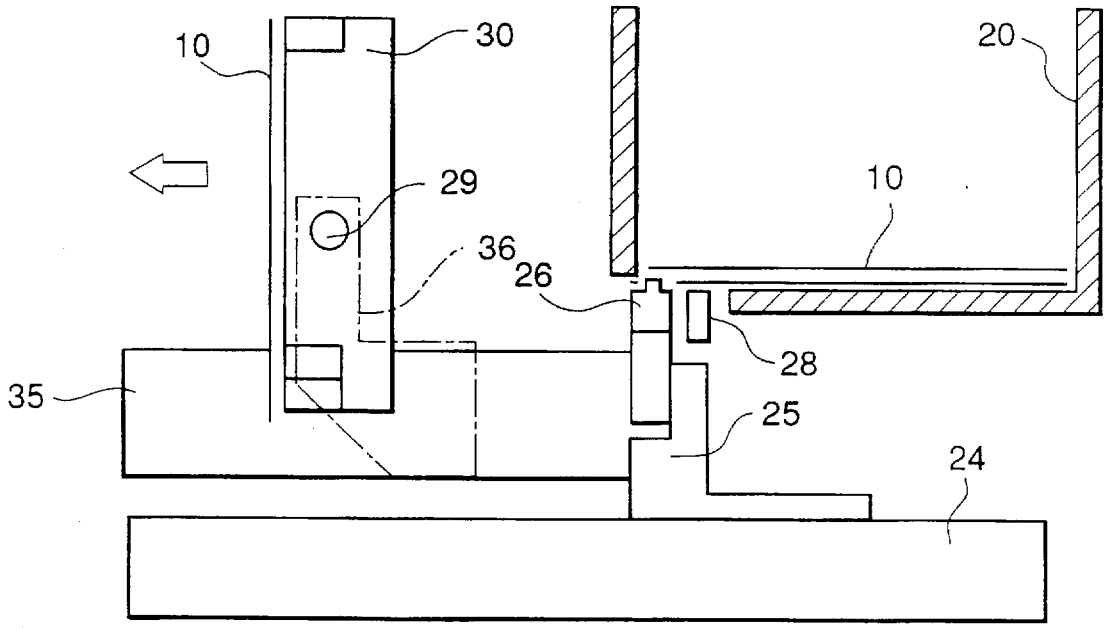
FIG. 17 is a perspective view to show a state of the standing block rotated 90° after the heald is secured to the standing block.

As shown in FIG. 17, the standing block 30 is connected through a support frame 36 to the translation stage 35 extending in the horizontal direction. Therefore, when the standing block 30 is rotated about the support shaft 29 into an upright state, the heald 10 magnetically stuck to the first and second magnetic heads 31, 32 can also stand up at the same time. Then the support frame 36 is moved forward in the arrow direction along the translation stage 35, whereby the heald 10 can be conveyed in the upright state toward the heald carrying mechanism 22.

Figure 18:
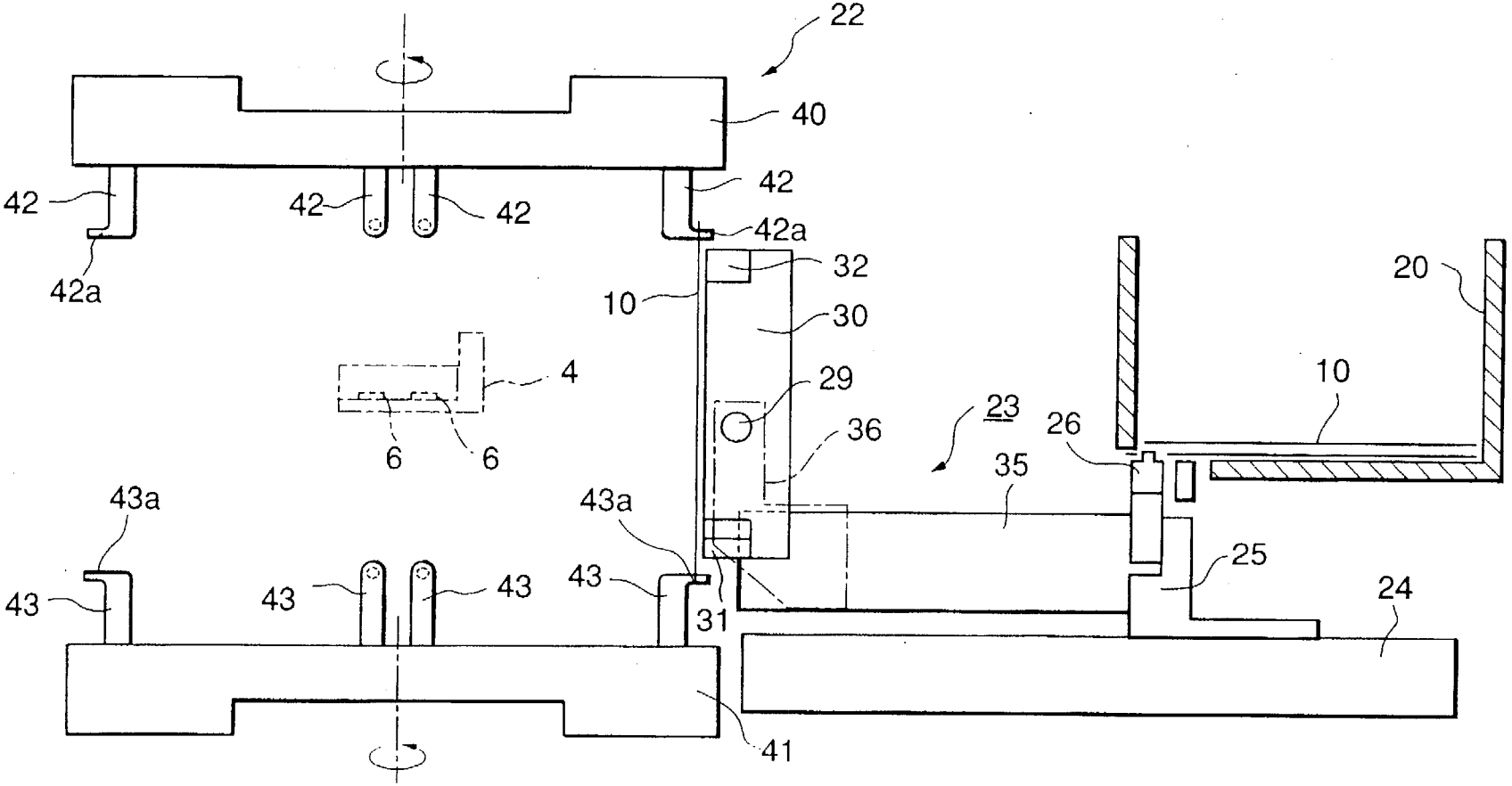
FIG. 18 is a schematic drawing to show the heald carrying mechanism.

As shown in FIG. 18, the heald carrying mechanism 22 has disk-shaped upper and lower index tables 40, rotatably arranged so as to face to each other in up-and-down relation. A plurality of upper hooks 42 projecting downward and fixed are provided on the bottom surface of the upper index table 40, while a plurality of lower hooks 43 projecting upward and arranged to translate up and down are provided on the top surface of the lower index table 41. Also, claw portions 42*a*, 43*a* on which the guide holes 10*b* of heald 10 are to be hooked are provided as projecting outward at the tips of the upper hooks 42 and lower hooks 43. Therefore, by moving the lower hook 43 up and down, the distance between the claw portion 42*a* of the upper hook 42 and the claw portion 43*a* of the lower hook 43 can be varied.

There are four sets of upper hooks 42 and lower hooks 43 provided at index angles of 90° on the index tables 40, 41, respectively. The number of hooks 42, 43 in each set corresponds to the number of warp conveying passages 6 in the warp guide member 4, and in the present embodiment, two hooks 42, 43 compose a set, because there are two warp conveying passages 6. By making the upper hooks 42 and lower hooks 43 vertically face to each other, the heald 10 can be stretched by predetermined tension through cooperative action of the upper hook 42 and lower hook 43.

Here, for transferring the heald 10 from the heald transferring mechanism 23 to the heald carrying mechanism 22, the standing block 30 is moved to near the index tables 40, 41 on the translation stage 35. At this time the standing block 30 is moved before the claw portions 42*a* and 43*a* of a pair of upper hook 42 and lower hook 43 located up and down are inserted into the guide holes 10*b* of the heald 10. When the claw portions 42*a* and 43*a* are set in the guide holes 10*b* of the heald 10, the electric current to the coils wound around the first and second magnetic heads 31, 32 and around the degaussing head 33 is switched to the damping alternating current for degaussing, whereby the sticking force of each of these heads 31, 32, 33 is turned to zero and the remanence of heald 10 is erased, thereby completing the operation to transfer the heald 10 from the heald transferring mechanism 23 to the heald carrying mechanism 22.

Figure 19:
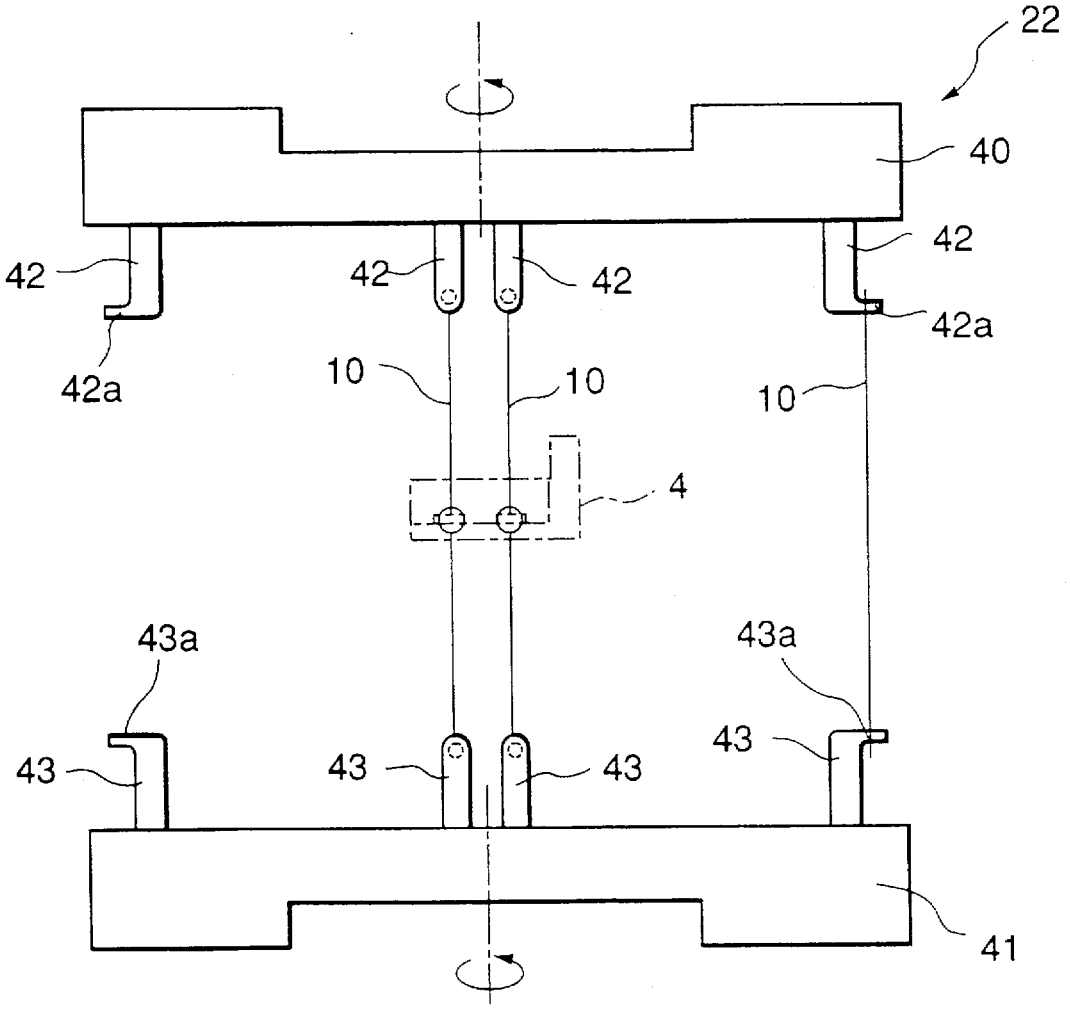
FIG. 19 is a schematic drawing to show a state of the heald located in the warp guide member using the heald carrying mechanism.

After that, by lowering the lower hook 43 slightly, the heald 10 transferred to the claw portions 42*a*, 43*a* can be stretched by predetermined tension between the index tables 40, 41. When the index tables 40 and 41 are rotated 90° in synchronization as maintaining this state, the heald 10 can be carried into the warp guide member 4 as shown in FIG. 19. At this time, as shown in FIG. 2, the mail 10*a* of each heald 10 is aligned with the warp conveying passage 6, thereby completing preparation for passing of warp into the heald 10. Then the warp 3 is subjected to vacuum suction in the warp conveying passage 6, whereby the warp 3 is passed through the mail 10*a* of heald 10, and the warp 3 is driven out to the outside from the warp guide member 4, thus completing the warp-passing work into the heald 10.

Figure 20:
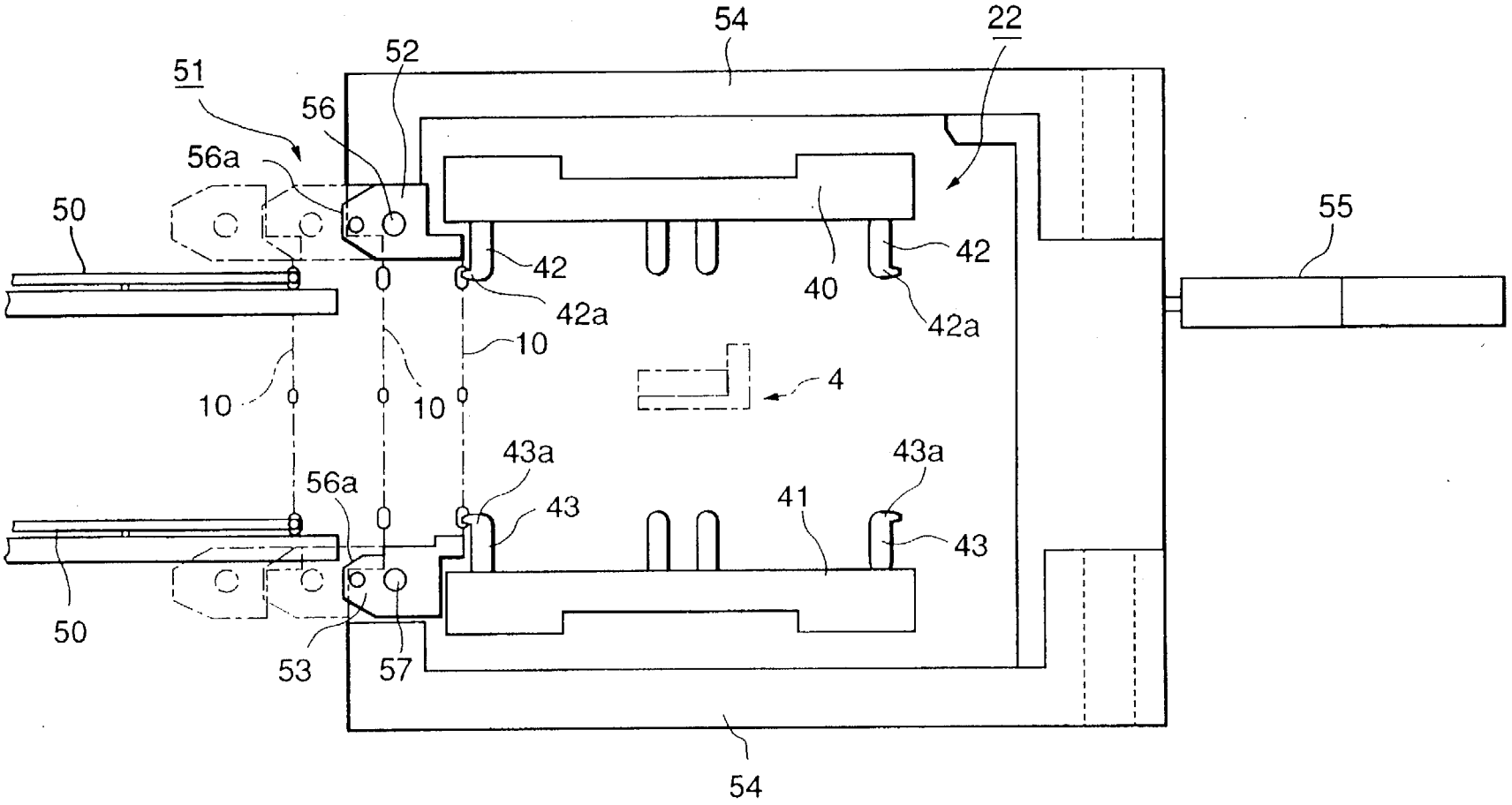
FIG. 20 is a schematic drawing to show the heald sending mechanism.

As shown in FIG. 20, the warp passing apparatus 1 comprises a heald sending mechanism 51 for sending the heald 10 mounted on the heald carrying mechanism 22 to heald holding rods 50. This heald sending mechanism 51 has a pair of upper chuck portion 52 and lower chuck portion 53 for clamping the both ends of the heald 10 kept in the stretched state by the upper hook 42 and lower hook 43 of the index tables 40, 41, and moving arms 54 for fixing the upper chuck portion 52 and lower chuck portion 53 at predetermined heights through spline shafts 56, 57 and slide shafts 56*a*, 57*a* extending in the direction of array of the heald holding rods 50 and for moving each chuck portion 52, 53 toward the heald holding rods 50. The height of the upper heald holding rods 50 is kept nearly in the same level as that of the claw portion 42*a* of the upper hook 42, while the height of the lower heald holding rods 50 is kept nearly in the same level as that of the claw portion 43*a* of the lower hook 43.

The upper and lower chuck portions 52, 53 move in a direction normal to the plane of FIG. 20 along the spline shafts 56, 57 and slide shafts 56*a*, 57*a* by means of a thin wire or timing belt or the like driven by a servo motor not shown, and they stop at a position where the heald can be brought into fit with arbitrary heald holding rods 50. Then the movable arms 54 translationally move the upper and lower chuck portions 52, 53 toward the heald holding rods 50, whereby the guide holes 10*b* of heald 10 can be brought into fit with the heald holding rods 50. Further, the upper chuck portion 52 and lower chuck portion 53 are constructed to open and close through a predetermined mechanism by rotation of the spline shafts 56, 57.

The movable arms 54 are provided with a cylinder device 55 for horizontally moving the upper chuck portion 52 and lower chuck portion 53 toward the heald holding rods 50. This cylinder device 55 uses a two-stage cylinder so as to enable the movable arms 54 to assume three positions. Namely, drive of this cylinder device 55 enables to select three positions: a heald taking position (the position indicated by solid lines) where the upper and lower chuck portions 52, 53 face the upper and lower hooks 42, 43 and where the upper and lower chuck portions 52, 53 are actuated to clamp the both ends of heald 10; a heald holding rod selection position (the position indicated by chain lines) where the upper and lower chuck portions 52, 53 are to be moved in the direction of array of heald holding rods 50; and a heald holding position (the position indicated by chain double dashed lines) where after selecting arbitrary heald holding rods 50 out of the plural heald holding rods 50 juxtaposed in a line, the heald 10 is moved by a certain amount to bring the guide holes 10*b* of heald 10 into fit with the arbitrary heald holding rods 50 and where the upper and lower chuck portions 52, 53 unclamp the both ends of the heald 10.

Then, the index tables 40, 41, after the warp 3 is passed through the heald 10, are further rotated 90°, whereby the upper and lower hooks 42, 43 of the index tables 40, 41 are opposed to the heald holding rods 50 arranged in a line. After that, at the heald taking position (the position indicated by the solid lines), the spline shafts 56, 57 are rotated by a predetermined amount, and then the heald 10 is taken off from the claw portions 42*a*, 43*a* as the upper and lower chuck portions 52, 53 clamp the both ends of the heald 10. At this time the lower hook 43 exerts tension on the heald 10 utilizing a compression spring (not shown), and the lower hook 43 moves slightly up as contracting the compression spring (not shown) when the guide holes 10*b* of heald 10 are off from the claw portions 42*a*, 43*a*. Then the lower hook 43 quickly returns to the original position after completion of removal of heald 10. Then the upper and lower chuck portions 52, 53 move the heald 10 forward up to between the heald holding rods 50 and the index tables 40, 41 and then stop temporarily (the heald support rod selection position indicated by the chain lines).

After that, the upper and lower chuck portions 52, 53 move in the direction of array of heald holding rods 50 along the spline shafts 56, 57 and slide shafts 56*a*, 57*a*, utilizing the thin wire or timing belt or the like driven by the servo motor not shown or the like. Then the upper and lower chuck portions 52, 53 stop after arbitrary heald holding rods 50 have been selected out of the plural heald holding rods 50 arranged in a line. Then the cylinder device 55 is further driven to move the chuck portions 52, 53 forward, thereby bringing the guide holes 10*b* of heald 10 into fit with the predetermined heald holding rods 50 (at the heald holding position indicated by the chain double dashed lines). Then the spline shafts 56, 57 are reversed by a predetermined amount so as to open the upper and lower chuck portions 52, 53 to separate the heald 10 from the upper and lower chuck portions 52, 53, thereby completing the work to stock the arbitrary heald 10 on the predetermined heald holding rods 50.

Next explained is the structure to pass the warp 3 through the warp-passing hole 9*a* of dropper 9 by the warp passing apparatus 1.

Figure 21:
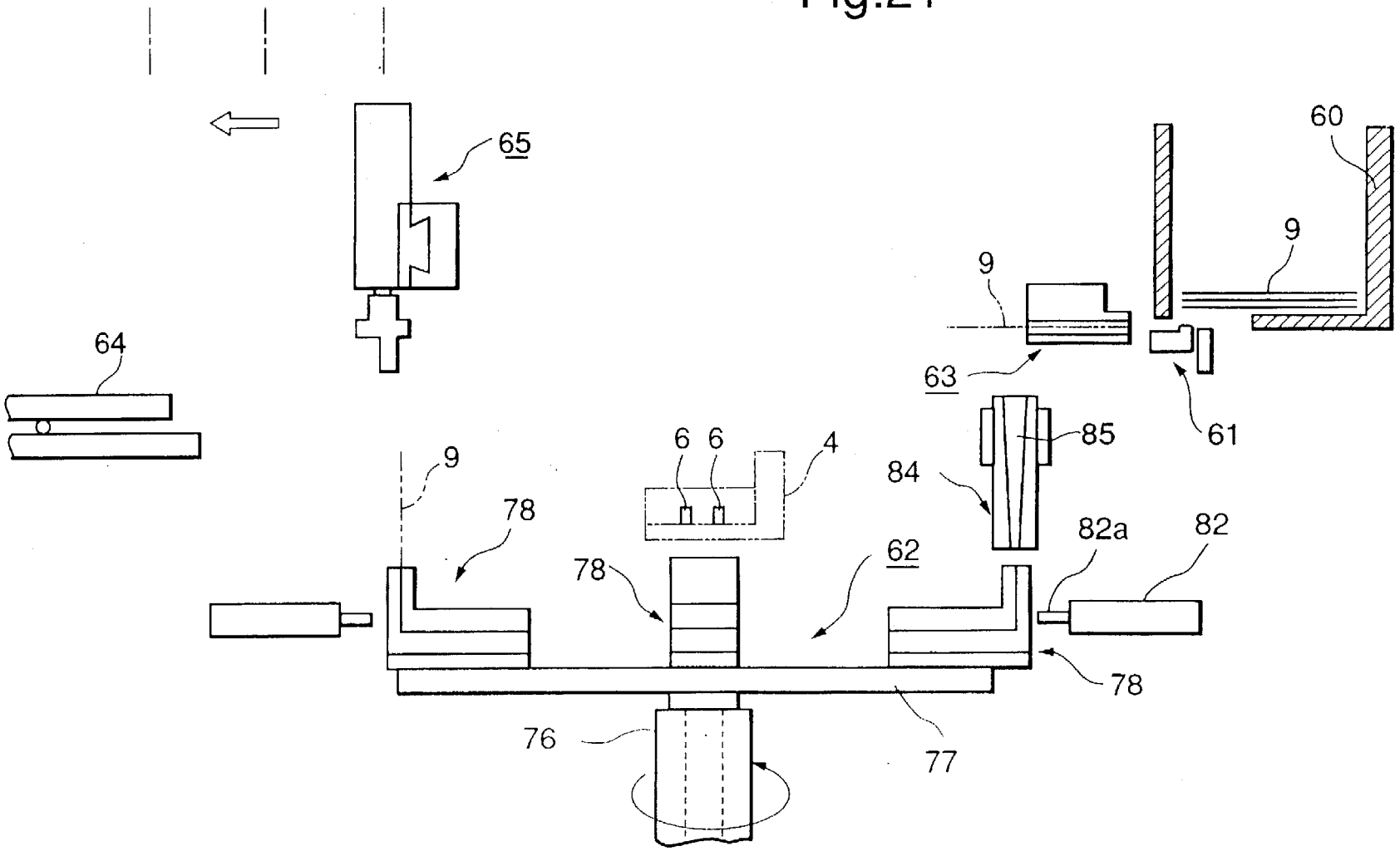
FIG. 21 is a schematic drawing to show the overall structure for passing a warp through a dropper in the warp passing apparatus.
Figure 22:
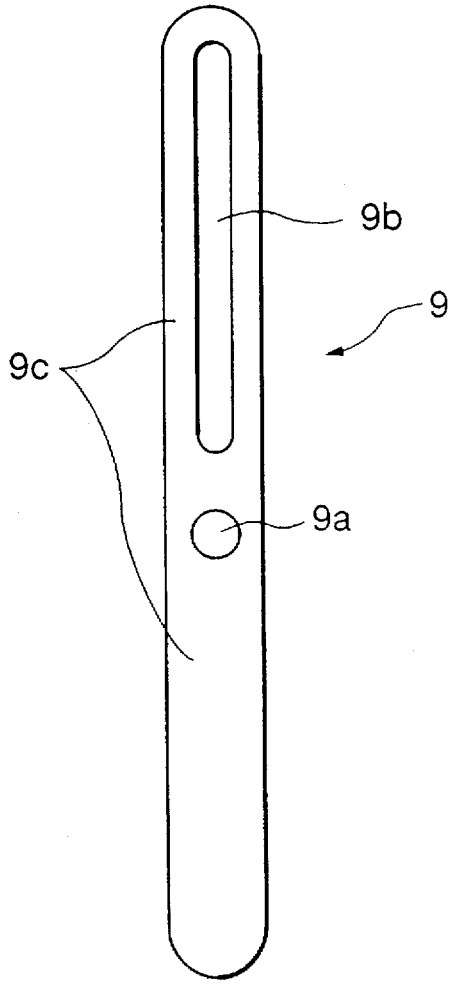
FIG. 22 is a front view to show an ordinary dropper.

As shown in FIG. 21, the warp passing apparatus 1 comprises a stocker 60 for dropper to stock droppers 9 at a predetermined place in a stack and in a lying state (in a horizontal state), a dropper drawing mechanism 61 for completely drawing the lowermost dropper 9 in a horizontal direction out of the plural droppers 9 stacked in the stocker 60, a dropper carrying mechanism 62 for carrying the lowermost dropper 9 drawn out from the stocker 60 to a position where it traverses the warp conveying passage 6 of the warp guide member 4, a dropper transferring mechanism 63 for transferring the dropper 9 drawn out by the dropper drawing mechanism 61 to the dropper carrying mechanism 62, and a dropper sending mechanism 65 for bringing a guide hole **9*b* (see FIG. 22) of dropper 9 after passing of warp, mounted on the dropper carrying mechanism 62, into fit with a dropper holding rod 64**.

Figure 23:
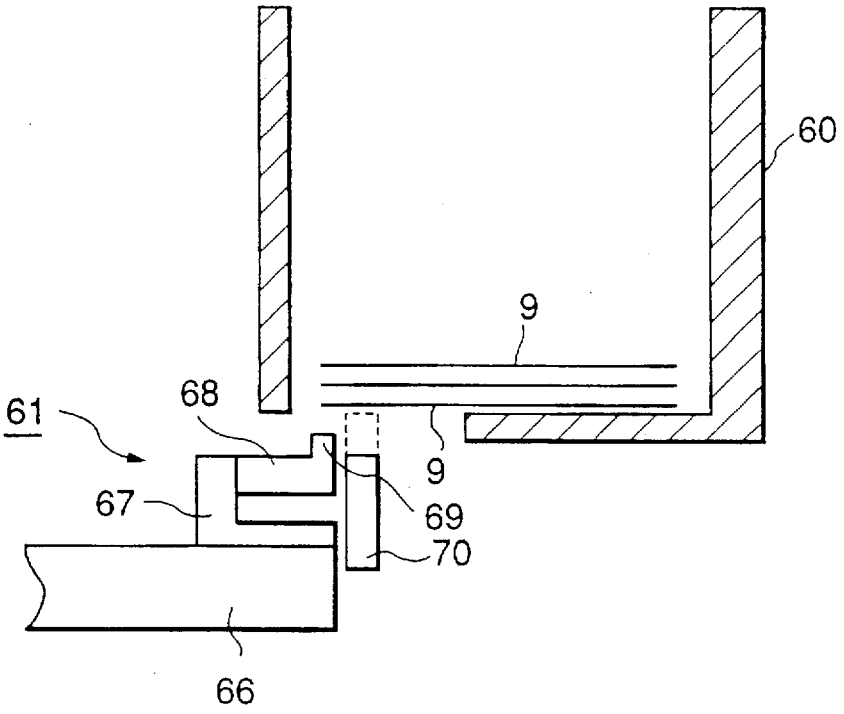
FIG. 23 is a schematic drawing to show the dropper drawing mechanism located below the stoker.

Here, as shown in FIG. 23, the dropper drawing mechanism 61 is located below the stocker 60, and the dropper drawing mechanism 61 is provided with a conveying block 67 arranged to move along a translation stage 66 extending in a horizontal direction. Provided in the upper part of this conveying block 67 is a magnetic head 68 for drawing of dropper arranged to move up and down immediately below the guide hole **9*b* of dropper 9, and this magnetic head 68 is comprised of a magnetic member of soft iron or the like around which an electromagnetic coil is wound, thus composing an electromagnet. Further, a drawing pin 69 made of a non-magnetic material is fixed to the top portion of the magnetic head 68. Therefore, when this drawing pin 69 is located immediately below the guide hole 9*b* of dropper 9 and when the lowermost dropper 9 is sucked down by a vacuum head 70 described hereinafter, the drawing pin 69 can be inserted into the guide hole 9*b*, thus enabling the drawing pin 69 to horizontally draw the dropper 9**.

Figure 24:
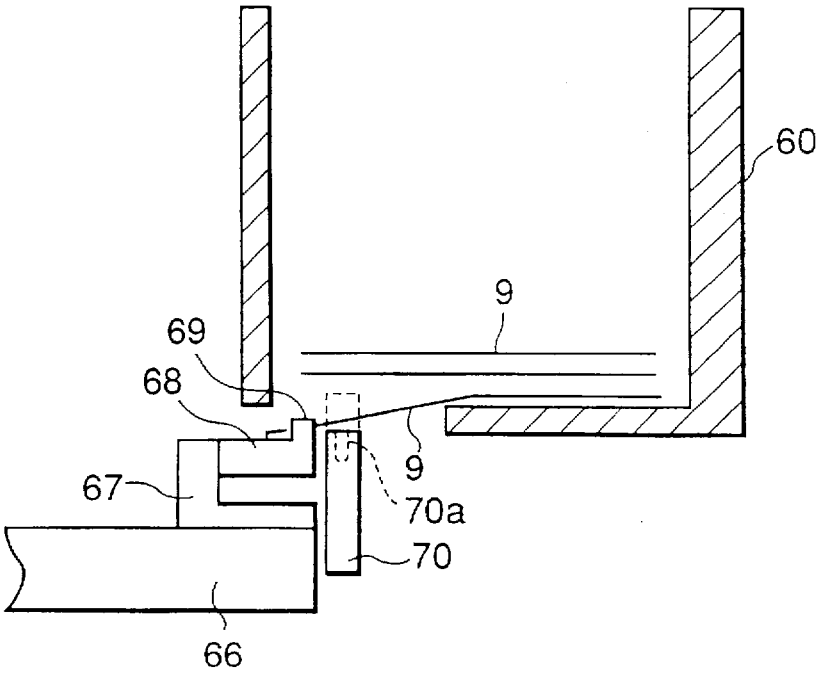
FIG. 24 is a schematic drawing to show a state in which the tip portion of dropper is drawn to the magnetic head utilizing the vacuum head.

In addition, as shown in FIG. 24, the dropper drawing mechanism 61 is provided with the vacuum head 70 located adjacent to the magnetic head 68 and arranged to move up and down. Provided in the upper part of this vacuum head 70 is a suction port **70*a* directed to a flat surface 9*c* (see FIG. 22) of dropper 9. This suction port 70*a* is connected to a vacuum source not shown, whereby the flat surface 9*c* of dropper 9 (especially, the flat surface 9*c* around the guide hole 9*b*) can be vacuum-sucked downward. Thus, the vacuum head 70 is moved up to locate the suction port 70*a* near the flat surface 9*c* of dropper 9, and thereafter the suction port 70*a* is actuated to stick the lowermost dropper 9 to the suction port 70*a*. After that, the vacuum head 70 is moved down to draw only the lowermost dropper 9 downward by the suction port 70*a*. Namely, use of the suction port 70*a* can separate the lowermost dropper 9 from the other droppers 9 and, at the same time, can insert the drawing pin 69 into the guide hole 9*b* of the lowermost dropper 9, whereby the dropper 9 is magnetically stuck to the magnetic head 68**.

Figure 25:
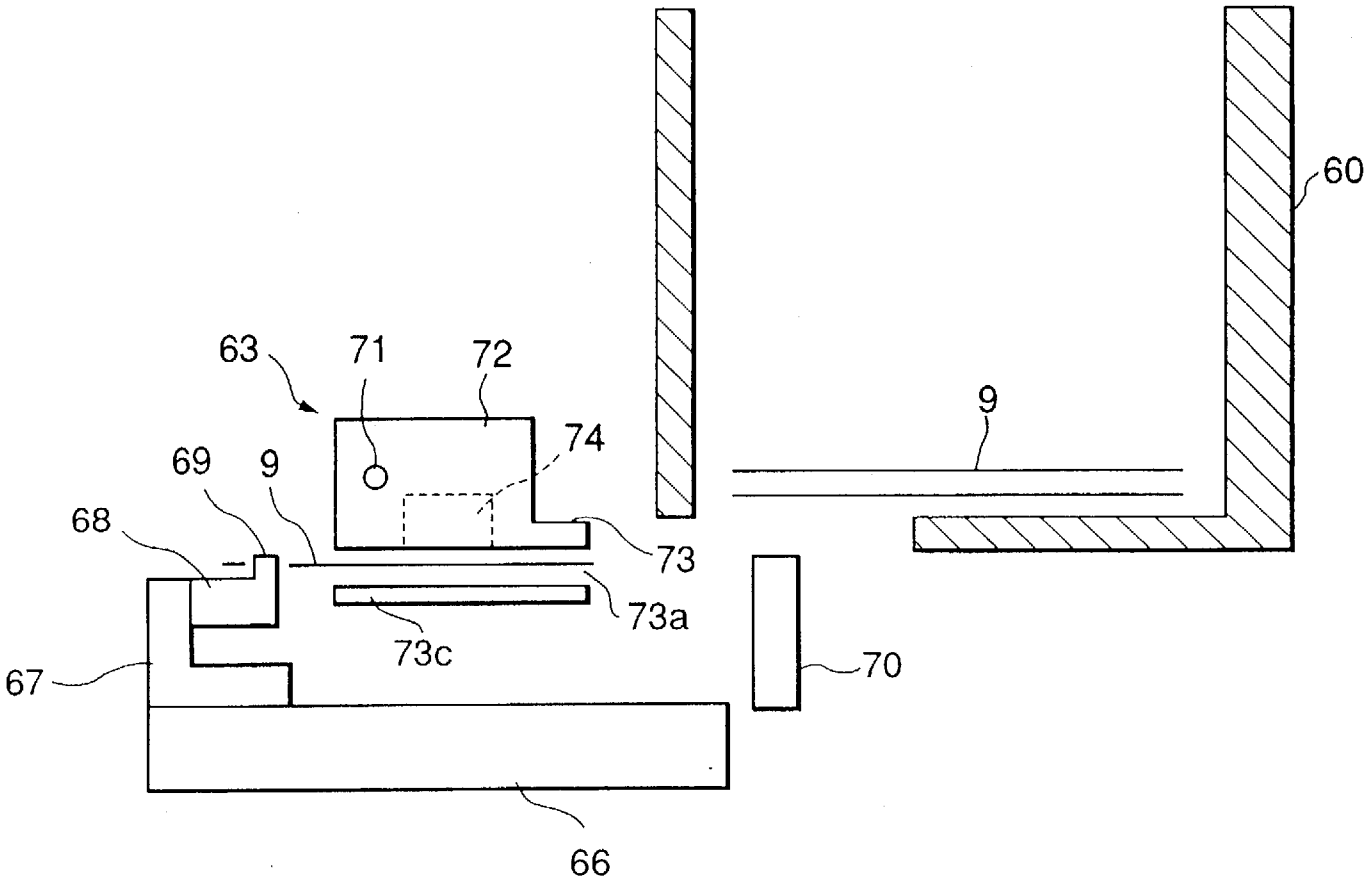
FIG. 25 is a schematic drawing to show a state in which the dropper is completely drawn out of the stocker by the magnetic head.
Figure 26:
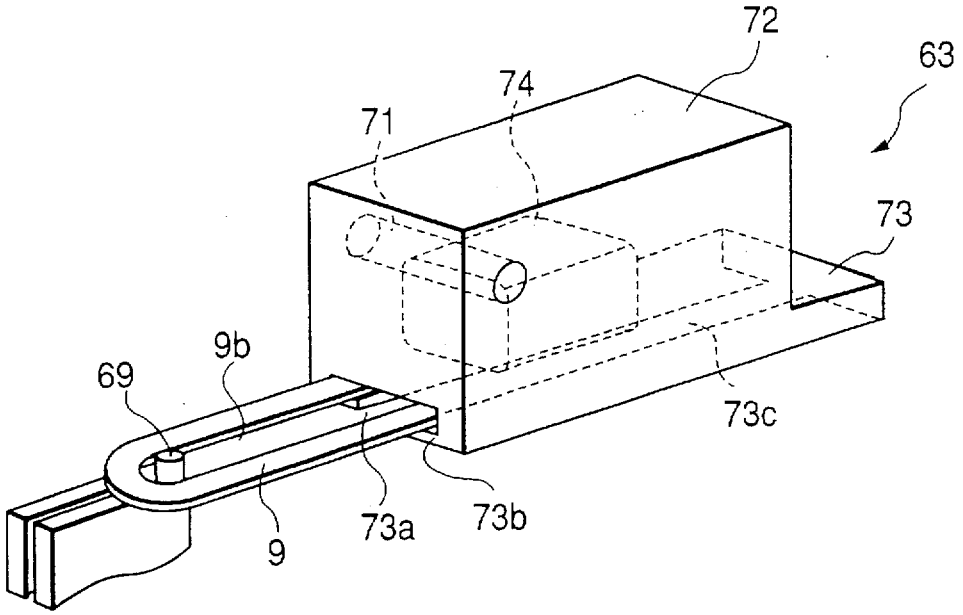
FIG. 26 is a schematic drawing to show the dropper transferring mechanism.

As shown in FIG. 25, the dropper transferring mechanism 63 is disposed in front of the stocker 60, and this dropper transferring mechanism 63 has a work rotating member 72 arranged to rotate 90° about a support shaft 71. This work rotating member 72 is provided with a dropper accommodating portion 73 having a dropper insertion hole **73*a* into which the dropper 9 drawn out in the horizontal direction by the drawing pin 69 is to be inserted in a lying state. As shown in FIG. 26, a slit 73*c* for guide of magnetic head through which the magnetic head 68 can pass is formed throughout the entire length in a bottom wall 73*b* of the dropper accommodating portion 73. Further, a magnetic head 74 is provided in the work rotating member 72, and this magnetic head 74 is positioned so as to meet the dropper insertion hole 73*a*. The present embodiment employs two dropper transferring mechanisms 63** arranged in parallel.

Thus, as shown in FIG. 25, the dropper 9 is drawn out horizontally along the translation stage 66 by the drawing pin 69 as being magnetically stuck to the magnetic head 68. At this time, the magnetic head 68 passes through the magnetic head guiding slit **73*c*, and thus, the dropper 9 horizontally moves as passing in the dropper insertion hole 73*a* of the work rotating member 72. Then movement of conveying block 67 is stopped when a predetermined portion of dropper 9 is conveyed up to the magnetic head 74. After that, the electric current to the coil wound around the magnetic head 68 on the conveying block 67 side is switched from that for magnetization to the damping alternating current for degaussing, whereby the electric current for degaussing is made to flow through the coil wound around the magnetic head 74 on the work rotating member 72 side. As a result, the front end of dropper 9 is freed as being degaussed by the magnetic head 68 and at the same time, the center of dropper 9 is magnetically stuck to the magnetic head 74, whereby the dropper 9 is held by magnetic force in the work rotating member 72. Then the work rotating member 72 is rotated 90° about the support shaft 71, whereby the dropper 9 stands up as held by the work rotating member 72**.

Since the dropper 9 is moved slightly up when the dropper 9 is magnetically stuck in a horizontal state to to the magnetic head 74, the guide hole **9*b* of dropper 9 becomes off from the drawing pin 69. Then the magnetic head 68 and drawing pin 69 run backward (are reversed) through the magnetic head guiding slit 73*c* of work rotating member 72 along the translation stage 66 and then stop at the original position of FIG. 23**.

Figure 27:
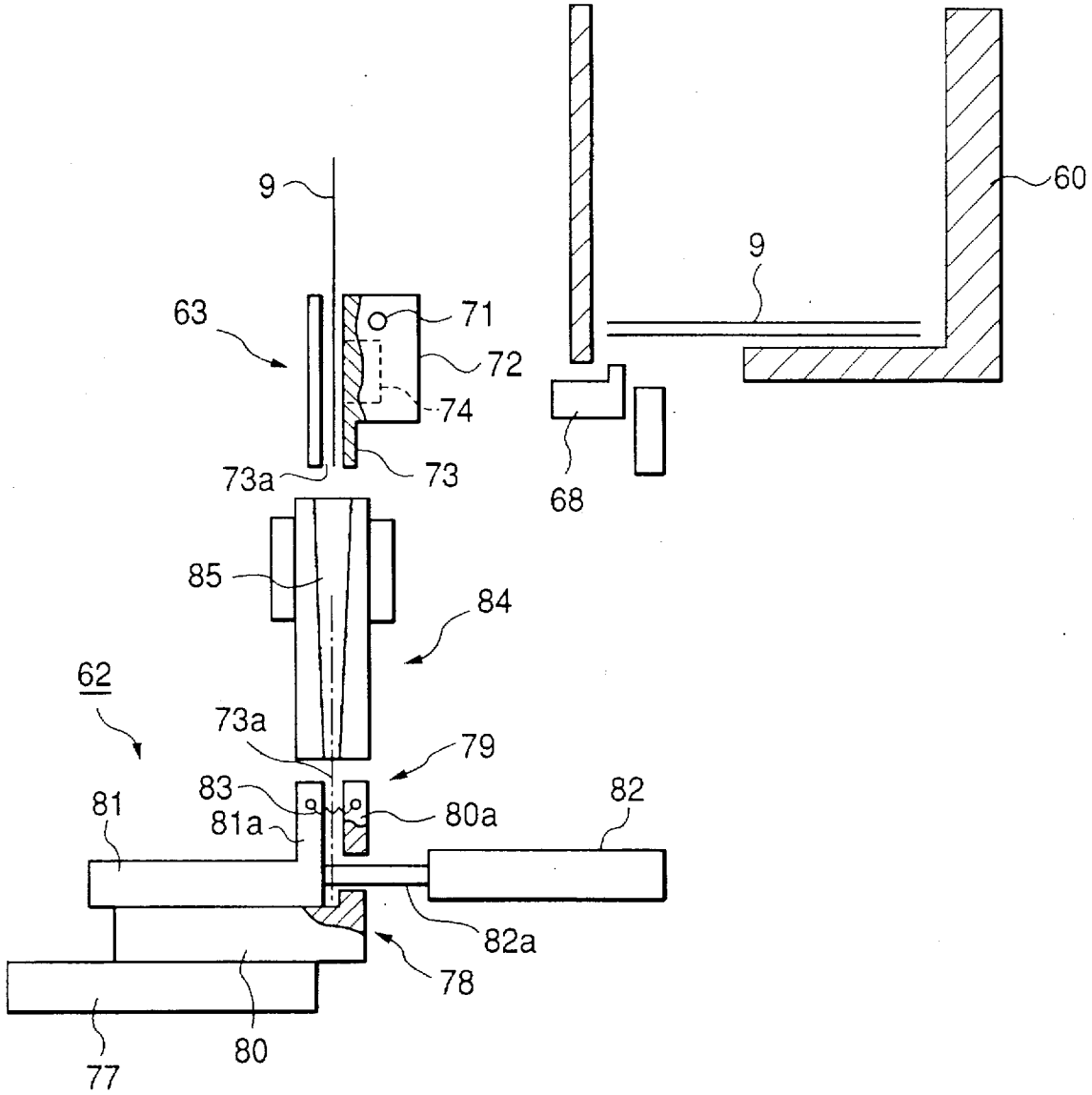
FIG. 27 is a schematic drawing to show the dropper carrying mechanism located below the dropper transferring mechanism.

As shown in FIG. 27 and FIG. 21, the dropper carrying mechanism 62 for carrying the dropper 9 into the warp guide member 4 is provided below the dropper transferring mechanism 63, and the dropper carrying mechanism 62 has an index table 77 arranged to rotate every 90° about a rotation shaft 76 located below the warp guide member 4. Four dropper holders 78 are fixed to peripheral portions of this index table 77, and the four dropper holders 78 each are arranged at equal intervals of index angles of 90°. Further, the dropper holders 78 are positioned on the index table 77 so that either one of dropper holders 78 can be located immediately below the dropper transferring mechanism 63 upon rotation of the index table 77.

Each dropper holder 78 has a chuck portion 79 for accepting and chucking the dropper 9 having been dropped from the dropper transferring mechanism 63. This chuck portion 79 is constructed of cooperation of a dropper receiver 80 fixed on the index table 77 with a sliding portion 81 arranged to slide relative to this dropper receiver 80, and specifically, it is composed of a first chuck piece **80*a* standing on the dropper receiver 80, a second chuck piece 81*a* standing on the sliding portion 81, and a tension spring 83 stretched between the first chuck piece 80*a* and the second chuck piece 81*a*. Further, the second chuck piece 81*a* of the chuck portion 79 is pushed to open by forward motion of a piston 82*a* of air cylinder 82 and is narrowed by backward motion of the piston 82*a*. Then the spring force of the tension spring 83 forces to close the chuck portion 79 and at the same time, the chuck portion 79** comes to have desired dropper holding force.

Here, a work guide portion 84 in vertically bisected structure is provided between the dropper transferring mechanism 63 and the dropper carrying mechanism 62, and this work guide portion 84 is for surely guiding the dropper 9 dropping in an upright state from the work rotating member 72 into the dropper carrying mechanism 62. A funnel-shaped dropper passage 85 extending in the vertical direction is provided in this work guide portion 84, and this dropper passage 85 is aligned on a line connecting the dropper insertion hole 73*a* of the upright work rotating member 72 with a chuck mouth 79*a* of the chuck portion 79. Then the magnetizing current to the coil wound around the magnetic head 74 in the work rotating member 72 is switched to the degaussing damping alternating current, whereby the dropper 9 is dropped in a state of zero remanence and this dropper 9, passing in the dropper passage 85 of the work guide portion 84, comes to be loaded in the chuck portion 79. At this time the chuck mouth 79*a* is expanded by the forward motion of the piston 82*a* of air cylinder 82.

Figure 28:
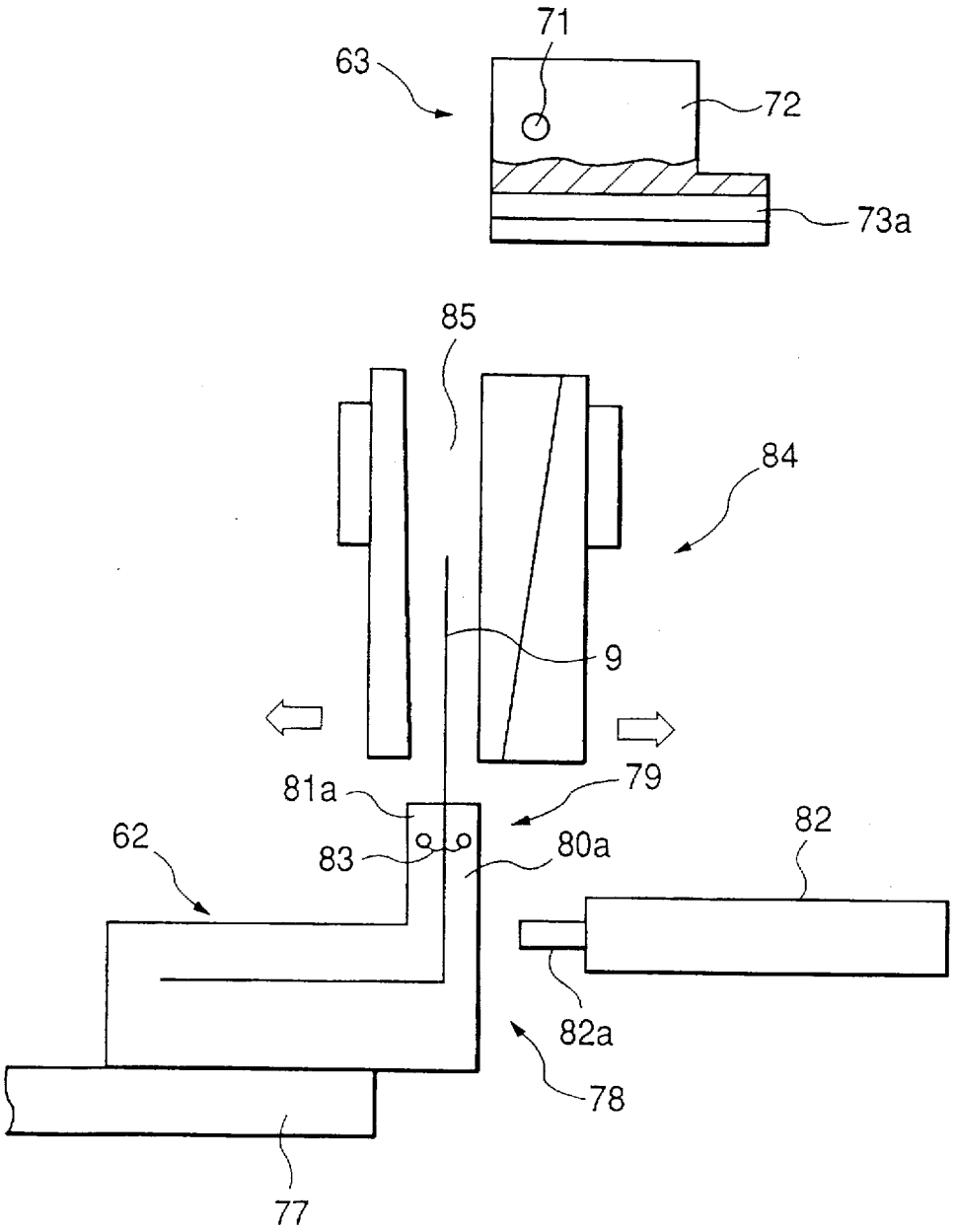
FIG. 28 is a schematic drawing to show a state in which the dropper is mounted in an upright state in the dropper holder.

As shown in FIG. 28, the piston 82*a* is moved back and the spring force of the tension spring 83 forces to close the chuck portion 79, whereby the dropper 9 can be held in an upright state in the dropper holder 78. Further, the top end of the dropper 9 held by the chuck portion 79 is kept as inserted in the dropper passage 85 of the work guide portion 84. Since the dropper passage 85 is formed relatively narrow to properly guide drop of the dropper 9, the dropper 9 cannot slip off from the side of the passage 85 upon rotation of the index table 77. Then the dropper passage 85 of the work guide portion 84 is widened to the both sides (see arrows) by a predetermined mechanism, whereby the dropper 9, moving to follow the index table 77, can be permitted to pass easily from the dropper passage 85. The work rotating member 72 is reversed 90° to keep the dropper insertion hole 73*a* horizontal in order to accept a next dropper 9.

Figure 29:
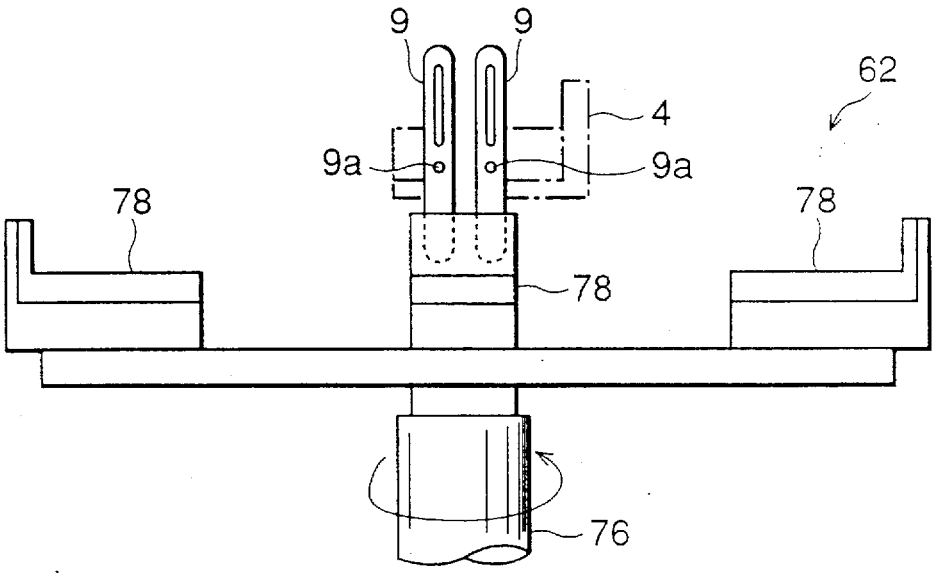
FIG. 29 is a schematic drawing to show a state in which the dropper is mounted in the warp guide member using the dropper carrying mechanism.

As shown in FIG. 29, the index table 77, after the dropper holder 78 has held the dropper 9 in the upright state, is rotated 90°, so as to move the dropper holder 78 to just below the warp guide member 4, and the dropper 9 is carried into the warp guide member 4. At this time, the warp-passing hole 9*a* of dropper 9 is positioned to match with the warp conveying passage 6, thus completing preparation for passing of warp into the dropper 9. Then the warp 3 is subjected to vacuum suction in the warp conveying passage 6, whereby the warp 3 is passed through the warp-passing hole 9*a* of dropper 9, and the warp 3 is driven out to the outside from the warp guide member 4, thus completing the warp-passing work into the dropper 9.

Figure 30:
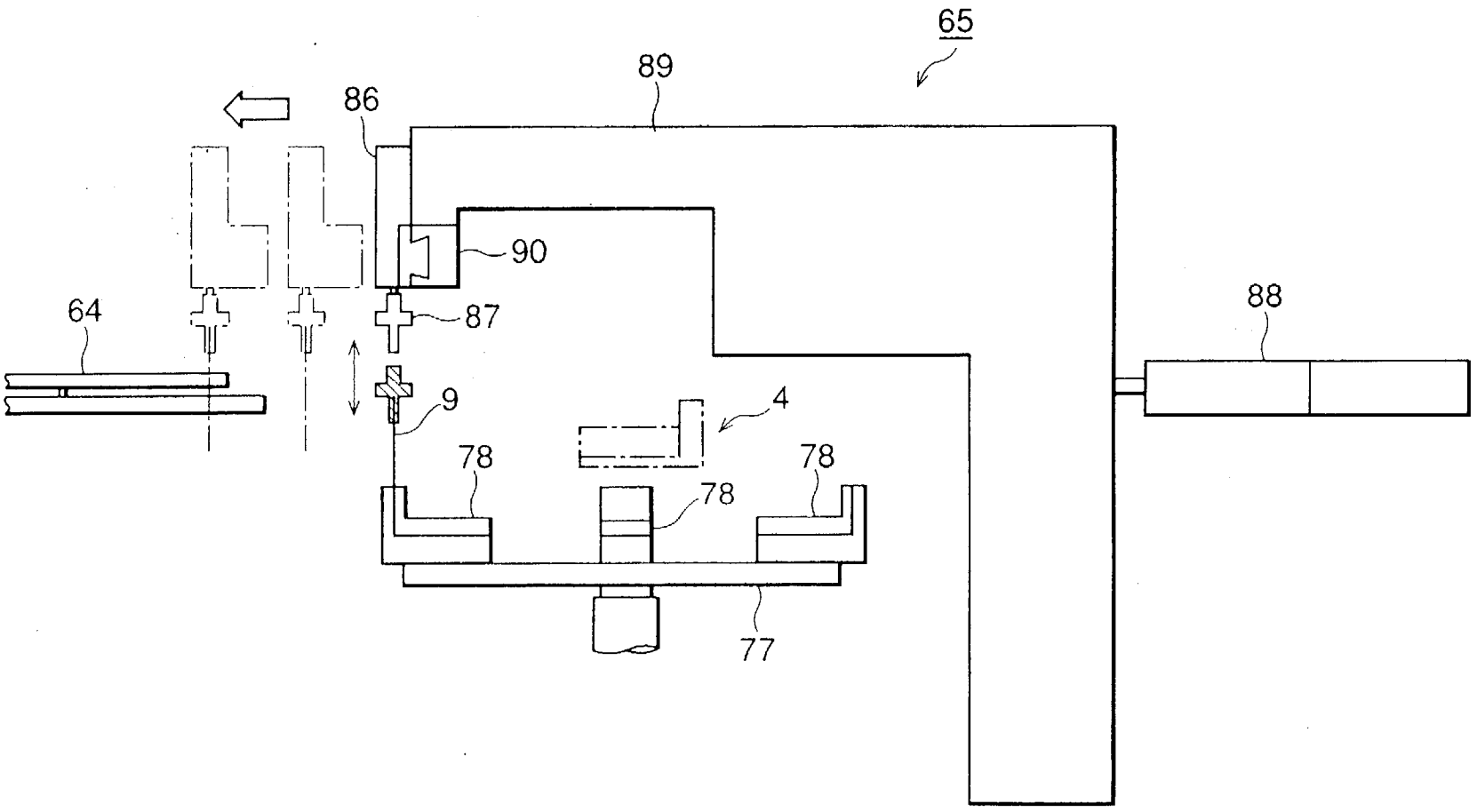
FIG. 30 is a schematic drawing to show the dropper sending mechanism.

As shown in FIG. 30, the warp passing apparatus 1 has a dropper sending mechanism 65 for transferring the dropper 9 after passing of warp, held by the dropper holder 78, to a dropper holding rod 64. This dropper sending mechanism 65 comprises a clamp portion 87 located above the index table 77 and provided for capturing the top end of dropper 9 with the warp passed therethrough, a cylinder portion 86 for opening and closing and vertically moving the clamp portion 87, a movable arm 89 arranged to be moved forward by a two-stage cylinder device 88 through a cylinder portion 86 so as to move the clamp head 87 toward the dropper holding rod 64, and a linear guide 90 for connecting the front end of this movable arm 89 with the cylinder portion 86 and for moving the clamp head 87 in the direction of array of dropper holding rods 64 juxtaposed in a line. A driving mechanism for moving the movable arm 89 and cylinder portion 86 in the direction of array of dropper holding rods 64 with intervention of this linear guide 90 utilizes a thin wire or timing belt or the like driven by a servo motor not shown or the like, similarly as the aforementioned driving mechanism of the upper and lower chuck portions 52, 53 applied to the heald 10.

Thus, the index table 77, after the warp 3 has been passed through the dropper 9 by the warp guide member 4, is rotated 90°, the clamp head 87 is moved down to the position indicated by hatching, whereby the top end of dropper 9 is captured by the clamp head 87, and after completion of capturing, the clamp head 87 is moved up to the position indicated by the solid line. After that, the cylinder device 88 is first moved forward by a step, whereby the dropper 9 is moved forward to between the dropper holding rod 64 and the index table 77 and then is stopped once (at the position indicated by the chain line).

After that, utilizing the thin wire or timing belt or the like driven by the servo motor not shown or the like, the clamp head 87 and cylinder portion 86 are moved in the direction of array of dropper holding rods 64 along the linear guide 90, an arbitrary dropper holding rod 64 is selected out of the plural dropper holding rods 64 juxtaposed in a line, and movement of the clamp head 87 and cylinder portion 86 is stopped. After that, the cylinder device 88 is further moved forward by another step, so that the guide hole 9*b* of dropper 9 captured by the clamp head 87 is brought into fit with the predetermined dropper holding rod 64 (at the position indicated by the chain double dashed line). Then the dropper 9 is freed from the clamp head 87, thereby completing the work to stock an arbitrary dropper 9 on a predetermined dropper holding rod 64.

Figure 31:
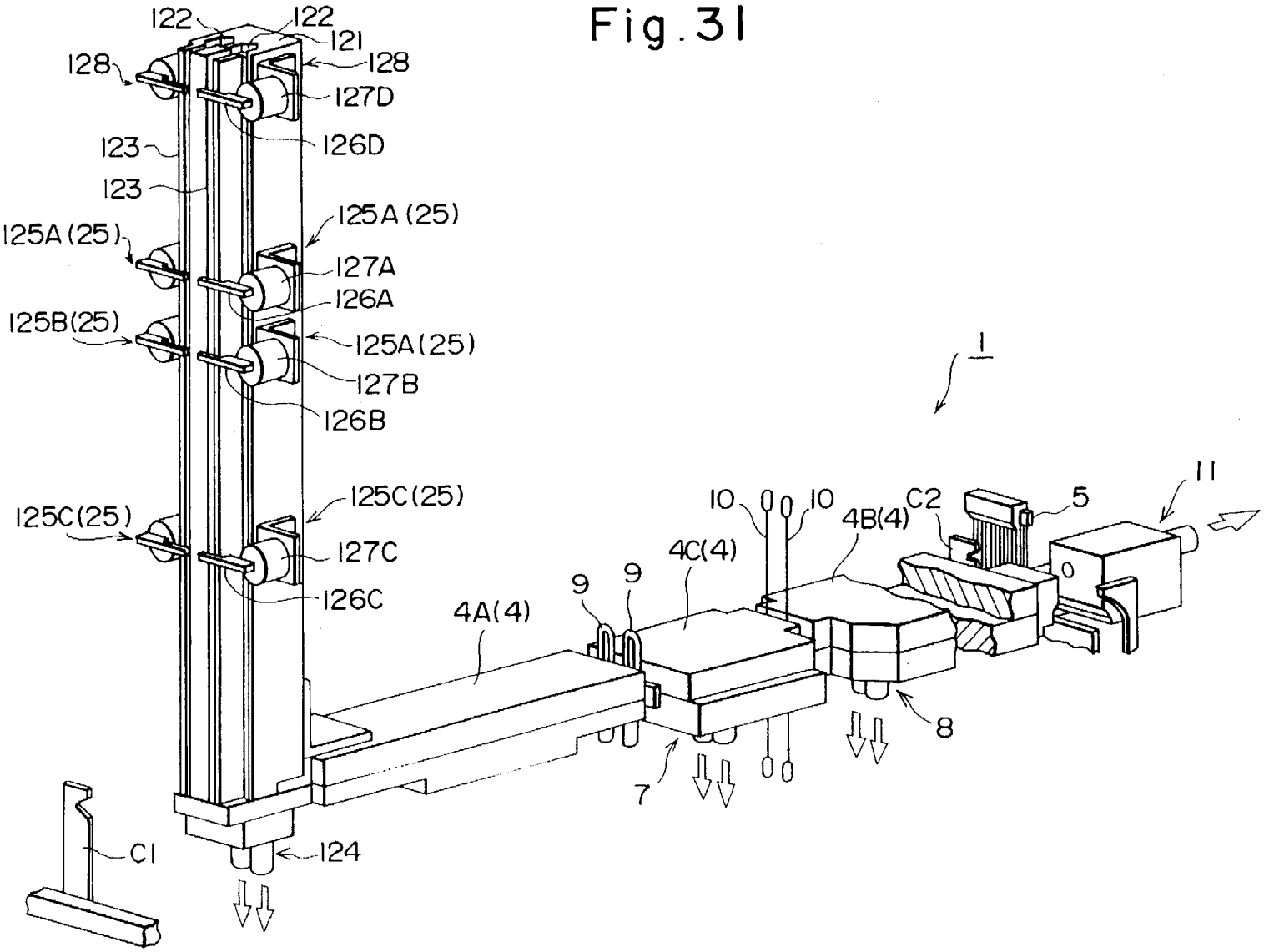
FIG. 31 is a perspective view to show the second embodiment of the warp passing apparatus according to the present invention.
Figure 32:
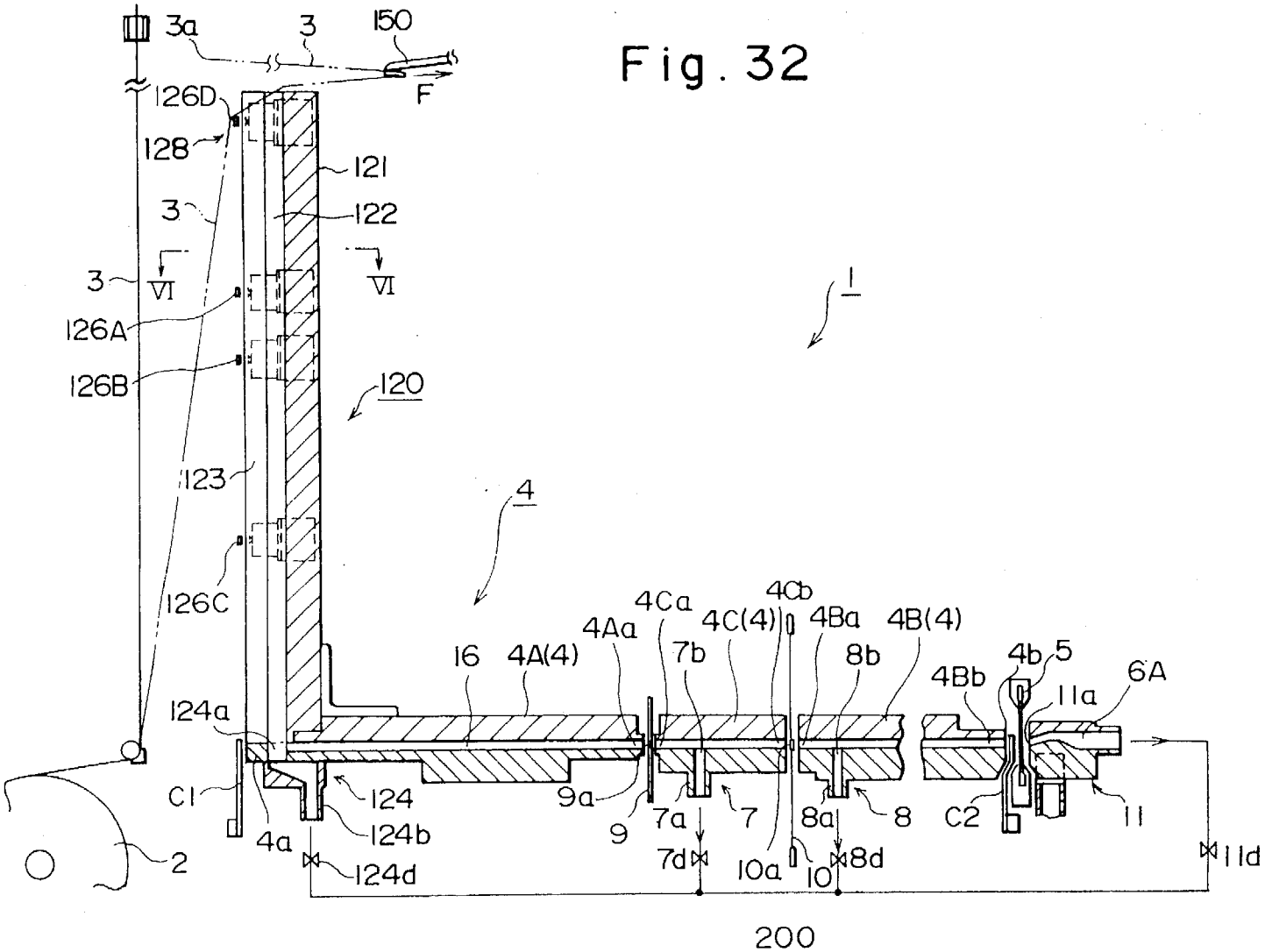
FIG. 32 is a sectional view to show the second embodiment of the warp guide member forming a major part of the present invention.

FIGS. 31 and 32 show the second embodiment according to the present invention.

In FIGS. 31 and 32, any elements having the same reference numerals and characters as those of the elements shown in FIGS. 1, 2, has the same structure and fuction and because such structure and fuctions has been explained above, the detailed explanations may be omitted.

As shown in FIGS. 31 and 32, a feed regulator 120 for regulating the feed lengths of the warp 3 drawn out from the warp beam 2 is fixed to the front end (upstream end) 4*a* of the warp guide member 4. This feed regulator 120 has a pillar-shaped feed regulating body 121 fixed in a standing state to the upstream end 4*a* of the warp guide member 4, and this feed regulating body 121 is made by extrusion of aluminum. Formed in this feed regulating body 121 are warp feed passages 122 extending perpendicular to the warp conveying passages 6 and along the longitudinal direction of the feed regulating body 121, and the lower end of this warp feed passage 122 communicates with the front end of a warp conveying passage 6 while the upper end of the warp feed passage 122 is open.

Figure 33:
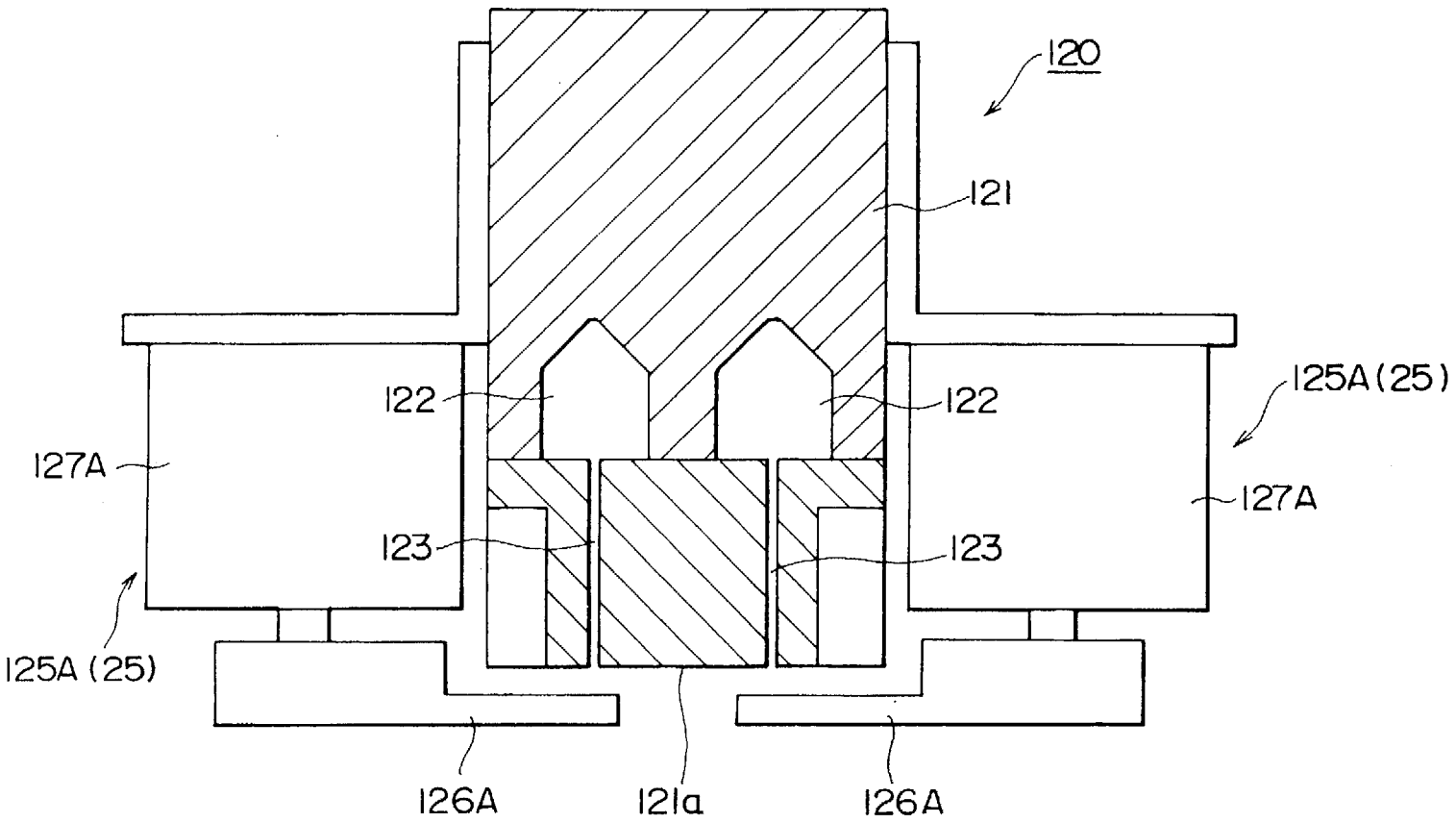
FIG. 33 is a cross sectional view along line VI—VI of FIG. 32 to show the cross section of the second embodiment apparatus.

FIG. 33 shows the cross-sectional structure of the feed regulator 120.

As shown in FIGS. 31 and 33, slits 123 are formed along the warp feed passages 122 in the feed regulating body 121, wherein this slit 123 is formed on the warp beam 2 side of the feed regulating body 121, makes the front face of the feed regulating body 121 communicate with the warp feed passage 122, and is provided over the entire length of the warp feed passage 122. Further, since the slit 123 has the width necessary and minimum to allow the warp 3 to pass and move easily, a midway part of warp 3 extending from the warp beam 2 can be moved along the slit 123.

Further, frontmost suction portions 124 are provided at the front end portion (the upstream end) 4*a* of the warp guide member 4, i.e., at the lower end of the feed regulating body 121, wherein this frontmost suction portion 124 has a suction port 124*a* communicating with the lower end of a warp feed passage 122 and the front end of a warp conveying passage 6 and this suction port 124*a* is connected to a vacuum source 200 through a suction pipe 124*b* with a valve 124*d*. Also, the aforementioned intermediate suction portion 7 is provided in the third warp guide member 4C and is located immediately after the dropper 9, while the intermediate suction portion 8 is provided in the second warp guide member 4B and is located immediately after the wire heald 10. Thus, by actuating the vacuum source 200 and opening the valves 124*d*, 7*d*, 8*d*, and 11*d*, the air can be sucked by the frontmost suction portion 124, intermediate suction portions 7, 8, and final suction portion 11 described above. Since an inflow rate of the air from the upper open portion of the warp feed passage 122 is extremely larger than that of the air through the slit 123, an appropriate descending airflow appears in the warp feed passage 122, which facilitates insertion of the warp 3 into the warp feed passage 122 from the top.

As shown in FIG. 31 and FIG. 32, the feed regulating body 121 is provided with three warp feed/engagement elements 125 for regulating the feed lengths of each warp 3 by catching the midway part of the warp 3 drawn out of the warp beam 2 and inserted into the warp feed passage 122 of the feed regulating body 121. Each warp feed/engagement element 125 is either one of a warp feed/engagement device 125A for dropper, which is for stopping the tip portion 3*a* of the warp 3 moving in the warp conveying passage 6 once immediately before passing of warp through the dropper 9, a warp feed/engagement device 125B for wire heald, which is for stopping the tip portion 3*a* of the warp 3 once immediately before passing of warp through the wire heald 10, and a warp feed/engagement device 125C for reed, which is for stopping the tip portion 3*a* of the warp 3 once immediately before passing of warp through the reed 5. Since the warp 3 is passed through the dropper 9, wire heald 10, and reed 5 in this order, the warp feed/engagement device for dropper 125A is provided in the upper stage of the feed regulating body 121, the warp feed/engagement device for wire heald 125B in the middle stage thereof, and the warp feed/engagement device for reed 125C in the lower stage thereof.

The warp feed/engagement device 125A is comprised of a rotating lever 126A as a warp hook element opposed to the front face 121*a* of the feed regulating body 121 and disposed in close proximity of the slit 123, and a rotary actuator 127A as a drive unit fixed to a side face 121*b* of the feed regulating body 121 and arranged to rotate the rotating lever 126A by a predetermined angle. This rotating lever 126A is rotated back and forth by the rotary actuator 127A between a horizontal warp engagement position where it catches the warp 3 moving down along the slit 123 and a vertical warp feed position where it frees the warp 3 hooked on the rotating lever 126A. The rotating lever 126A is disposed at an upper-stage position where a midway portion of the warp 3 moving down along the slit 123 is hooked on the lever so that the tip portion 3*a* of the warp in the warp conveying passage 6 stops immediately before passing of warp through the dropper 9.

The warp feed/engagement device 125B also has the same structure as that for dropper 9 described above, and thus is comprised of a rotating lever 126B and a rotary actuator 127B. Also, the rotating lever 126B is disposed at a middle-stage position where the warp 3 moving down along the slit 123 after released from the rotating lever 126A, is hooked on the lever so that the tip portion 3*a* of the warp 3 in the warp conveying passage 6 stops immediately before passing of warp through the wire heald 10.

The warp feed/engagement device 125C also has the same structure as those for dropper 9 and wire heald 10 described above, and thus is comprised of a rotating lever 126C and a rotary actuator 127C. Also, the rotating lever 126C is disposed at a lower-stage position where the warp 3 moving down along the slit 123 after released from the rotating lever 126B, is hooked on the lever so that the tip portion 3*a* of the warp 3 in the warp conveying passage 6 stops immediately before passing of warp through the reed 5.

Further, the feed regulating body 121 is provided with warp feed standby devices 128 each for catching the midway portion of the warp 3 drawn out of the warp beam 2 and inserted into the warp feed passage 122 of the feed regulating body 121, thereby making the warp 3 stand by for feed. This warp feed standby device 128 is disposed in an upper stage (a front stage) higher than the warp feed/engagement device for dropper 125A in the feed regulating body 121, has the same structure as the aforementioned warp feed/engagement devices 125A to 125C, and thus is comprised of a rotating lever 126D and a rotary actuator 127D. Also, the rotating lever 126D is disposed at a position where, by suction force of the frontmost suction portion 124, it catches the warp 3 moving down along the slit 123 so that the tip portion 3*a* of warp 3 moving down along the warp feed passage 122 goes slightly into the suction port 124*a* of the frontmost suction portion 124.

The operation of the above-stated warp passing apparatus is next explained based on the structure thereof.

First, the vacuum source 200 is actuated and the valves 124*d*, 7*d*, 8*d*, and 11*d* are opened, whereby the frontmost suck portion 124, intermediate suck portions 7, 8, and final suck portion 11 start evacuating the air in the warp conveying passage 6 and warp feed passage 122 to a vacuum. At this time the vacuum suction force of the intermediate suction portions 7, 8 and final suction portion 11 is adjusted by the valves 7*d*, 8*d*, and 11*d* so as to create an appropriate stream of air directed to the reed 5 in the warp conveying passage 6. Also, the vacuum suction force of the frontmost suction portion 124 is adjusted by a valve 124*d* or the like so as to create an appropriate stream of air directed downward in the warp feed passage 122.

Figure 34:
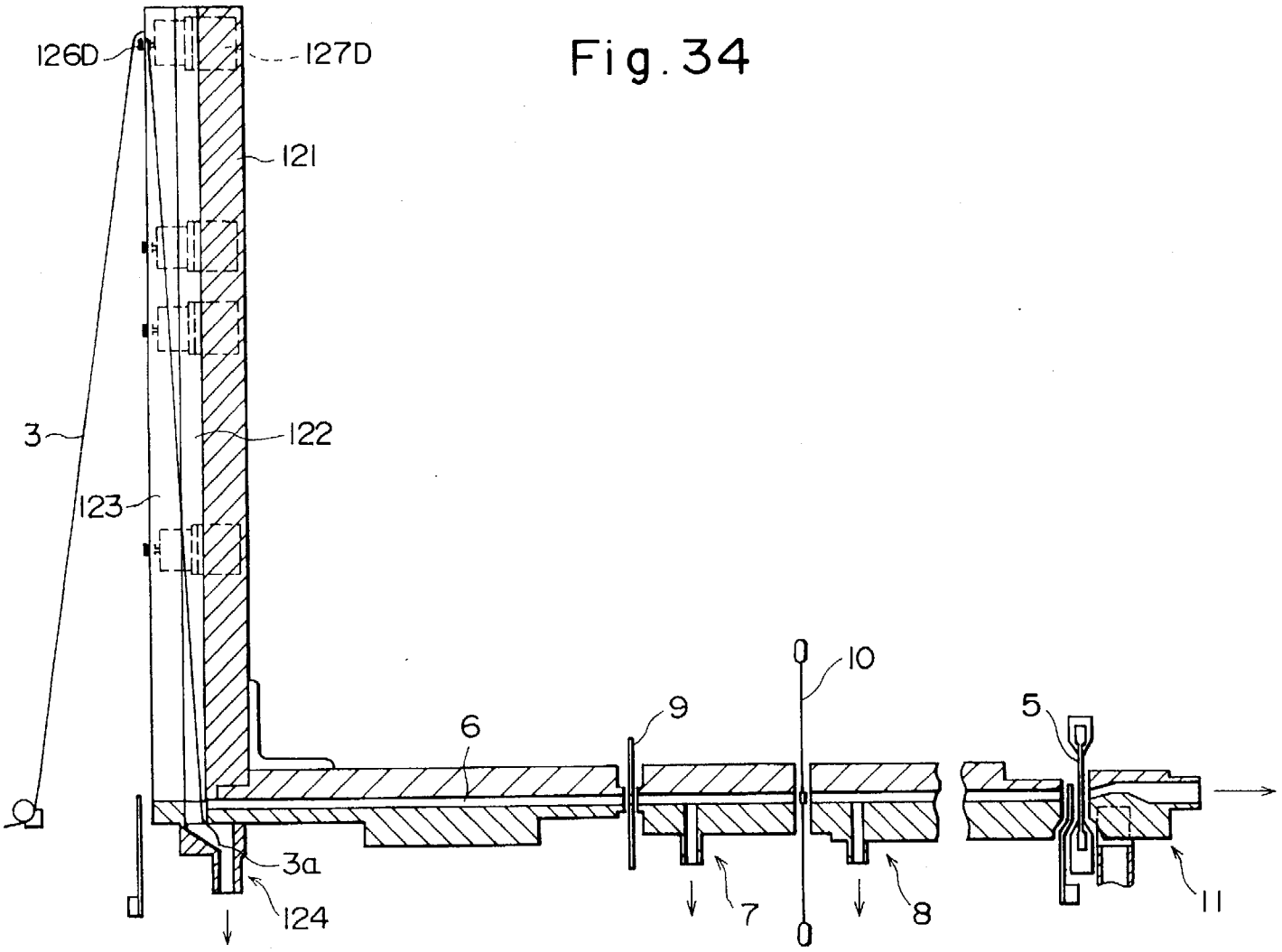
FIG. 34 is a cross-sectional view to show a state in which the warp is hooked on the warp feed stanby means of the apparatus.
Figure 35:
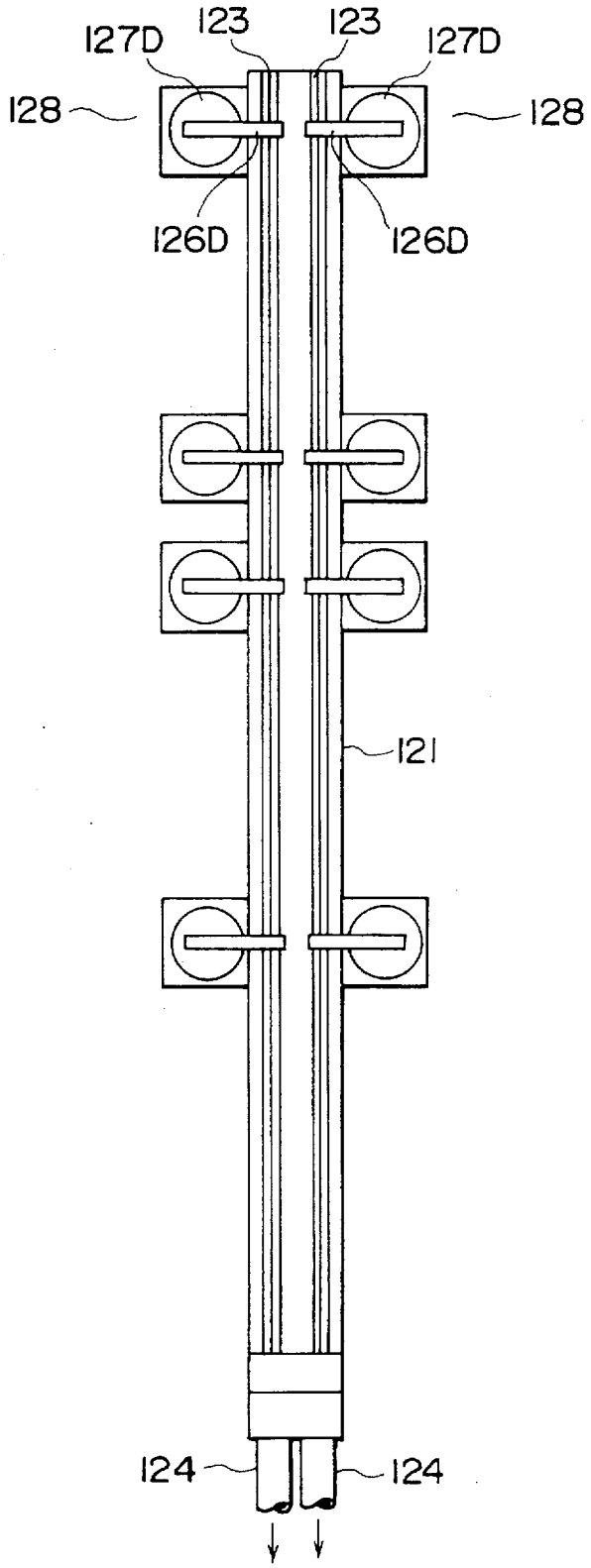
FIG. 35 is a front view of the apparatus shown in FIG. 34.

Thus, as shown in FIG. 31, after freeing the tip portion 3*a* of the warp 3 extending from the warp beam 2, a warp pulling element 150 pulls the warp 3 in the direction of arrow F as catching it, whereby a part of the warp 3 is put into the slit 123 as being located at the upper-end open portion of the warp feed passage 122. As a result, the downward airflow occurring in the warp feed passage 122 causes the warp 3 drawn out from the warp beam 2 to be pulled into the warp feed passage 122. At this time, as shown in FIG. 34 and FIG. 35, after a midway portion of the warp 3 is hooked on the rotating lever 126D kept horizontal with the warp 3 being stretched in a V-shape, the tip portion 3*a* of the warp 3 goes slightly into the frontmost suction portion 124 under vacuum suction (see FIG. 34). This state is a preparation stage for staged feed of the tip portion 3*a* of the warp 3.

Figure 36:
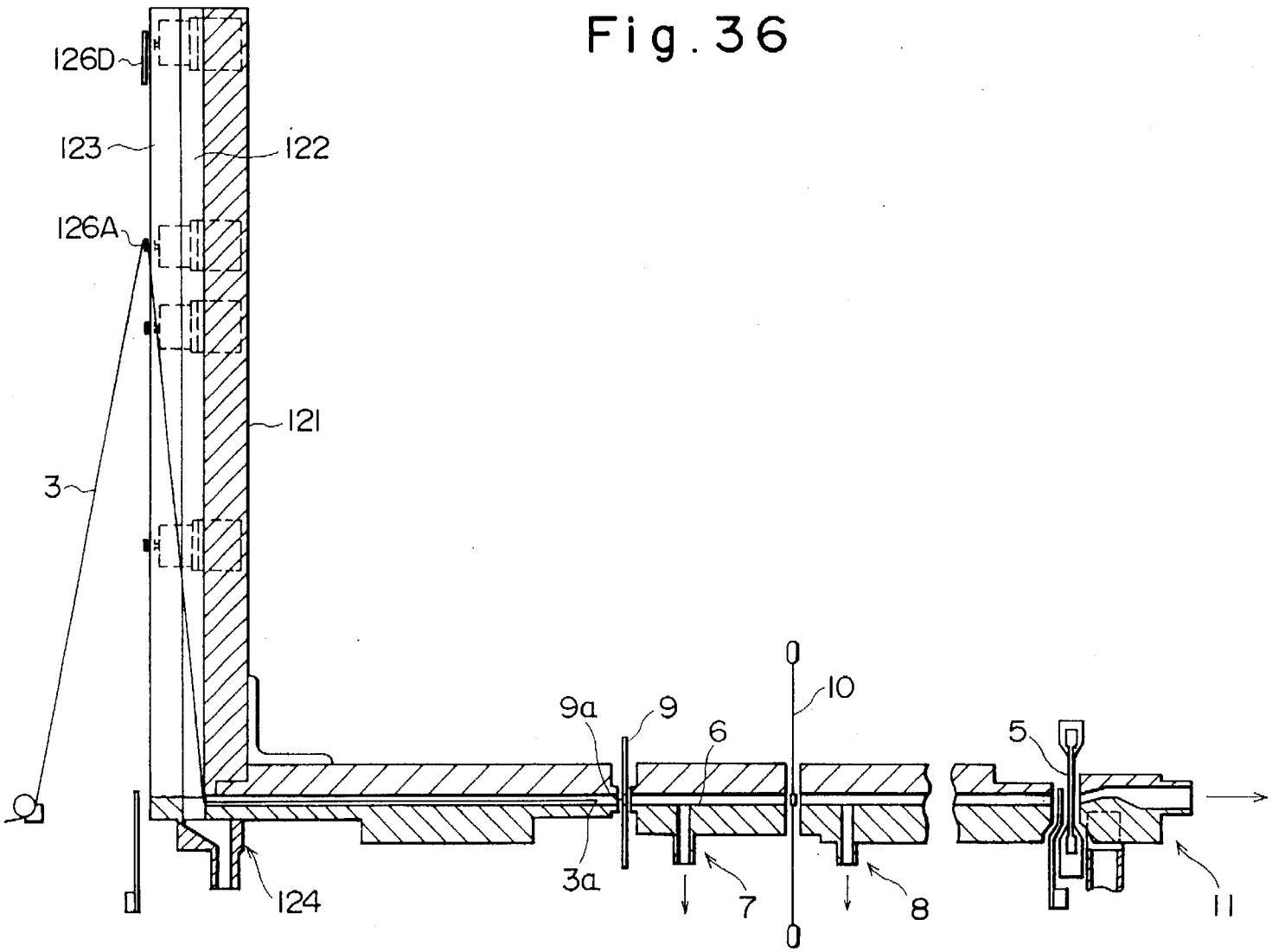
FIG. 36 is a cross-sectional view to show a state in which the warp is hooked on the warp feed/engagment device for the dropper.
Figure 37:
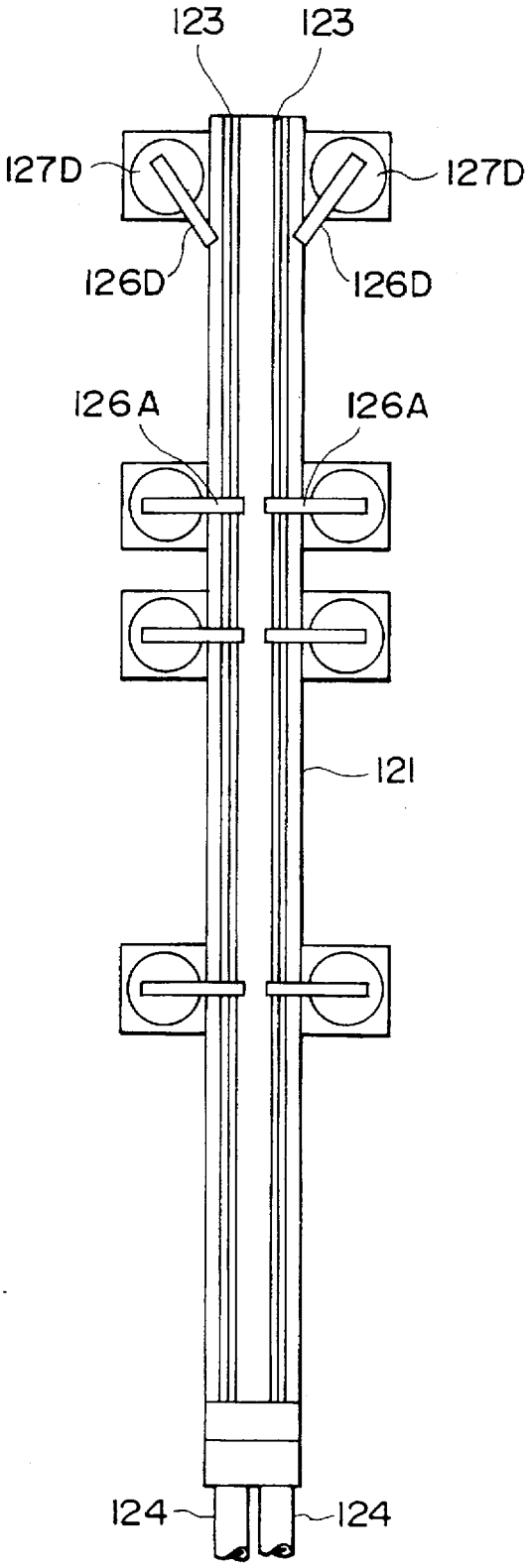
FIG. 37 is a front view of the apparatus shown in FIG. 36.

After that, the valve 124D of the frontmost suction portion 124 is closed to stop the vacuum suction of the frontmost suction portion 124. As a result, the tip portion 3*a* of the warp 3 in the frontmost suction portion 124 is pulled slightly into the warp conveying passage 6 by the airflow in the warp conveying passage 6. In this state, as shown in FIG. 37, the tip of the rotating lever 126D is directed down, whereby the warp 3 hooked on the rotating lever 126D is freed. At this time the warp 3 slips down along the slit 123, and the tip portion 3*a* of the warp 3 moves toward the dropper 9 in the warp conveying passage 6. Then, as shown in FIG. 36, the midway portion of the warp 3 comes to be hooked on the rotating lever 126A kept horizontal, and the tip portion 3*a* of the warp 3 stops immediately before the warp-passing hole 9*a* of dropper 9 with the warp 3 being stretched in a V-shape.

As a result, a bend near the tip portion 3*a* of warp 3 and a midway fold in the middle of the warp 3 can be eliminated as preparation for passing of warp through the dropper 9.

Figure 38:
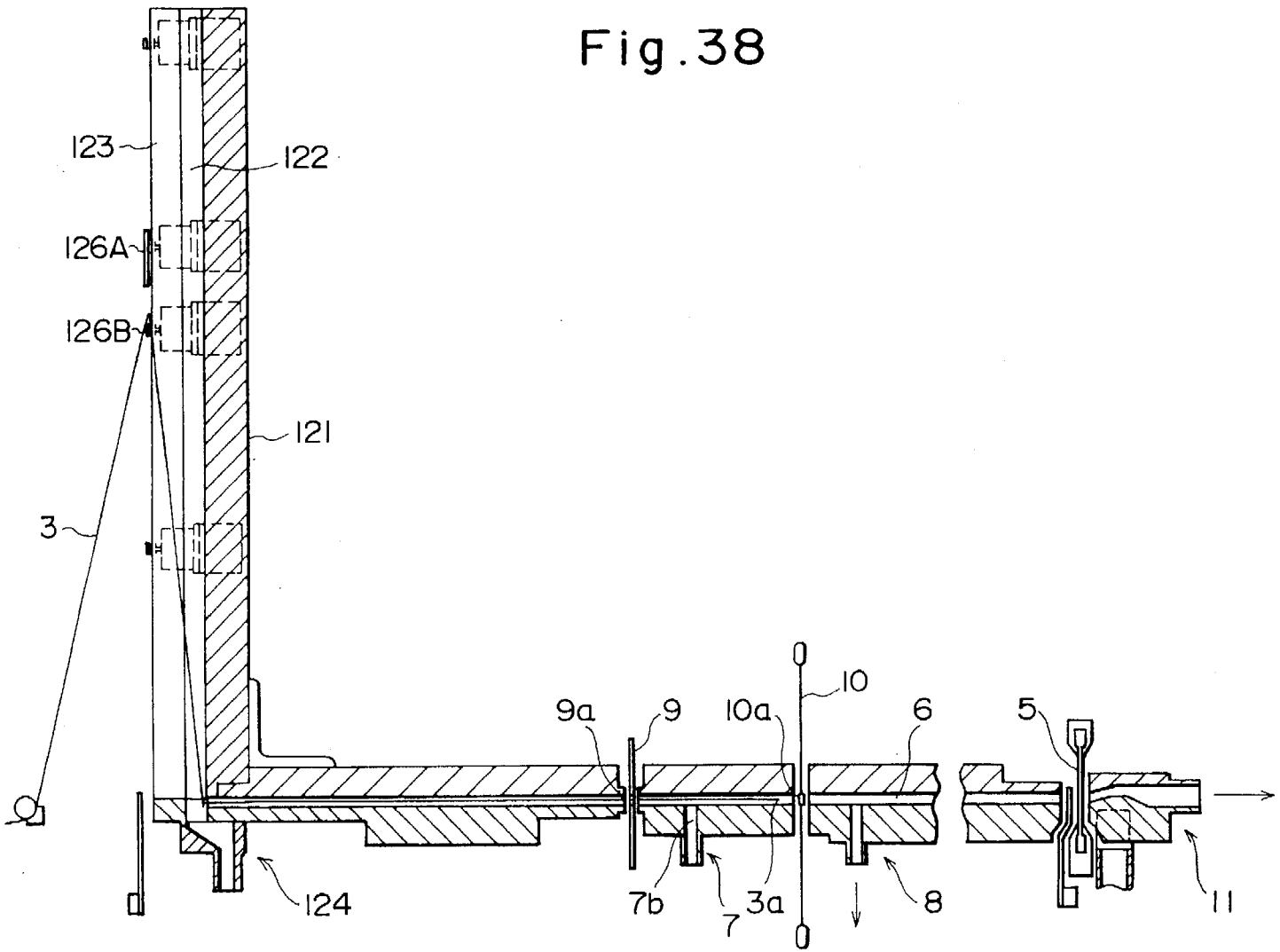
FIG. 38 is (FIG. 11) a cross-sectional view to show a state in which the warp is hooked on the warp feed/engagement device for the wire heald.
Figure 39:
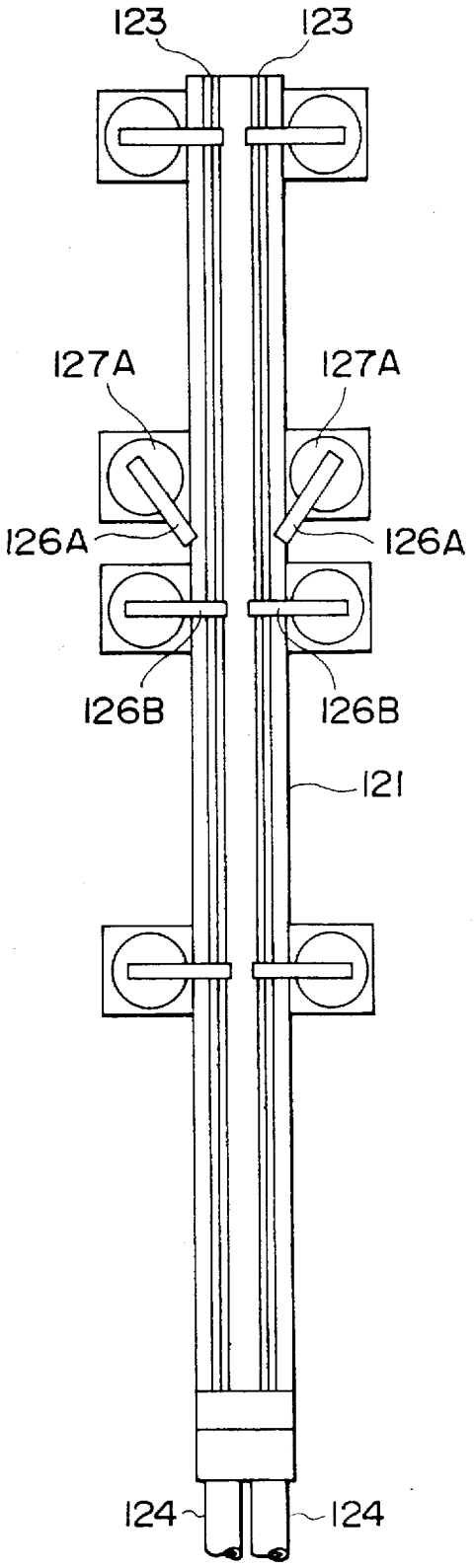
FIG. 39 is a front view of the apparatus shown in FIG. 37.

After that, the suction port 7*b* of the intermediate suction portion 7 is closed to stop the vacuum suction of the intermediate suction portion 7. In this state, as shown in FIG. 39, the tip of the rotating lever 126A is directed downward so as to free the warp 3 hooked on the rotating lever 126A. At this time the warp 3 slips down along the slit 123, and the tip portion 3*a* of the warp 3 passes through the warp-passing hole 9*a* of dropper 9 and thereafter moves toward the wire heald 10 in the warp conveying passage 6. Then, as shown in FIG. 38, the midway portion of the warp 3 comes to be hooked on the rotating lever 126B kept horizontal, and the tip portion 3*a* of the warp 3 stops immediately before the mail 10*a* of wire heald 10 with the warp 3 being stretched in a V-shape. As a result, a bend near the tip portion 3*a* of the warp 3 and a midway fold in the middle of the warp 3 can be eliminated as preparation for passing of warp through the wire heald 10.

Figure 40:
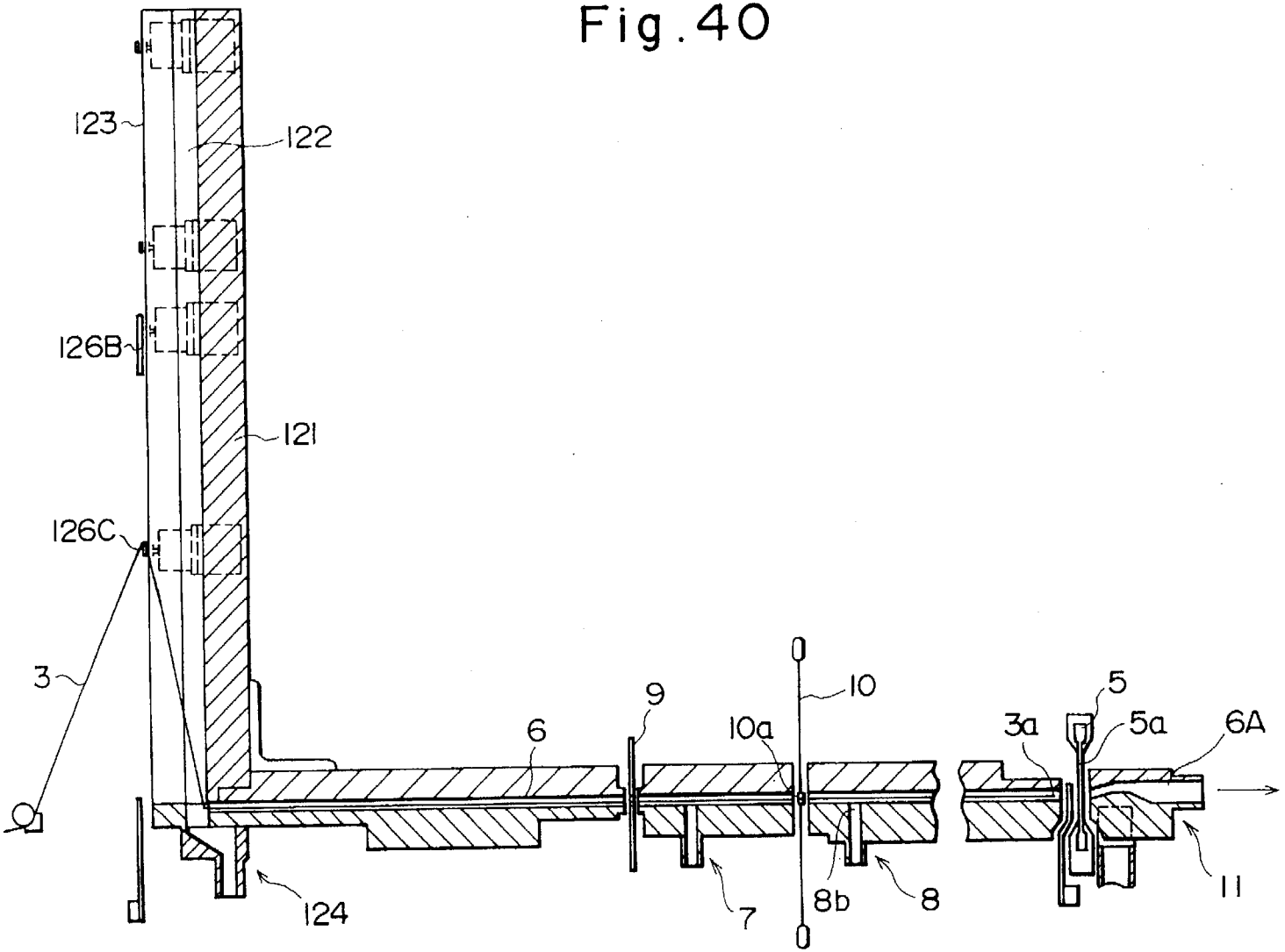
FIG. 40 is (FIG. 13) a cross-sectional view to show a state in which the warp is hooked on the warp reed.
Figure 41:
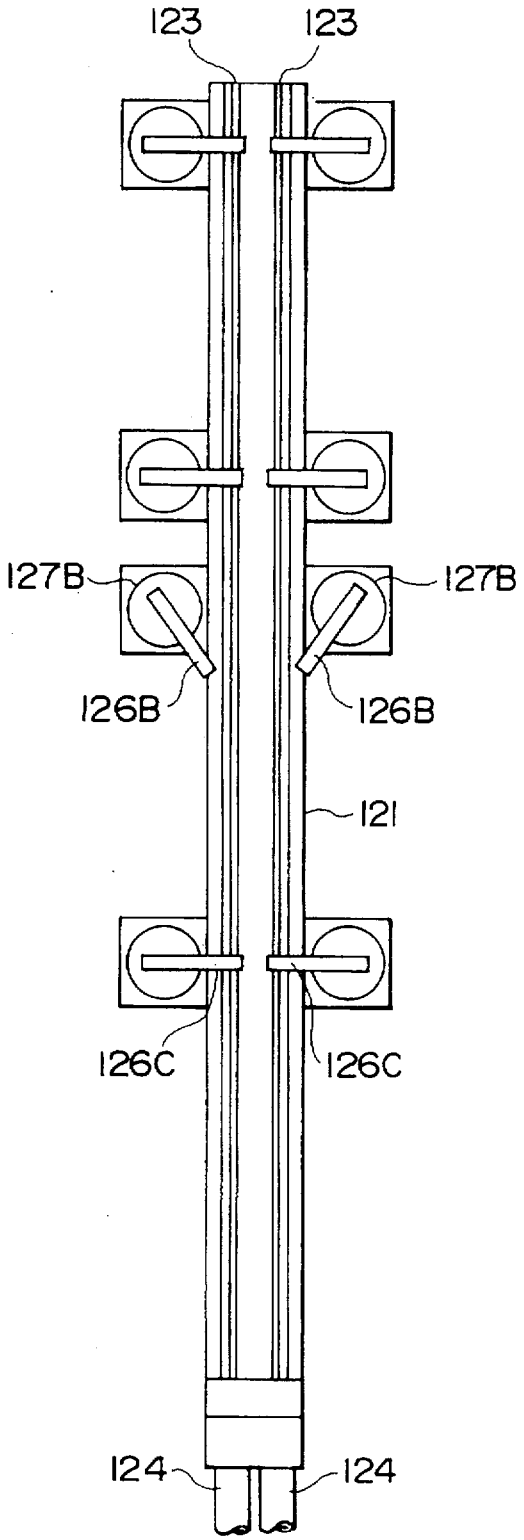
FIG. 41 is a front view of the apparatus shown in FIG. 40.

After that, the suction port 8*b* of the intermediate suction portion 8 is closed to stop the vacuum suction of the intermediate suction portion 8. In this state, as shown in FIG. 41, the tip of the rotating lever 126B is directed downward to free the warp 3 hooked on the rotating lever 126B. At this time, the warp 3 slips down along the slit 123, and the tip portion 3*a* of the warp 3 passes through the mail 10*a* of the wire heald 10 and thereafter moves toward the reed 5 in the warp conveying passage 6. Then, as shown in FIG. 40, the midway portion of the warp 3 comes to be hooked on the rotating lever 126C kept horizontal, and the tip portion 3*a* of the warp 3 stops immediately before the reed eye 5*a* of the reed 5 with the warp 3 being stretched in a V-shape. As a result, a bend near the tip portion 3*a* of the warp 3 and a midway fold in the middle of the warp 3 can be eliminated as preparation for passing of warp through the reed 5.

After that, as keeping the suction from the final suction portion 11 active, the tip of the rotating lever 126C is directed downward to free the warp 3 hooked on the rotating lever 126C. At this time, the warp 3 slips down along the slit 123, and the tip portion 3*a* of the warp 3 passes through the reed eye 5*a* of the reed 5 and thereafter goes into the warp conveying passage 6A, whereby the warp 3 is maintained in the shape along the warp conveying passage 6. As described, by the staged feed of the warp 3 drawn out of the warp beam 2, the warp 3 can be passed surely through the dropper 9, wire heald 10, and reed 5.

While the lever 126A to 126C in the rotating lever 126A to 126D as described above moves from the warp engagement position to the warp feed position, the rotating speed of the lever 126A to 126C in the rotating lever 126A to 126D is preferably controlled so that the moving speed of the warp 3 conveyed in the warp conveying passage 6 is slower than the speed of the airflow in the warp conveying passage 6. This makes a bend near the tip portion 3*a* of warp 3 and midway fold in the middle of the warp 3 hardly occur in the warp conveying passage 6, and the warp can be fed out surely with the warp 3 being stretched by the lever 126 A to 126C in the rotating lever 126A to 126D.

The number of rotating levers is not limited to four as described above. Namely, if the tip portion 3*a* of the warp 3 needs to be stopped at an arbitrary position in the warp conveying passage 6 in addition to those in the described case, an additional rotating lever will be provided in correspondence to that stop position, of course.

Figure 42:
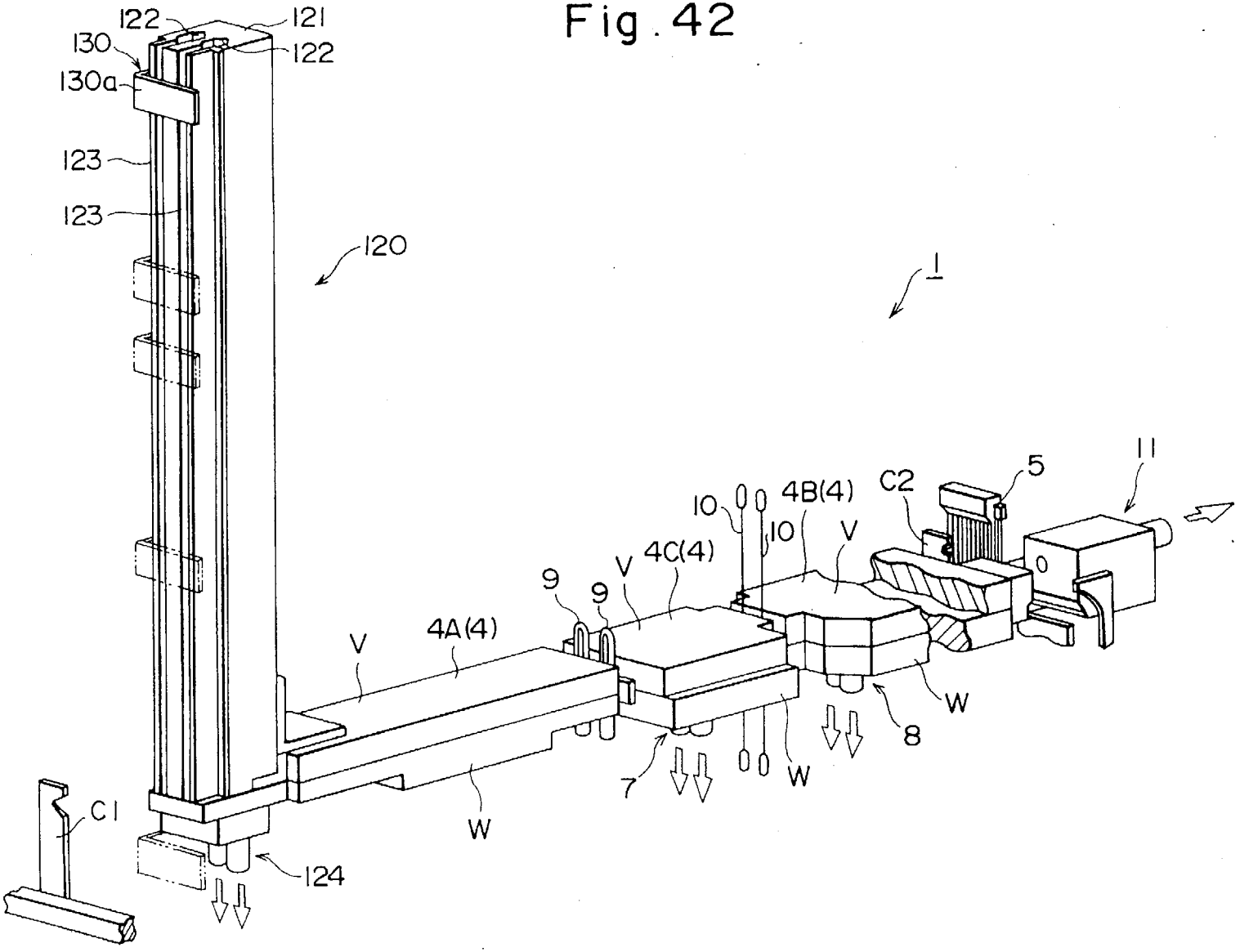
FIG. 42 is a perspective view to show the third embodiment of the warp passing apparatus according to the present invention.
Figure 43:
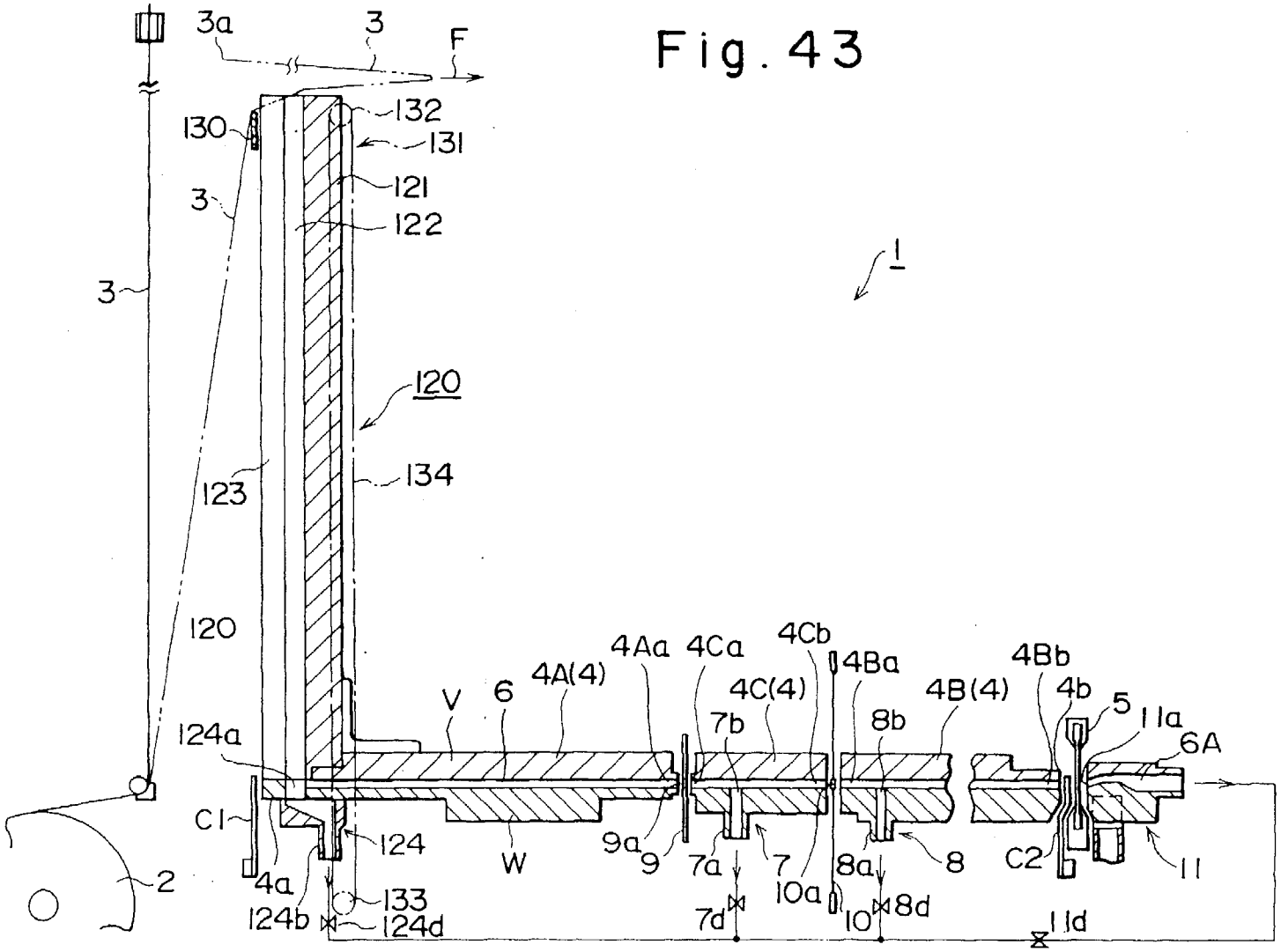
FIG. 43 is a longitudinal cross-sectional view of the warp passing apparatus shown in FIG. 42.

FIGS. 42 and 43 shows the third embodiment according to the present invention. Any elements having the same reference numerals and characters as those of the elements shown in FIGS. 1, 2, 31 and 32 has the same structures and fuctions and because such structure and fuctions has been explained above, the detailed explanations may be omitted.

Figure 44:
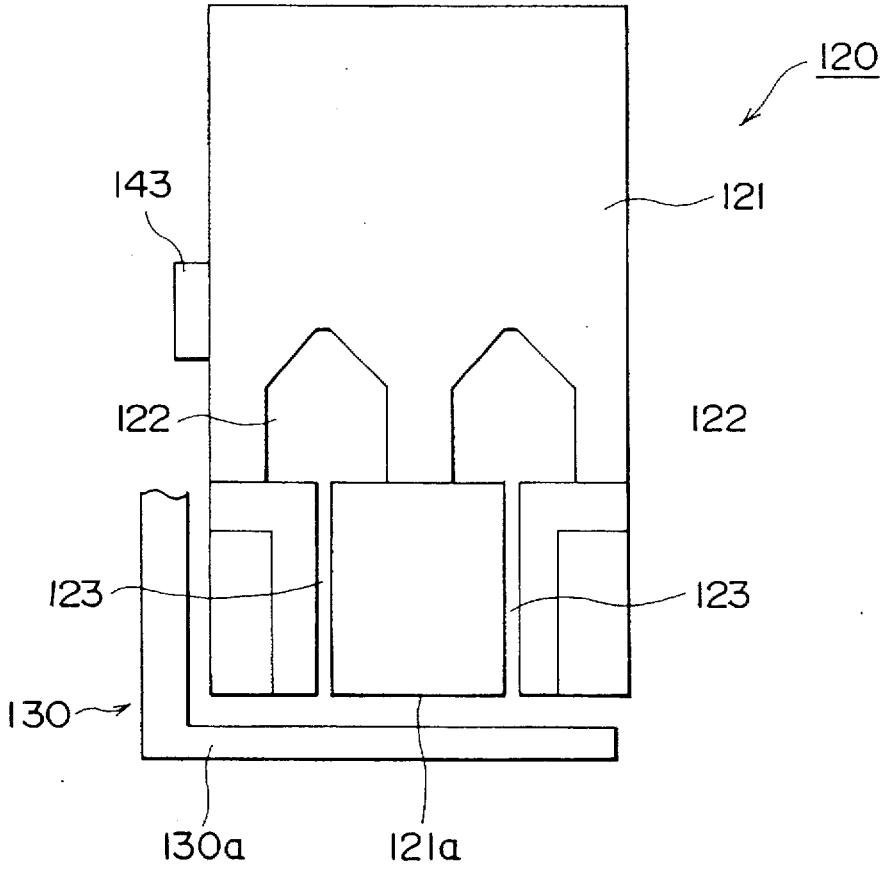
FIG. 44 is a plan view to show the feed regulating body of the embodiment shown in FIG. 42.
Figure 45:
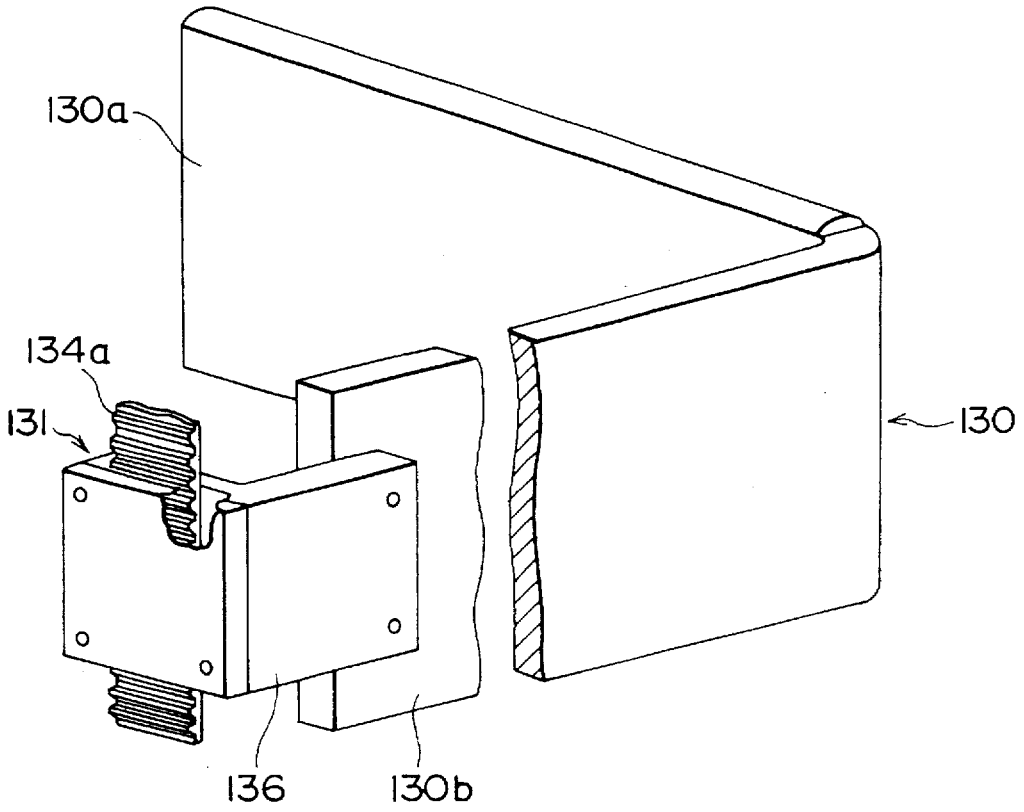
FIG. 45 is a perspective view to show the warp hook piece.

In the third embodiment, the feed regulator 120 has, as shown in FIG. 42 and FIG. 43, a warp hook piece 130 for the midway portion of the warp 3 suspended between the slit 123 and the warp beam 2 to be hooked thereon. This warp hook piece 130 is bent in an L-shape along the outside surfaces of the feed regulating body 121, as shown in FIG. 44 and FIG. 45, and a hook portion 130*a* of the warp hook piece 130 extends horizontally and faces the slits 123 at a position apart from the front face 121*a* of the feed regulating body 121. Also, the feed regulator 120 has a linear actuator 131 for rectilinearly driving the hook portion 130*a* of the warp hook piece 130 along the front face 121*a* of the feed regulating body 121.

Figure 46:
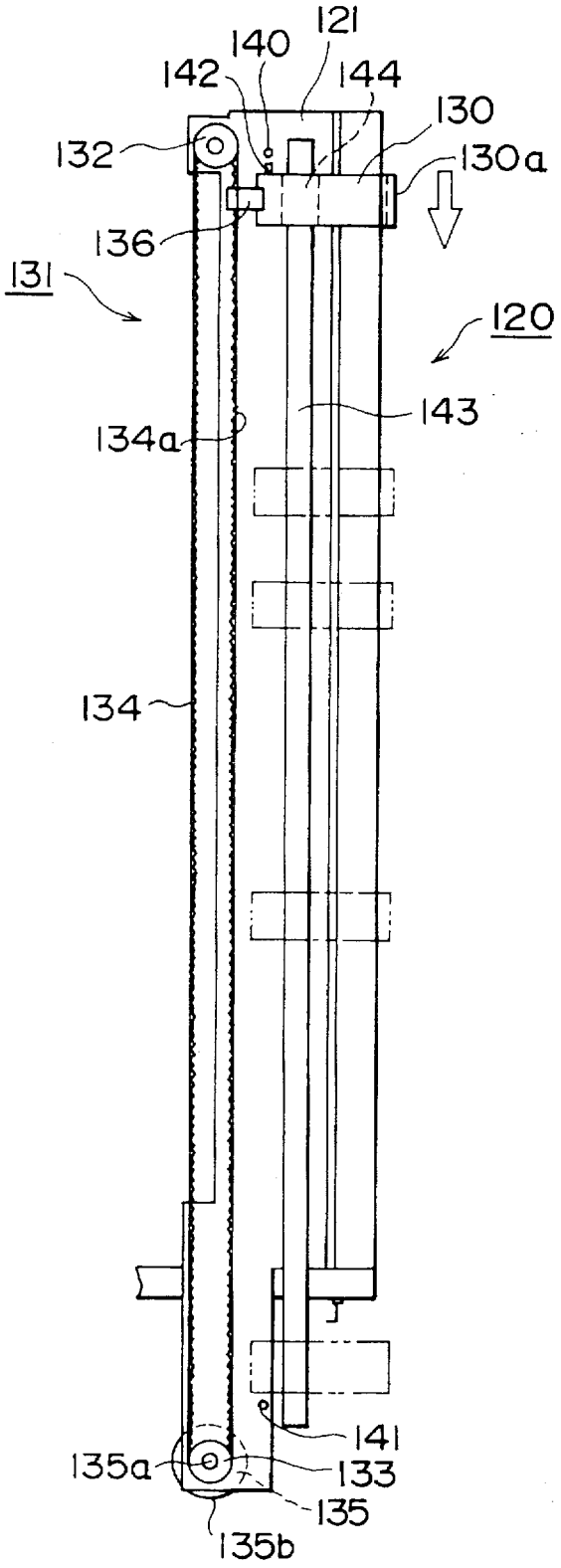
FIG. 46 is a side view to show a state in which the warp hook piece and linear actuator are mounted to the feed regulating body.

This linear actuator 131 is comprised of, as shown in FIG. 46, a pair of upper and lower timing pulleys 132, 133 rotatably mounted to the both upper and lower ends of the feed regulating body 121, a timing belt 134 wound around each timing pulley 132, 133 and stretched along the longitudinal direction of the feed regulating body 121, and a motor (for example, a pulse motor or servo motor or the like) 135 fixed to the lower timing pulley 133 on the side of output shaft 135*a* and fixed to the feed regulating body 121 on the side of body 135*b*. Then, as shown in FIG. 45, a base 130*b* of the warp hook piece 130 is fixed through a holder portion 136 with a suspended portion 134*a* of the timing belt 134. This holder 136 is formed in an L-shape, one end of the holder portion 136 is fixed by screw or the like to the base 130*b* of the warp hook piece 130, and the other end is fixed so as to pinch the suspended portion 134*a* of the timing belt 134.

Thus, as shown in FIG. 46, as the output shaft 135*a* of motor 135 is rotated in a predetermined direction, the lower timing pulley 133 rotates in the predetermined direction to move the holder portion 136 of the timing belt 134 hooked on this timing pulley 133 downward, and the warp hook piece 130 thus moves downward as following the motion of the timing belt 134. At this time, the moving speed of the warp hook piece 130 is controlled by the rotating speed of the output shaft 135*a* of the motor 135 so that the moving speed of the warp 3 moving in the warp conveying passage 6 becomes slower than the speed of the airflow in the warp conveying passage 6. Therefore, the warp 3 is hooked in a constantly stretched state on the hook portion 130*a* of the warp hook piece 130; even if the warp had a bend near the tip portion 3*a* of warp 3 or midway of warp 3 in the warp conveying passage 6, that state would be canceled in a moment, so that the warp 3 can be always maintained in a straight condition.

Reference numerals 140 and 141 denote limit sensors for sensing the warp hook piece 130 to stop drive of the motor 135, thereby preventing overrun of the warp hook piece 130. Numeral 142 designates an origin sensor for sensing the warp hook piece 130 to stop drive of motor 135, thereby stopping the warp hook piece 130 at a start position. Also, a guide rail 143 extending along the longitudinal direction of the feed regulating body is fixed to the side surface of the feed regulating body 121, and a slide bearing 144 provided in the warp hook piece 130 slidably engages with the guide rail 143, thereby achieving rectilinear motion of the warp hook piece 130 easily and surely.

The operation of the warp passing apparatus as described above is next explained based on the structure thereof.

First, similarly as in another embodiment described previously, the vacuum source 200 is actuated and the valves 124*d*, 7*d*, 8*d*, and 11*d* are opened, whereby the frontmost suction portion 24, intermediate suction portions 7, 8 and final suction portion 11 start evacuating the air in the warp conveying passage 6 and warp conveying passage 22 to a vacuum. At this time the vacuum suction force of the intermediate suction portions 7, 8 and final suction portion 11 is adjusted by the valves 7*d*, 8*d* and 11*d* or the like so as to create an appropriate stream of air directed to the reed 5 in the warp conveying passage 6. Also, the vacuum suction force of the frontmost suction portion 124 is adjusted by the valve 124*d* so as to create an appropriate stream of air directed downward in the warp feed passage 122.

Figure 47:
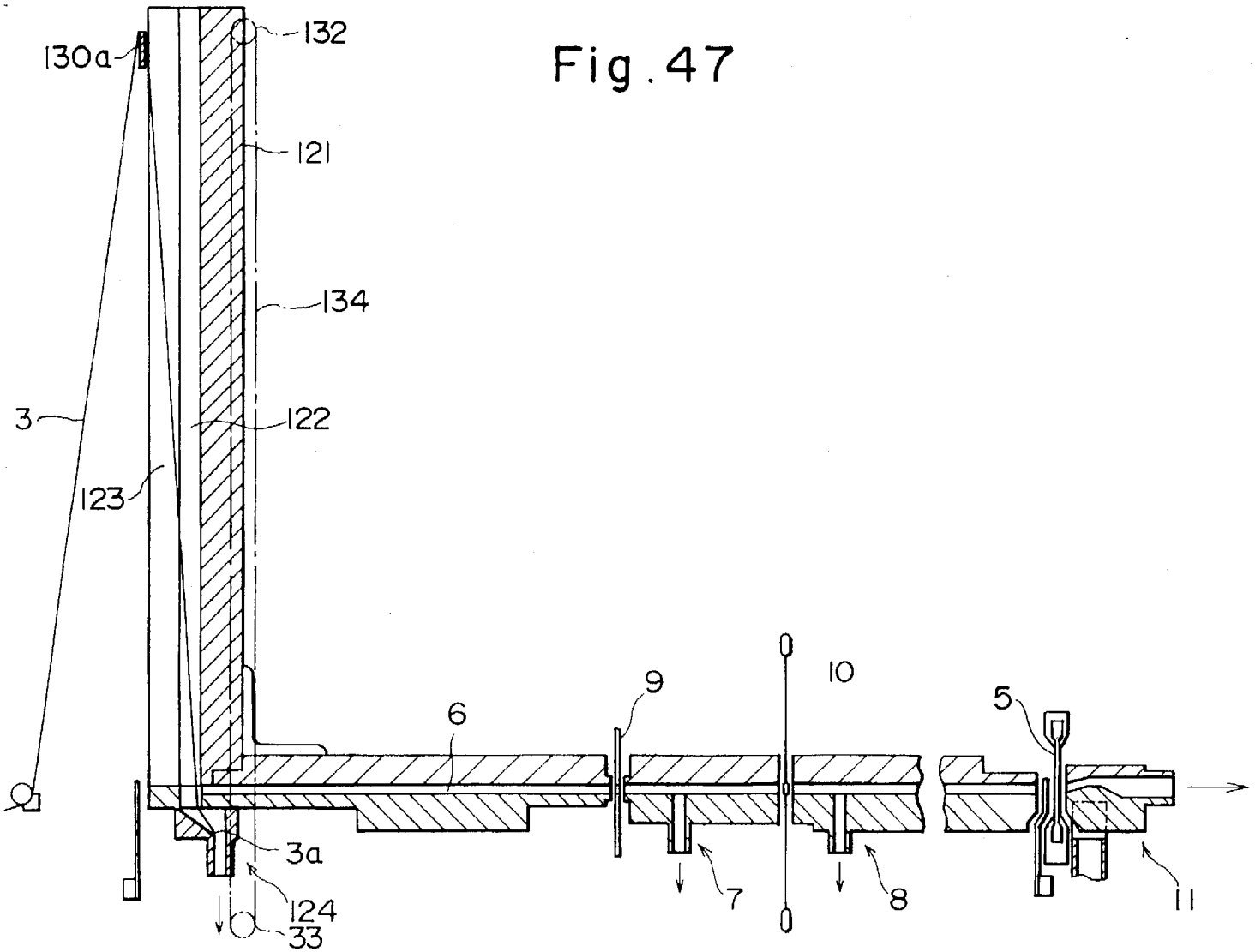
FIG. 47 is a cross-sectional view to show a state in which the warp is hooked on the warp hook piece located at the position of the origin.

Next, as shown in FIG. 43, after the tip portion 3*a* of the warp 3 extending from the warp beam 2 is freed, the warp pulling element not shown pulls the warp 3 in the direction of arrow F as catching it, and a portion of the warp 3 is put into the slit 123 as being located in the upper end open portion of the warp feed passage 122. As a result, the downward airflow occurring in the warp feed passage 122 pulls the warp 3 drawn out from the warp beam 2 into the warp feed passage 122. At this time, as shown in FIG. 47, while the midway portion of the warp 3 is hooked on the hook portion 130*a* of the warp hook piece 130 stopped at the origin position with the warp 3 being stretched in a V-shape, the tip portion 3*a* of the warp 3 goes slightly into the frontmost suction portion 124 under vacuum suction. This state is a preparation stage for continuously letting the warp 3 out.

Figure 48:
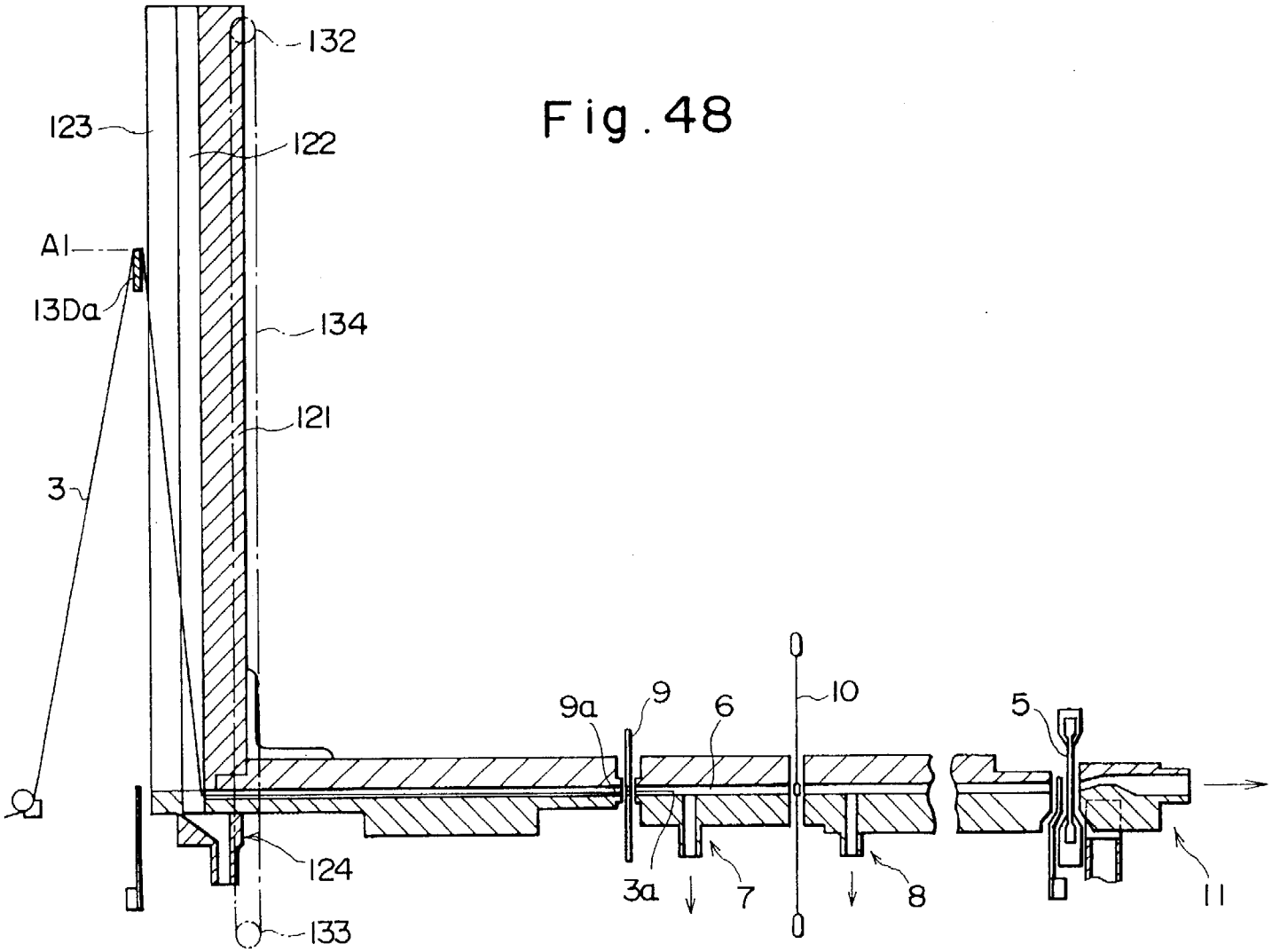
FIG. 48 is a cross-sectional view to show a state in which after the warp hook piece moves down, the tip portion of warp comes to immediately before the suction port behind the dropper.

After that, as shown in FIG. 48, the valve 124*d* of the frontmost suction portion 124 is closed to stop the vacuum suction of the frontmost suction portion 124. As a result, the tip portion 3*a* of the warp 3 present in the frontmost suction portion 124 is pulled slightly into the warp conveying passage 6 by the airflow in the warp conveying passage 6. In this sate the motor 135 is driven to rotate the lower timing pulley 133. As a result, the warp hook piece 130 moves down as following the motion of the timing belt 134 hooked on the timing pulleys 133. At this time, the warp hook piece 130 is moved so that the warp 3 moves down at a speed slower than the speed of the airflow in the warp conveying passage 6, whereby the warp 3 slips down along the slit 123 with the warp 3 being stretched in the V-shape by the warp hook piece 130, and the tip portion 3*a* of the warp 3 gradually moves toward the dropper 9 in the warp conveying passage 6.

When the hook portion 130*a* of the warp hook piece 130 comes to the position of A1 of FIG. 48, the tip portion 3*a* of the warp 3 is located immediately before the suction port 7*b* after the tip portion 3*a* has passed through the warp-passing hole 9*a*; at that moment the suction port 7*b* of the intermediate suction portion 7 is closed by a shutter mechanism 250 and the valve is closed, thereby stopping the vacuum suction of the intermediate suction portion 7. Then the tip portion 3*a* of the warp 3 passes through the warp-passing hole 9*a* of dropper 9 as the warp 3 hooked on the hook portion 130*a* gradually descending is pulled by the suction force of the intermediate suction portion 8 and final suction portion 11.

Figure 49:
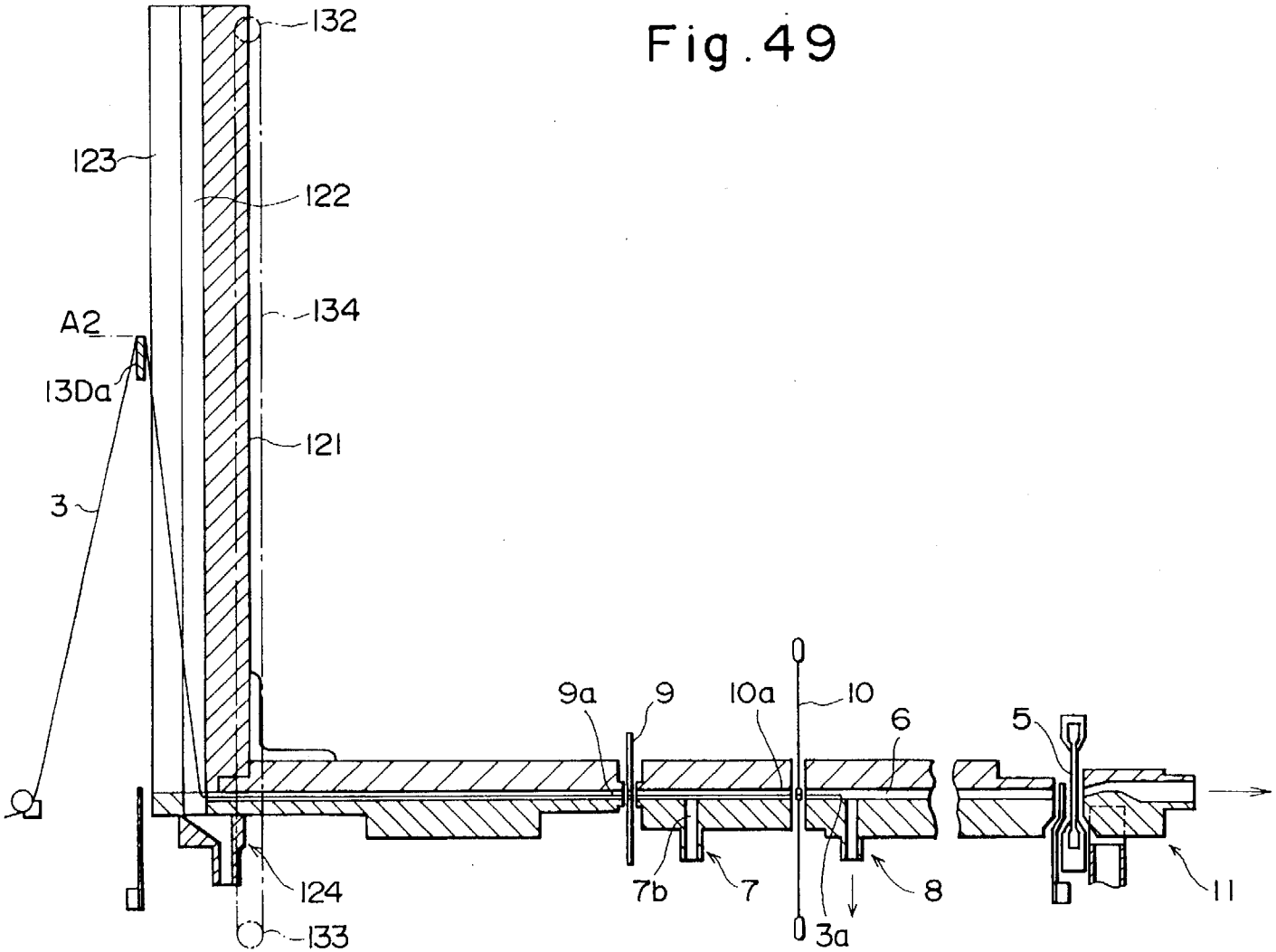
FIG. 49 is a cross-sectional view to show a state in which after the warp hook piece further moves down, the tip portion of warp comes to immediately before the suction port behind the wire heald.

Further, the warp hook piece 130 continues gradually descending; when the hook portion 130*a* of the warp hook piece 130 comes to the position of A2 of FIG. 49, the tip portion 3*a* of the warp 3 is located immediately before the suction port 8*b* after the tip portion 3*a* has passed through the warp-passing hole 9*a*; at that moment the suction port 8*b* of the intermediate suction portion 8 is closed by a shutter member 251 in the structure described hereinafter and the valve 8*d* is closed so as to stop the vacuum suction of the intermediate suction portion 8. Then, as the warp 3 hooked on the hook portion 130*a* gradually descending is pulled by the suction force of the final suction portion 11, the tip portion 3*a* of the warp 3 passes through the mail 10*a* of the wire heald 10.

Figure 50:
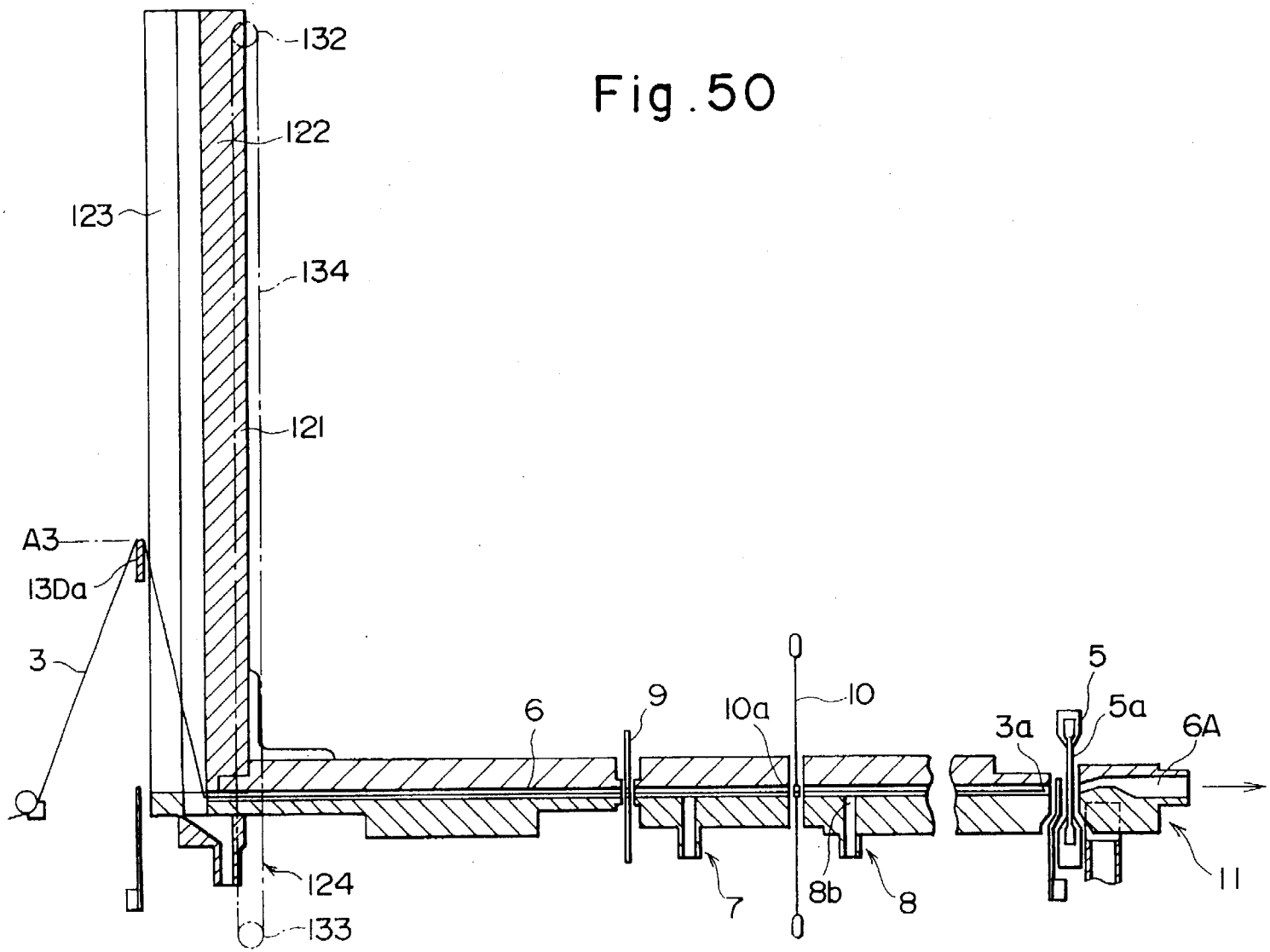
FIG. 50 is a cross-sectional view to show a state in which after the warp hook piece moves down, the tip portion of warp comes to immediately before the reed.

Further, the warp hook piece 130 continues gradually descending; when the hook portion 130*a* of the warp hook piece 130 comes to the position of A3 of FIG. 50, the tip portion 3*a* of the warp 3 is located immediately before the reed eye 5*a* of the reed 5 and the suction force of the final suction portion 11 is maintained. Then the warp hook piece 130 continues gradually descending; after the tip portion 3*a* of the warp 3 passes through the reed eye 5*a* of the reed 5, the tip portion goes into the warp conveying passage 6A and the warp 3 is maintained in the shape along the warp conveying passage 6. As described, by letting the warp 3 extended from the warp beam 2 out, the warp 3 can be passed surely through the dropper 9, wire heald 10, and reed 5.

Next explained is the shutter mechanism applied to the intermediate suction portions 7 and 8 in the above embodiments of the warp passing apparatus 1. A reason why such a shutter mechanism is employed is that simply keeping the suction port 7*b*, 8*b* open after stop of suction could cause the tip portion 3*a* of the warp 3 to go into the suction port 7*b*, 8*b* because of stagnation or turbulent flow of the air occurring near this suction port 7*b*, 8*b*. The shutter mechanism is applied to the intermediate suction portions 7 and 8, but the following description representatively explains it only as to the intermediate suction portion 7.

Figure 51:
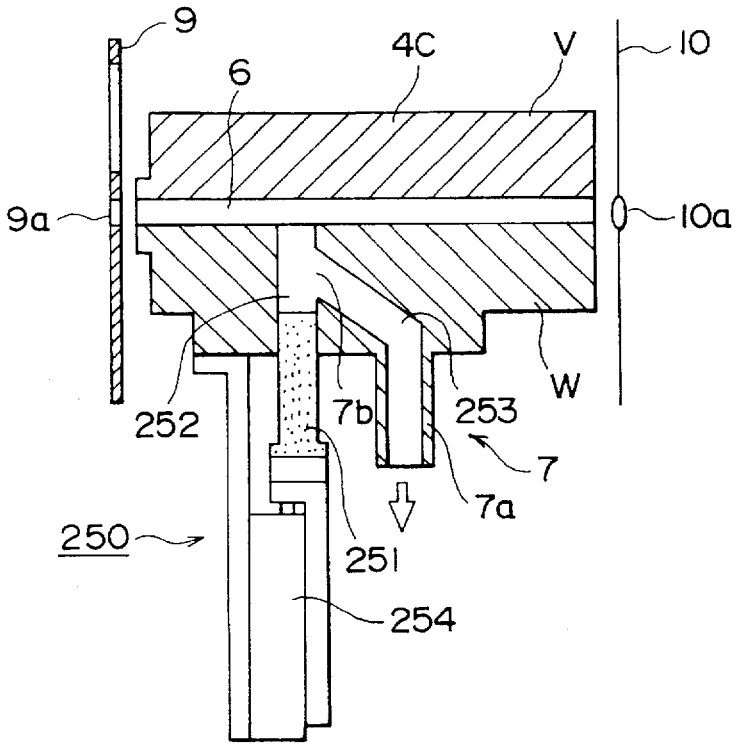
FIG. 51 is a cross-sectional view to show an example of the shutter mechanism applied to the warp passing apparatus of the present invention.

As shown in FIG. 51, the intermediate suction portion 7 is provided with the shutter mechanism 250, and the shutter mechanism 250 has a shutter member 251 for reciprocating up and down to open and close the suction port 7*b* communicating with the warp conveying passage 6. This shutter member 251 is comprised of a piston member, and it slides up and down in a piston sliding hole 252 formed in a lower guide member W of the third warp guide member 4C. This piston sliding hole 252 vertically and rectilinearly penetrates the lower guide member W and makes the warp conveying passage 6 communicate with the outside. The piston member may be arranged to move in non-contact reciprocating motion with a slight clearance without having to be slid in close contact in the piston sliding hole 252. The clearance in this case is determined so as to be small enough to neglect inflow and outflow of air.

Further, a suction hole 253 branched from midway of the piston sliding hole 252 is formed in the third warp guide member 4C, and this suction hole 253 is connected to an installed suction pipe 7*a* fixed to the lower guide member W of the third warp guide member As described, by connecting the suction hole 253 to midway of the piston sliding hole 252, an entrance portion of the suction hole 253 is formed midway of the piston sliding hole 252, and this becomes the suction port 7*b*. Further, the shutter mechanism 250 has an air cylinder 254 as a driving unit for driving the piston member (shutter member) 251 along the piston sliding hole 252, and this air cylinder 254 is fixed to the lower guide member W. A push-pull solenoid may be used in place of the air cylinder 254.

Figure 52:
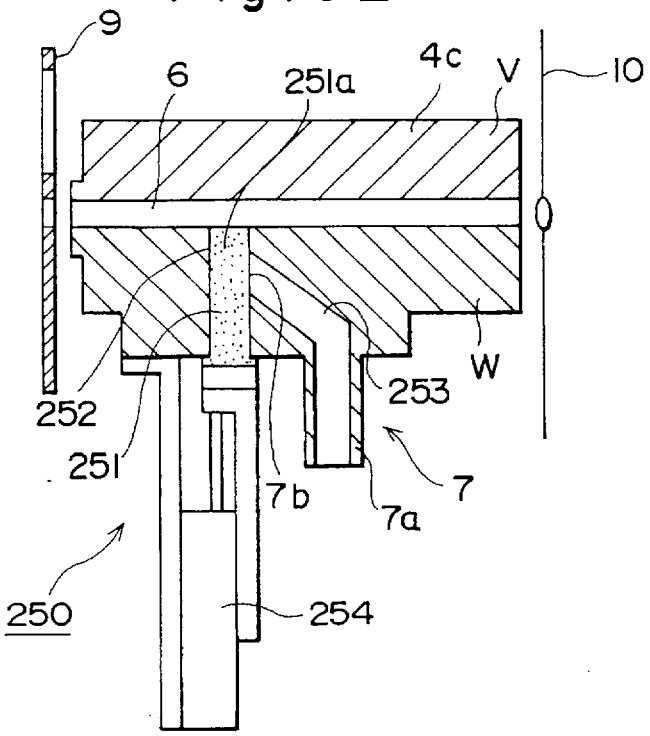
FIG. 52 is a cross-sectional view to show a state in which the suction port is closed by the shutter member shown in FIG. 51.

Thus, the air cylinder 254 is actuated to move the piston member 251 toward the suction port 7*b*, whereby the suction port 7*b* is closed by the side surface of the piston member 251, as shown in FIG. 52, so that a front end face 251*a* of the piston member 251 comes to be located in the same surface as a wall surface of the warp conveying passage 6 without projecting out into the warp conveying passage 6. As a result, the suction port 7b is brought into a state closed by the piston member 251, the warp conveying passage 6 becomes flat by the front end face 251a of the piston member 251, and thus, the warp 3 will never be caught in the warp conveying passage 6, whereby the tip portion 3a of the warp 3 is prevented from being pulled into the suction port 7b. Also, the air cylinder 254 is actuated to pull the piston member 251 back from the suction port 7b, whereby the suction port 7b is freed from the piston member 251, as shown in FIG. 51, thus permitting suction through the suction port 7b. In this way, the piston member (shutter member) 251 described above turns to the passage opening shutter member that always maintains the warp conveying passage 6 in the open state.

Figure 53:
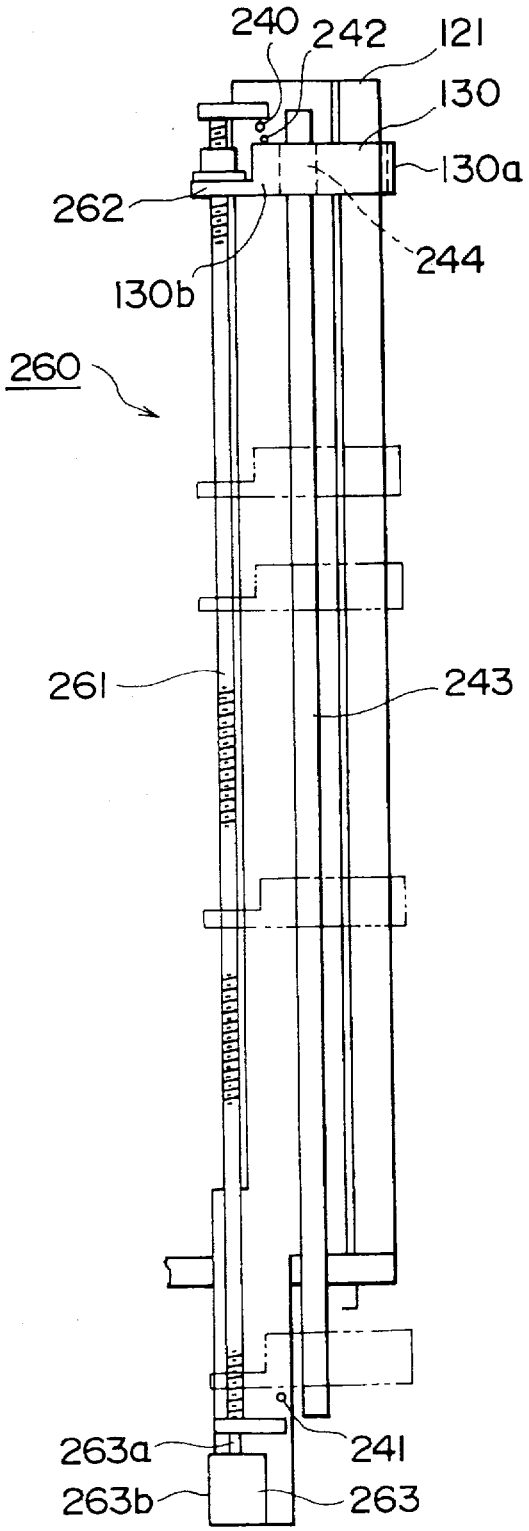
FIG. 53 is a side view to show another example of the linear actuator.

The present invention may employ a linear actuator 260 as shown in FIG. 53 without having to be limited to the above embodiment. This linear actuator 260 is comprised of a ball screw shaft 261 rotatably journaled at the both upper and lower ends of the feed regulating body 121 and extending along the longitudinal direction of the feed regulating body 121, a female screw portion 262 meshed with this ball screw shaft 261 and fixed to the base 130b of the warp hook piece 130, and a motor (for example, a pulse motor or servo motor or the like) 263 fixed to one end of the ball screw shaft 261 on the side of output shaft 263a and fixed to the feed regulating body 121 on the side of body 263b.

Then, the output shaft 263a of the motor 263 is rotated in a predetermined direction to rotate the ball screw shaft 261 in the predetermined direction and to move the female screw portion 262 meshed with this ball screw shaft 261 downward, whereby the warp hook piece 130 moves down as following the motion of this female screw portion 262. At this time, the rotating speed of the output shaft 163a of the motor 163 is controlled so that the moving speed of the warp 3 becomes slower than the speed of the airflow in the warp conveying passage 6. Accordingly, since the warp 3 is hooked, as always being stretched, on the hook portion 130a of the warp hook piece 130, even if a bend near the tip portion 3a of the warp 3 or a midway fold in the middle of warp 3 should occur in the warp conveying passage 6, that state would be canceled in a moment. Thus, the warp 3 can be always maintained in a straight state in the warp conveying passage 6.

The shutter mechanism shown in FIGS. 51 and 52 can be also applied to the first and second embodiments.

The present invention is by no means limited to the embodiments as described above, but it is needless to mention that flat healds may be applied instead of the wire healds 10.

The warp passing method and warp passing apparatus according to the present invention can achieve the following effects because of the arrangement as described above.

Namely, because a warp is passed through a dropper, a heald, and the reed by vacuum suction of the warp throughout the entire length of the warp conveying passage, even in the case of the gaps being formed in the warp conveying passage so as to communicate with the outside, no conveying air leaks through the gaps, which can prevent the tip portion of warp from jumping out through the gaps because of such air leakage, thus making passing of warp certain. Further, the structure to pass the warp through the dropper, heald, and reed does not employ any warp passing mechanism using the compressed air as before. Accordingly, the structure of the warp passing apparatus becomes extremely simplified, and especially, the warp conveying passages can be formed in a very simple shape.

By the arrangement to subject the tip portion of warp to staged vacuum suction as regulating the feed lengths of warp in stages, conveyance of warp in the warp conveying passage can be made surer, and in addition, the warp can be conveyed by the plurality of suction portions, which makes the suction force stronger than in the case of vacuum suction of warp by a single suction portion and which also makes sure passing of warp of thick yarn number or the like.

Further, utilization of the first drawing piece and the second drawing piece enables the warp to be discharged surely from the warp conveying passage throughout the entire length thereof. And the warp guide member is positioned between them, thereby preventing occurrence of an unexpected accident of failing to sweep the warp away through the warp sweep aperture.

Further, the arrangement to supply the compressed air into the warp conveying passages to sweep the warps away through the warp sweep aperture is effective, especially, in the case of discharging heavy warps of thick yarn number through the warp sweep aperture. In the above embodiments, the heald is explained as a steel wire heald but the flat steel can be also applied to the above embodiments.

From the invention thus described, it will be obvious that the invention may be varied in many ways. Such variations are not to be regarded as a departure from the spirit and scope of the invention, and all such modifications as would be obvious to one skilled in the art are intended to be included within the scope of the following claims.

The basic Japanese Application No.314187/1995 filed on Dec. 1, 1995 is hereby incorporated by reference.

What is claimed is:

1. A method for passing a warp wound around a warp beam through a warp-passing hole of a dropper, a mail of a heald, and a reed eye between reed wires of a reed, comprising the steps of:

disposing said dropper having said warp-passing hole and said heald having said mail in a warp conveying passage provided between said warp beam and said reed, providing a plurality of suction portions at positions spaced between said warp beam and said reed on said warp conveying passage, said suction portions providing a vacuum suction, passing a tip portion of said warp subjected to said vacuum suction toward said reed through said warp conveying passage, said warp-passing hole, and said mail, passing said tip portion of said warp through said reed eye between said reed wires, regulating the passing of said warp to pass said warp at successive increments such that said tip portion stops at said position of a first suction portion on said warp conveying passage after a first successive increment, stopping said vacuum suction provided by said first suction portion, continuing to pass said warp through said warp conveying passage, and stopping said tip portion of said position of a second suction portion.

2. A method for passing a warp wound around a warp beam through a warp-passing hole of a dropper, a mail of a heald, and a reed eye between reed wires of a reed, comprising the steps of:

disposing said dropper having said warp-passing hole and said heald having said mail in a warp conveying passage provided between said warp beam and said reed, passing a tip portion of said warp subjected to a vacuum suction toward said reed through said warp conveying passage, said warp-passing hole, and said mail, passing said tip portion of said warp through said reed eye between said reed wires, and regulating the passing of said warp to pass said warp in successive increments such that said tip portion is stopped immediately before passing through each of said warp-passing hole, said mail, and said reed eye.

3. A method for passing a warp wound around a warp beam through a warp-passing hole of a dropper, a mail of a heald, and a reed eye between reed wires of a reed, comprising the steps of:

disposing said dropper having said warp-passing hole and said heald having said mail in a warp conveying passage provided between said warp beam and said reed, said warp conveying passage having a length along a longitudinal axis, passing a tip portion of said warp subjected to a vacuum suction toward said reed through said warp conveying passage, said warp-passing hole, and said mail, passing said tip portion of said warp through said reed eye between said reed wires, opening said warp conveying passage after said warp has been passed through said warp-passing hole, said mail, and said reed eye to form a warp sweep aperture, said warp sweep aperture extending said length of said warp conveying passage, and removing said warp through said warp sweep aperture by removing said dropper and said heald from said warp conveying passage.

4. A warp passing method according to claim 3, wherein said warp is removed from said warp conveying passage by also moving drawing pieces disposed at opposite ends of said warp conveying passage in a direction generally perpendicular to said longitudinal axis of said warp conveying passage such that said warp is removed through said warp sweep aperture.

5. A warp passing method according to claim 3, wherein said warp is forced to be discharged through said warp sweep aperture by supplying compressed air into said warp conveying passage.

6. A warp-passing apparatus for passing a warp wound around a warp beam through a warp-passing hole of a dropper, a mail of a heald, and a reed eye between reed wires of a reed, comprising:

a warp guide member extending between said warp beam and said reed, a warp conveying passage provided inside of said warp guide member having an opening at an upstream end of said warp guide member adjacent said warp beam and at a downstream end of said warp guide member adjacent said reed, said warp guide member and said warp conveying passage constructed and arranged to permit said dropper with said warp-passing hole to be disposed within said warp guide member with said warp-passing hole in alignment with said warp conveying passage and to permit said heald with said mail to be disposed within said warp guide member with said mail in alignment with said warp conveying passage such that said warp passes through said warp-passing hole and said mail as said warp passes though said warp conveying passage, and a plurality of suction ports with valves thereon provided on and communicating with said warp conveying passage to provide a vacuum suction to pass said warp through said warp conveying passage towards said reed when said valves are open.

7. A warp-passing apparatus for passing a warp wound around a warp beam through a warp-passing hole of a dropper, a mail of a heald, and a reed eye between reed wires of a reed, comprising:

a warp guide member extending between said warp beam and said reed, a warp conveying passage with a length along a longitudinal axis provided inside of said warp guide member having an opening at an upstream end of said warp guide member adjacent said warp beam and at a downstream end of said warp guide member adjacent said reed, said warp guide member and said warp conveying passage constructed and arranged to permit said dropper with said warp-passing hole to be disposed within said warp guide member with said warp-passing hole in alignment with said warp conveying passage and to permit said heald with said mail to be disposed within said warp guide member with said mail in alignment with said warp conveying passage such that said warp passes through said warp-passing hole and said mail as said warp passes though said warp conveying passage, a suction portion communicating with said warp conveying passage and providing a vacuum suction to pass said warp through said warp conveying passage towards said reed, and a first passage member and a second passage member comprising said warp guide member and having interior surfaces defining said warp conveying passage, said first passage member and second passage member constructed and arranged such that said first passage member can be separated from said second passage member to define a warp sweep aperture along the length of said warp conveying passage through which said warp can be removed from said warp conveying passage by removing said dropper and said heald from within said warp guide member.

8. A warp-passing apparatus according to claim 7, further comprising:

a first drawing piece disposed between said upstream end of said warp guide member and said warp beam a second drawing piece disposed between said downstream end of said warp guide member and said reed, and wherein said drawing pieces are constructed and arranged to remove said warp from said warp conveying passage by moving said pieces in said direction generally perpendicular to said longitudinal axis of said warp conveying passage and catching said warp with said drawing pieces such that said warp is passed through said warp sweep aperture.

9. A warp-passing apparatus according to claim 7, further comprising a sweeping air supply portion communicating with said warp conveying passage to supply compressed air to said warp conveying passage to force said warp from said warp conveying passage through said warp sweep aperture.

10. A warp-passing apparatus for passing a warp wound around a warp beam through a warp-passing hole of a dropper, a mail of a heald, and a reed eye between reed wires of a reed, comprising:

a warp guide member extending between said warp beam and said reed, a warp conveying passage provided inside of said warp guide member having an opening at an upstream end of said warp guide member adjacent said warp beam and at a downstream end of said warp guide member adjacent said reed, said warp guide member and said warp conveying passage constructed and arranged to permit said dropper with said warp-passing hole to be disposed within said warp guide member with said warp-passing hole in alignment with said warp conveying passage and to permit said heald with said mail to be disposed within said warp guide member with said mail in alignment with said warp conveying passage such that said warp passes through said warp-passing hole and said mail as said warp passes though said warp conveying passage, a suction portion communicating with said warp conveying passage and providing a vacuum suction to pass said warp through said warp conveying passage towards said reed, and a feed regulating mechanism disposed adjacent said upstream end of said warp guide member for regulating said passing of said warp to pass said warp in successive increments such that a tip portion of said warp is stopped immediately before passing said tip portion through each of said warp-passing hole, said mail, and said reed eye; and wherein said feed regulating mechanism comprises:

a feed regulating body disposed adjacent said upstream end of said warp guide member and a having a front face;

a warp feed passage provided inside said feed regulating body and communicating with said warp conveying passage such that said vacuum suction provided by said suction portion draws said warp from said warp feed passage into said warp conveying passage;

a slit formed along said front face of said feed regulating body facing outwardly from said feed regulating body and communicating with said warp feed passage such that said warp passes into said warp feed passage though said slit; and a plurality of warp engaging structures provided on said feed regulating body, said warp engaging structures being constructed and arranged to catch said warp as said warp moves along said slit, thereby stopping said tip portion immediately before passing said tip portion through each of said warp-passing hole, said mail, and said reed eye, and to release said warp, thereby passing the warp in said successive increments.

11. A warp-passing apparatus according to claim 10, wherein said warp engaging structures are rotating levers or reciprocating pins constructed and arranged to move between a warp engagement position for catching said warp as said warp moves along said slit and a warp feed position for releasing said warp, said rotating levers or reciprocating pins being moved from said warp engagement position to said warp feed position such that said warp passes through said warp conveying passage at a speed slower than a speed of an airflow in said warp conveying passage caused by said vacuum suction provided by said suction portion.

12. A warp-passing apparatus according to claim 10, further comprising warp retaining devices provided on said feed regulating body and constructed and arranged to retain said warp in a stand-by position in said warp feed passage before passing said warp into said warp conveying passage.

13. A warp passing apparatus for passing a warp wound around a warp beam through a warp-passing hole of a dropper, a mail of a heald, and a reed eye between reed wires of a reed, comprising:

a warp guide member extending between said warp beam and said reed, a warp conveying passage provided inside of said warp guide member having an opening at an upstream end of said warp guide member adjacent said warp beam and at a downstream end of said warp guide member adjacent said reed, said warp guide member and said warp conveying passage constructed and arranged to permit said dropper with said warp-passing hole to be disposed within said warp guide member with said warp-passing hole in alignment with said warp conveying passage and to permit said heald with said mail to be disposed within said warp guide member with said mail in alignment with said warp conveying passage such that said warp passes through said warp-passing hole and said mail as said warp passes though said warp conveying passage, a suction portion communicating with said warp conveying passage and providing a vacuum suction to pass said warp through said warp conveying passage towards said reed, and a feed regulating mechanism disposed adjacent said upstream end of said warp guide member for regulating said passing of said warp in successive increments such that a tip portion of said warp is stopped immediately before passing said tip portion through each of said warp-passing hole, said mail, and said reed eye; and wherein said feed regulating mechanism comprises:

a feed regulating body disposed adjacent to said upstream end of said warp guide member and having a front face;

a warp feed passage provided inside said feed regulating body and communicating with said warp conveying passage such that said vacuum suction provided by said suction portions draws said warp from said warp feed passage into said warp conveying passage;

a slit formed along said front face of said feed regulating body facing outwardly from said feed regulating body and communicating with said warp feed passage such that said warp passes into said warp feed passage though said slit;

a warp hook piece movable in a longitudinal direction along said front face adjacent said slit and configured to catch a midway portion of said warp, said warp hook piece constructed and arranged to move in said longitudinal direction and stop at successive increments as said warp passes into said warp feed passage through said slit such that said tip portion stops immediately before passing through each of said warp-passing hole, said mail, and said reed eye, thereby passing said warp in successive increments; and a linear actuator for moving said warp hook piece along said front face of said feed regulating body.

14. A warp apparatus according to claim 13, wherein a moving speed of said warp moving in said warp conveying passage is slower than a speed of the airflow in said warp, conveying passage caused by said suction portion.

* * * * *

UNITED STATES PATENT AND TRADEMARK OFFICE

CERTIFICATE OF CORRECTION

PATENT NO. : 5,737,814

DATED : April 14, 1998

INVENTOR(S) : Kazunori KUROYANAGI; Toyoshi ITO

It is certified that error appears in the above-identified patent and that said Letters Patent is hereby corrected as shown below:

Title page, item

Please change:

"[75] Inventors: Kazunori Kuroyanagi, Inaga-gun;
Toyoshi Ito, Hamamatsu, both of Japan"

to

--[75] Inventors: Kazunori Kuroyanagi, Inasa-gun;
Toyoshi Ito, Hamamatsu-shi, both of Japan--.

Please change:

"[73] Assignee: Hamamatsu Photonics K.K.
Hamamatsu, Japan"

to

--[73] Assignee: Hamamatsu Photonics K.K.
Hamamatsu-shi, Japan--.

Signed and Sealed this
First Day of February, 2000

*Attest:*

Q. TODD DICKINSON

*Attesting Officer*

*Acting Commissioner of Patents and Trademarks*